US012061034B2

(12) United States Patent
Kim et al.

(10) Patent No.: US 12,061,034 B2
(45) Date of Patent: Aug. 13, 2024

(54) ICE MAKER AND REFRIGERATOR

(71) Applicant: LG ELECTRONICS INC., Seoul (KR)

(72) Inventors: Yonghyun Kim, Seoul (KR); Jinil Hong, Seoul (KR)

(73) Assignee: LG Electronics Inc., Seoul (KR)

( * ) Notice: Subject to any disclaimer, the term of this patent is extended or adjusted under 35 U.S.C. 154(b) by 0 days.

(21) Appl. No.: 18/119,429

(22) Filed: Mar. 9, 2023

(65) Prior Publication Data

US 2023/0213259 A1 Jul. 6, 2023

Related U.S. Application Data

(63) Continuation of application No. 16/685,373, filed on Nov. 15, 2019.

(30) Foreign Application Priority Data

Nov. 16, 2018 (KR) ..... 10-2018-0142115
Jul. 24, 2019 (KR) ..... 10-2019-0089841

(51) Int. Cl.
*F25C 5/08* (2006.01)
*F25C 1/04* (2018.01)
*F25C 1/243* (2018.01)

(52) U.S. Cl.
CPC ..... *F25C 5/08* (2013.01); *F25C 1/04* (2013.01); *F25C 1/243* (2013.01)

(58) Field of Classification Search
CPC .... F25C 5/08; F25C 1/04; F25C 1/243; F25C 5/06; F25C 1/18; F25C 1/25;
(Continued)

(56) References Cited

U.S. PATENT DOCUMENTS 1,868,503 A 7/1932 Kennedy
2,342,743 A * 2/1944 Lutes ..... F25C 1/24 249/75
(Continued)

FOREIGN PATENT DOCUMENTS

CN 2690816 4/2005
CN 102878744 1/2013
(Continued)

OTHER PUBLICATIONS

Extended European Search Report in European Application No. 19209405.0, mailed on Apr. 3, 2020, 8 pages.
(Continued)

*Primary Examiner* — Eric S Ruppert
*Assistant Examiner* — Kirstin U Oswald
(74) *Attorney, Agent, or Firm* — Fish & Richardson P.C.

(57) ABSTRACT

An ice maker includes: an upper tray defining an upper chamber that is a portion of an ice chamber; a lower tray defining a lower chamber that is another portion of the ice chamber, wherein the lower tray is relatively rotatable relative to the upper tray; and an upper heater disposed around the upper tray, for providing heat to the upper chamber, wherein the upper tray is made of a non-metal material and a flexible material, the upper heater is a DC heater receiving DC power, at least a portion of the upper tray is thicker than the lower tray, an accommodation part for accommodating the upper heater is formed on the upper tray, and at least a portion of the upper heater is disposed to vertically overlap the ice chamber in a state that the upper heater is accommodated in the accommodation part.

25 Claims, 29 Drawing Sheets

(58) Field of Classification Search
CPC ..... F25C 2400/08; F25C 2400/10; F25C 2500/02; F25C 2600/04; F25C 2700/12; F25D 23/12
USPC ..... 62/73
See application file for complete search history.

(56) References Cited

U.S. PATENT DOCUMENTS

| | | | | |
|---|---|---|---|---|
| 2,717,498 | A * | 9/1955 | Shagaloff | F25C 1/04 249/70 |
| 2,941,377 | A | 6/1960 | Nelson | |
| 2,941,378 | A | 6/1960 | Nelson | |
| 3,143,866 | A | 8/1964 | Frohbieter | |
| 3,678,701 | A * | 7/1972 | Powell | F25C 1/04 62/353 |
| 3,721,103 | A | 3/1973 | Brandt et al. | |
| 3,736,767 | A | 6/1973 | Lukes | |
| 4,429,550 | A | 2/1984 | Latter | |
| 4,910,974 | A * | 3/1990 | Hara | F25C 1/045 62/352 |
| 5,090,210 | A | 2/1992 | Katayanagi et al. | |
| 6,658,869 | B1 * | 12/2003 | Thornbrough | F25C 5/08 62/137 |
| 9,234,688 | B2 | 1/2016 | Son et al. | |
| 9,581,372 | B2 | 2/2017 | Lee et al. | |
| 2006/0086107 | A1 * | 4/2006 | Voglewede | F25C 1/246 62/157 |
| 2006/0086134 | A1 * | 4/2006 | Voglewede | F25C 5/06 62/353 |
| 2009/0178431 | A1 | 7/2009 | Cho | |
| 2011/0192175 | A1 | 8/2011 | Kuratani et al. | |
| 2013/0014535 | A1 | 1/2013 | Son et al. | |
| 2013/0014536 | A1 * | 1/2013 | Son | F25C 1/25 62/340 |
| 2013/0081412 | A1 * | 4/2013 | Son | F25C 5/04 62/340 |
| 2014/0165598 | A1 | 6/2014 | Boarman et al. | |
| 2014/0167321 | A1 | 6/2014 | Culley et al. | |
| 2014/0182325 | A1 * | 7/2014 | Lee | F25C 1/04 62/340 |

FOREIGN PATENT DOCUMENTS

| | | | |
|---|---|---|---|
| CN | 103423939 | 12/2013 | |
| CN | 105546898 | 5/2016 | |
| JP | 05203299 | 8/1993 | |
| JP | 2003056956 | 2/2003 | |
| JP | 2003114072 | 4/2003 | |
| JP | 2006105417 | 4/2006 | |
| KR | 20100065903 | 6/2010 | |
| KR | 1020110037609 | 4/2011 | |
| KR | 1020120064026 | 6/2012 | |
| KR | 20130009332 | 1/2013 | |
| KR | 101628876 | 6/2016 | |
| KR | 101850918 | 5/2018 | |
| WO | WO-2012169567 A1 * | 12/2012 | F25C 1/24 |

OTHER PUBLICATIONS

Huazi, "Mechanical Processing," Xinhua Bookstore Beijing Publishing House, Apr. 1984, 449-450, 4 pages.
International Search Report in International Application No. PCT/KR2019/015481, mailed on Feb. 26, 2020, 11 pages.
Office Action in Chinese Appln. No. 201911113697.2, dated Oct. 19, 2021, 17 pages (with English translation).
Office Action in Chinese Appln. No. 201911113697.2, mailed on Mar. 25, 2021, 17 pages (with English translation).

* cited by examiner

ICE MAKER AND REFRIGERATOR

CROSS-REFERENCE TO RELATED APPLICATIONS

This application is a continuation of U.S. application Ser. No. 16/685,373, filed on Nov. 15, 2019 which claims the benefit of priority to Korean Application No. 10-2018-0142115, filed on Nov. 16, 2018, and Korean Application No. 10-2019-0089841, filed on Jul. 24, 2019. The disclosures of the prior applications are incorporated by reference in their entirety.

BACKGROUND

The present disclosure relates to an ice maker and a refrigerator.

In general, refrigerators are home appliances for storing foods at a low temperature in a storage space that is covered by a door.

The refrigerator may cool the inside of the storage space by using cold air to store the stored food in a refrigerated or frozen state.

Generally, an ice maker for making ice is provided in the refrigerator.

The ice maker is constructed so that water supplied from a water supply source or a water tank is accommodated in a tray to make ice.

Also, the ice maker is constructed to transfer the made ice from the ice tray in a heating manner or twisting manner.

As described above, the ice maker through which water is automatically supplied, and the ice automatically transferred may be opened upward so that the mode ice is pumped up.

As described above, the ice made in the ice maker may have at least one flat surface such as crescent or cubic shape.

When the ice has a spherical shape, it is more convenient to ice the ice, and also, it is possible to provide different feeling of use to a user. Also, even when the made ice is stored, a contact area between the ice cubes may be minimized to minimize a mat of the ice cubes.

A prior art document, Korean Laid-open Publication No. 10-2013-0009332 provides an ice maker.

The ice maker of the prior art document comprises an upper plate tray forming an upper appearance, a lower plate tray selectively opening or closing the upper plate tray under the upper plate tray, a plurality of cells recessed in a hemispheric shape in the upper plate tray and the lower plate tray and having spherical ice formed inside in a state that the upper plate tray and the lower plate tray are closed, and a drive unit axis-coupled to at least one of the upper plate tray or the lower plate tray and configured to separate the upper plate tray and the lower plate tray by rotation.

A heater for heating the upper plate tray for ice separation of ice may be provided in the upper plate tray.

The upper plate tray may be made of a metal element, and the heater melts some of the spherical ice in contact with a surface of the upper plate tray by heating the upper plate tray made of the metal element.

However, by the prior art document, if the upper plate tray is made of a metal material, the upper plate tray has large thermal conductivity of the upper plate tray, and accordingly, there is a large amount of heat applied to a portion corresponding to a heater of the upper plate tray in ice when operating the heater.

Therefore, the portion corresponding to the heater in the ice is melted most. In this case, when the heater is turned-off, the portion heated by the heater in the ice is attached back to a surface of the upper tray, and accordingly, some of the ice may be made opaque.

A phenomenon of making the ice opaque after operating the heater like so gets worse, as an output of the heater gets larger.

In addition, when the ice is once melted and frozen and is again attached to the upper plate tray, since the ice is not easily detached from the upper plate tray, ice separation performance may be lowered.

SUMMARY

The present embodiment provides an ice maker preventing a phenomenon that some of ice is melted by heat of a heater for ice separation.

The present embodiment provides an ice maker allowing the heat of the heater to be uniformly transferred to a plurality of ice chambers.

The present embodiment provides an ice maker preventing an upper tray to droop in an ice separation process of ice.

The present embodiment provides an ice maker preventing a phenomenon of stretching some of the upper tray in the ice separation process of the ice.

The present embodiment provides an ice maker that can maintain a state that an upper ejector and an upper opening of the upper tray are aligned.

The present embodiment provides a refrigerator including the above-described ice maker.

An ice maker according to one aspect may comprise: an upper tray defining an upper chamber that is a portion of an ice chamber; a lower tray defining a lower chamber that is another portion of the ice chamber, wherein the lower tray is relatively rotatable relative to the upper tray; and an upper heater disposed around the upper tray, for providing heat to the upper chamber.

The upper tray may be made of a non-metal material and a flexible material, and the upper heater may be a DC heater receiving DC power. As an example, the upper tray may be made of a silicone material.

At least a portion of the upper tray defining the upper chamber may be thicker than the lower tray defining the lower chamber.

An accommodation part for accommodating the upper heater may be formed on the upper tray so that the heat of the upper heater is smoothly transferred to the upper chamber and a contact surface of the upper chamber and the lower tray, and at least a portion of the upper heater may be disposed to vertically overlap the ice chamber in a state that the upper heater is accommodated in the accommodation part.

The upper heater may comprise a round portion surrounding the upper chamber, and a linear portion connected to the round portion so that the heat of the upper heater is uniformly transferred to the upper chamber as a whole. The upper round portion may be disposed to vertically overlap the ice chamber.

The upper tray may comprise a plurality of upper chambers, and the upper heater may comprise the round portion so as to surround each of the plurality of upper chambers.

The ice maker may further comprise: an upper ejector including an ejecting pin inserted into the upper chamber such that ice of the ice chamber is separated from the upper tray; and an upper support supporting the upper tray.

The upper support may support a bottom surface of the upper tray. The upper tray may include a lower protrusion, and the upper support may include a lower slot in which the lower protrusion is accommodated.

The lower protrusion and the lower slot may be rounded in a horizontal direction.

The ice maker may further comprise an upper case supporting a top surface of the upper tray.

The upper case may contact a top surface of the upper tray.

The upper tray may include an upper protrusion, and the upper case may include an upper slot in which the upper protrusion is accommodated. The upper protrusion and the upper slot may be rounded in a horizontal direction.

The upper support may comprise a plurality of unit guides for guiding a vertical movement of the upper ejector. Each of the plurality of unit guides may include a guide slot for guiding the vertical movement of the upper ejector, wherein the upper ejector penetrates the guide slot.

The ice maker may further comprise an upper case having a heater coupling part coupled to the upper heater, wherein a portion of the upper case contacts a top surface of the upper tray.

The heater coupling part may be accommodated in the accommodation part in a state that the upper heater is coupled to the heater coupling part, and the upper heater may contact a bottom surface of the accommodation surface.

An ice maker according to another aspect may comprise: an upper tray defining a hemispherical upper chamber, a lower tray defining hemispherical lower chamber, and an upper heater for providing heat to the upper chamber.

As an example, the upper heater may be a DC heater. The upper tray may be made of a silicone material.

The ice maker may be fixed in a housing provided in a freezer of a refrigerator.

The ice maker may further comprise an upper support contacting a first surface of the upper tray and supporting the first surface.

In addition, the ice maker may further comprise an upper case contacting a second surface of the upper tray and coupled to the upper support.

The upper tray may comprise an upper tray body defining the upper chamber, and a horizontal extension part extending in a horizontal direction from the upper tray body.

The horizontal extension part may be disposed between a portion of the upper support and a portion of the upper case.

The first surface may be a top surface of the horizontal extension part, and the second surface may be a bottom surface of the horizontal extension part.

The upper case may include an upper plate contacting the first surface of the horizontal extension part. The upper plate may include an opening which the tray body penetrates.

The upper support includes a support plate contacting a bottom surface of the horizontal extension part. The support plate may include an opening which the upper tray body penetrates.

An upper protrusion may be provided on a top surface of the horizontal extension part. The upper plate may include an upper slot in which the upper protrusion is accommodated. The upper protrusion and the upper slot may be extended in a curved shape.

The upper protrusion and the upper lower protrusion may be rounded in a horizontal direction.

The lower protrusion may be provided on a bottom surface of the horizontal extension part. The support plate may include a lower slot in which the lower protrusion is accommodated.

The upper protrusion and the lower protrusion may be disposed to vertically overlap each other.

In the horizontal extension part, a plurality of upper protrusions may be spaced apart from one another in a horizontal direction, and a plurality of lower protrusions may be spaced apart from one another in the horizontal direction.

The upper protrusion may include a first top protrusion and a second top protrusion disposed in an opposite side of the first top protrusion based on the upper chamber.

The lower protrusion may include a first bottom protrusion and a second bottom protrusion disposed in an opposite side of the first bottom protrusion based on the upper chamber.

A distance between the first upper protrusion and the upper chamber may be different from a distance between the second upper protrusion and the upper chamber.

A distance between the first lower protrusion and the upper chamber may be different from a distance between the second lower protrusion and the upper chamber.

A coupling boss for coupling a coupling member is provided in the support plate. The horizontal extension part may include a penetration hole which the coupling boss penetrates. A sleeve in which the coupling boss penetrating the penetration hole is accommodated may be provided in the upper plate.

The coupling member may be coupled to the coupling boss accommodated in the sleeve upward from the sleeve.

The ice maker of this embodiment may further comprise an upper ejector provided with an upper ejector pin such that ice is separated from the upper tray, after completing an ice making.

The upper ejector may include an ejector body, and the upper ejector pin may be extended from the ejector body.

The upper support may further comprise a plurality of unit guides for guiding a vertical movement of the upper ejector. The plurality of unit guides may extend upward from the support plate.

A guide slot which the ejector body penetrates and guides a vertical movement of the upper ejector may be provided in each of the plurality of unit guides.

A plurality of penetration openings which the plurality of unit guides penetrate may be provided in the upper case.

In the upper case, a portion of the upper plate may form a recessed part recessed downward.

The upper tray body may penetrate an opening of a bottom of the recessed part, and a portion of the upper tray which the opening penetrates may be disposed in the recessed part.

The upper tray body may further comprise an accommodation part in which the recessed part is accommodated.

The upper tray body may comprise an upper opening and an inlet wall extending along a circumference of the opening.

The inlet wall and the upper tray body may be connected by a first connection rib.

Two adjacent inlet walls may be connected by a second connection rib.

A refrigerator according to another aspect comprises a cabinet defining a storage space; and an ice maker for making ice by using cold air of the storage space, and the ice maker comprises: an upper tray defining a portion of an ice chamber; an upper support supporting a portion of a bottom surface of the upper tray; an upper case supporting a portion of a top surface of the upper tray; and an upper heater for providing heat to the upper chamber, wherein the upper tray is made of a non-metal material, and the upper heater is a DC heater.

The upper tray may be made of a non-metal material, and the upper heater may be a DC heater. The upper tray may be made of a silicone material.

The ice maker may further comprise a lower tray defining another portion of the ice chamber, wherein the lower tray is relatively rotatable relative to the upper tray. At least a portion of the upper tray defining the upper chamber is thicker than the lower tray defining the lower chamber.

The ice maker according to another aspect may further comprise an upper tray defining an upper chamber that is a portion of the ice chamber; a upper tray defining a lower chamber that is another portion of the ice chamber and relatively rotatable relative to the upper tray; an upper heater disposed around the upper tray, for providing heat to the upper chamber; an upper ejector including an ejector pin inserted into the upper chamber; and an upper support supporting the upper tray.

The upper support may comprise a plurality of unit guides for guiding a vertical movement of the upper ejector.

A guide slot which the upper ejector penetrates and guides a vertical movement of the upper ejector may be provided in each of the plurality of unit guides.

The ice maker according to another aspect may further comprise: an upper tray defining an upper chamber that is a portion of the ice chamber; a upper tray defining a lower chamber that is another portion of the ice chamber and relatively rotatable relative to the upper tray; an upper heater disposed around the upper tray, for providing heat to the upper chamber; an upper support contacting a bottom surface of the upper tray and supporting the bottom surface; and an upper case coupled to the upper support.

The ice maker may comprise an upper tray body defining the upper chamber and the horizontal extension part extending in the horizontal direction for the upper tray body.

The upper case may include an upper plate contacting the top surface of the horizontal extension part. The upper plate may include an opening which the upper tray body penetrates.

The upper support may include the support plate contacting the bottom surface of the horizontal extension part. The support plate may include an opening which the upper tray body penetrates.

An upper protrusion may be formed on the top surface of the horizontal extension part, and a lower protrusion may be formed on the bottom surface, and the upper slot inserted into the upper protrusion may be formed in the upper plate, and the upper slot inserted into the lower protrusion may be formed in the support plate.

DETAILED DESCRIPTION OF THE EMBODIMENTS

Figure 1:
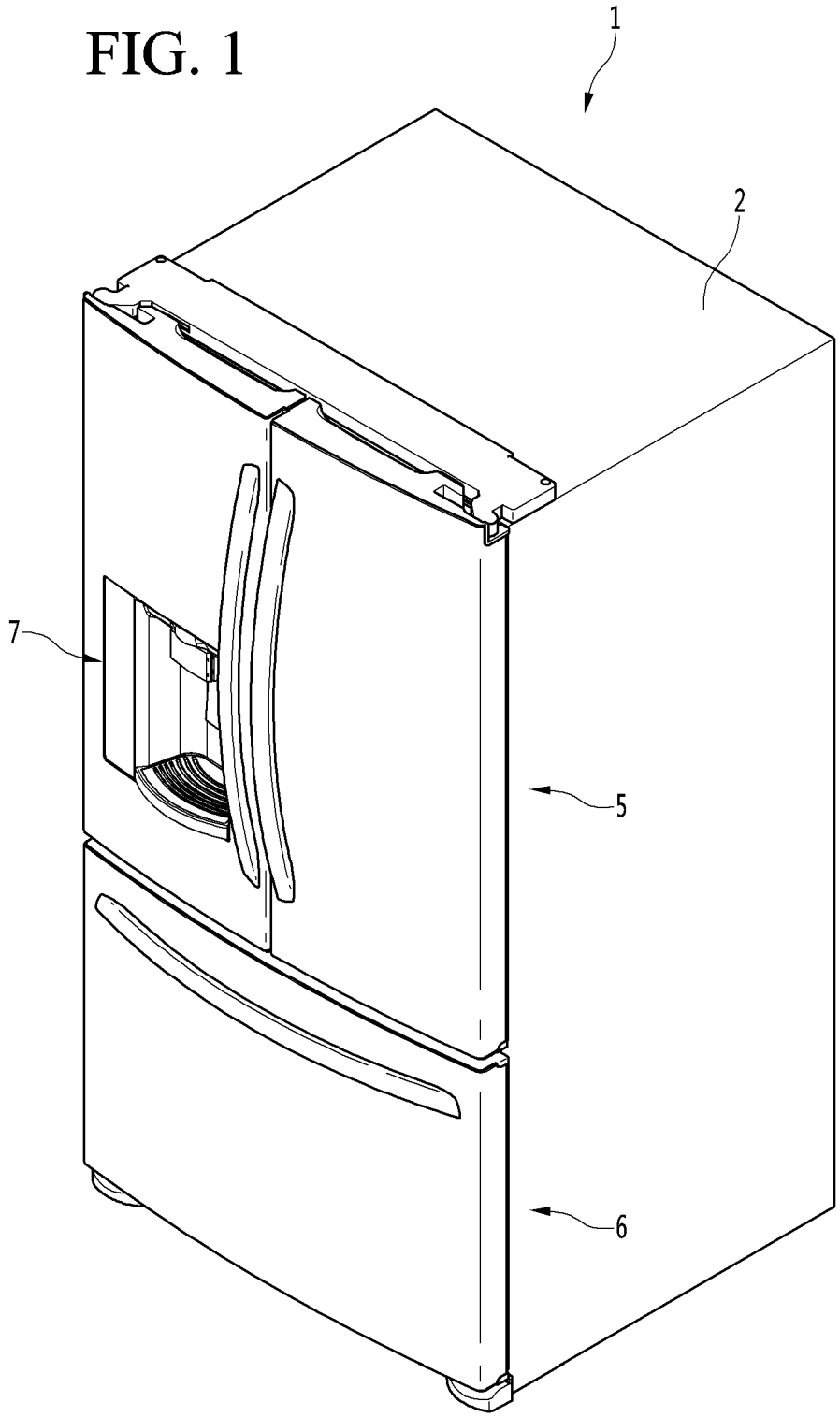
FIG. 1 is a perspective view of a refrigerator according to one embodiment of the present disclosure.
Figure 2:
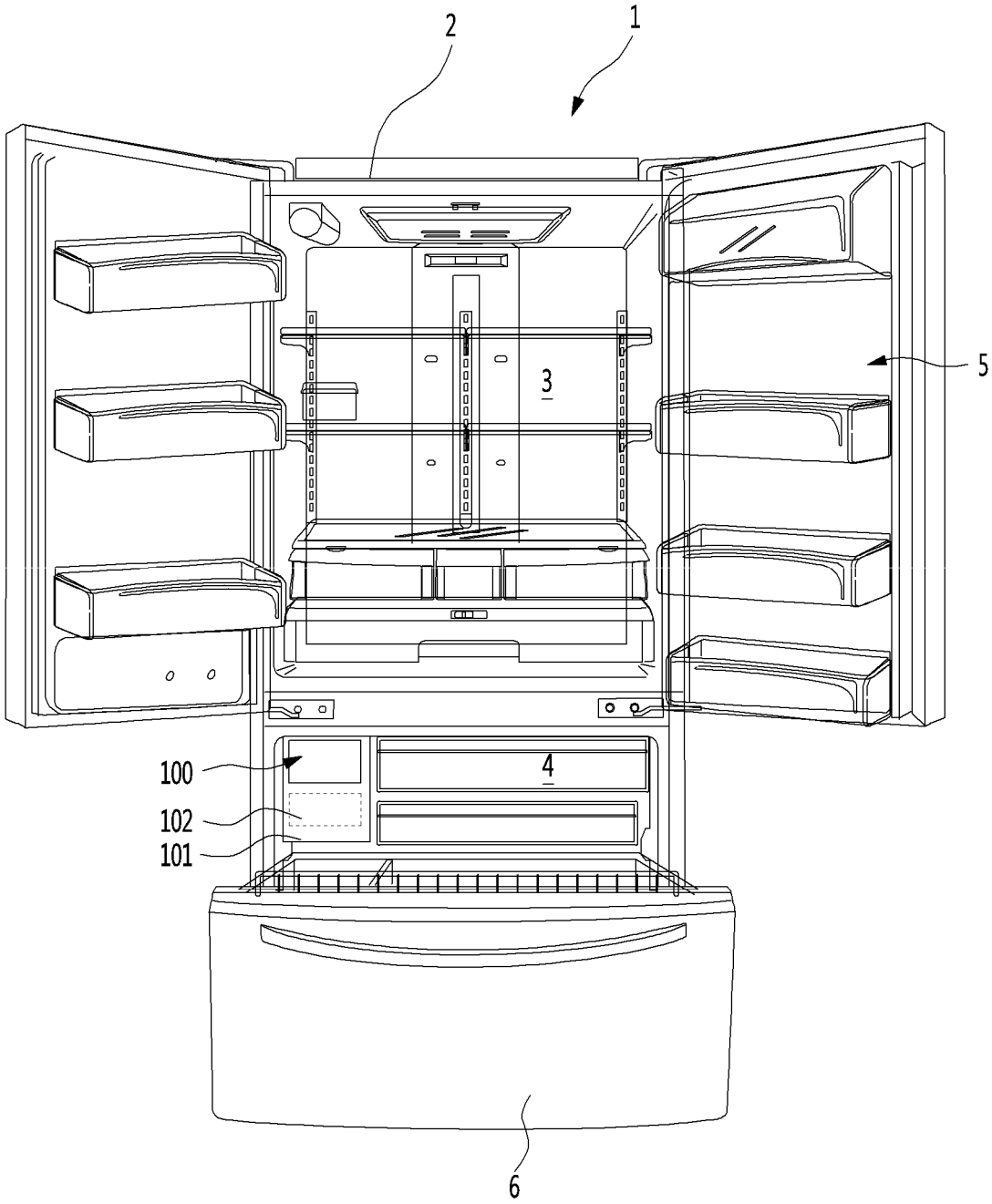
FIG. 2 is a view showing a state in which a door of the refrigerator of FIG. 1 is opened.

FIG. 1 is a perspective view of a refrigerator according to an embodiment, and FIG. 2 is a view illustrating a state in which a door of the refrigerator of FIG. 1 is opened.

Referring to FIGS. 1 and 2, a refrigerator 1 according to an embodiment may include a cabinet 2 defining a storage space and a door that opens and closes the storage space.

In detail, the cabinet 2 may define the storage space that is vertically divided by a barrier. Here, a refrigerating compartment 3 may be defined at an upper side, and a freezing compartment 4 may be defined at a lower side.

Accommodation members such as a drawer, a shelf, a basket, and the like may be provided in the refrigerating compartment 3 and the freezing compartment 4.

The door may include a refrigerating compartment door 5 opening/closing the refrigerating compartment 3 and a freezing compartment door 6 opening/closing the freezing compartment 4.

The refrigerating compartment door 5 may be constituted by a pair of left and right doors and be opened and closed through rotation thereof. Also, the freezing compartment door 6 may be inserted and withdrawn in a drawer manner.

Alternatively, the arrangement of the refrigerating compartment 3 and the freezing compartment 4 and the shape of the door may be changed according to kinds of refrigerators, but are not limited thereto. For example, the embodiments may be applied to various kinds of refrigerators. For example, the freezing compartment 4 and the refrigerating compartment 3 may be disposed at left and right sides, or the freezing compartment 4 may be disposed above the refrigerating compartment 3.

An ice maker 100 may be provided in the freezing compartment 4. The ice maker 100 is constructed to make ice by using supplied water. Here, the ice may have a spherical shape.

Also, an ice bin 102 in which the ice is stored after being transferred from the ice maker 100 may be further provided below the ice maker 100.

The ice maker 100 and the ice bin 102 may be mounted in the freezing compartment 4 in a state of being respectively mounted in separate housings 101.

A user may open the refrigerating compartment door 6 to approach the ice bin 102, thereby obtaining the ice.

In another example, a dispenser for dispensing purified water or the made ice to the outside may be provided in the refrigerating compartment door 5.

Also, the ice made in the ice maker 100 or the ice stored in the ice bin 102 after being made in the ice maker 100 may be transferred to the dispenser by a transfer unit. Thus, the user may obtain the ice from the dispenser.

Hereinafter, the ice maker will be described in detail with reference to the accompanying drawings.

Figure 3:
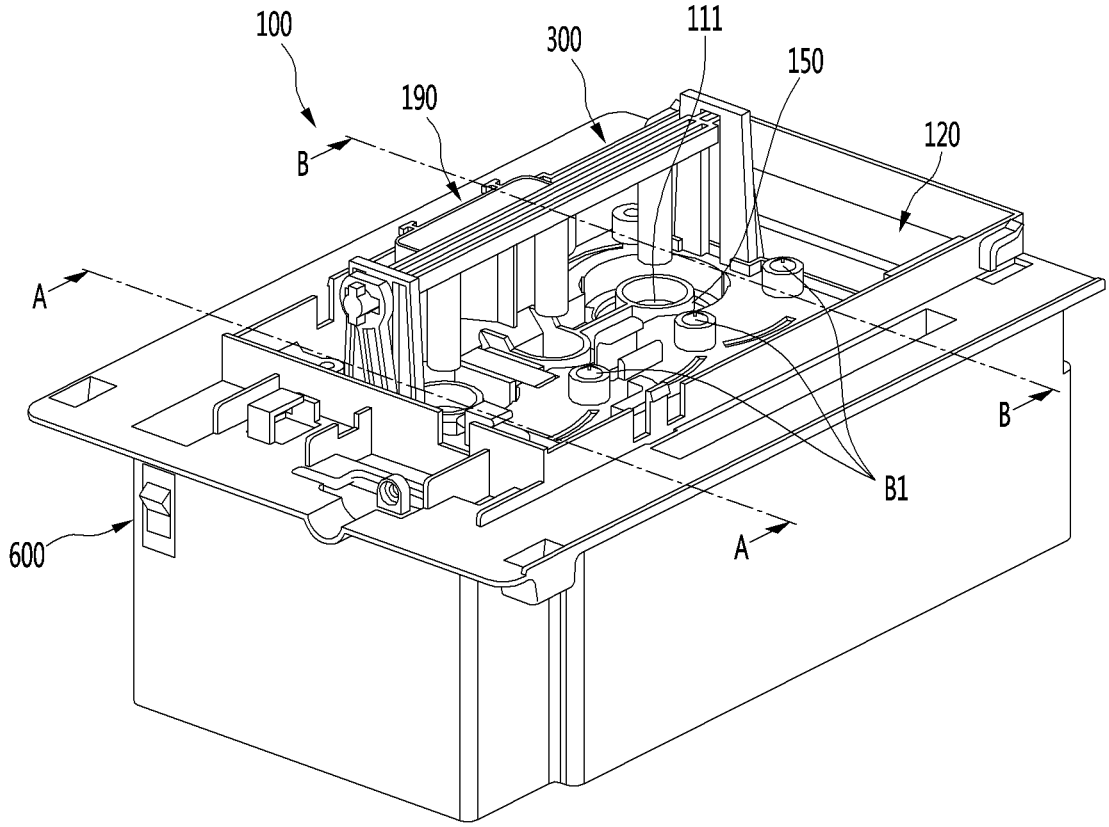
FIG. 3 and FIG. 4 is a perspective view of an ice maker according to one embodiment of the present disclosure.
Figure 4:
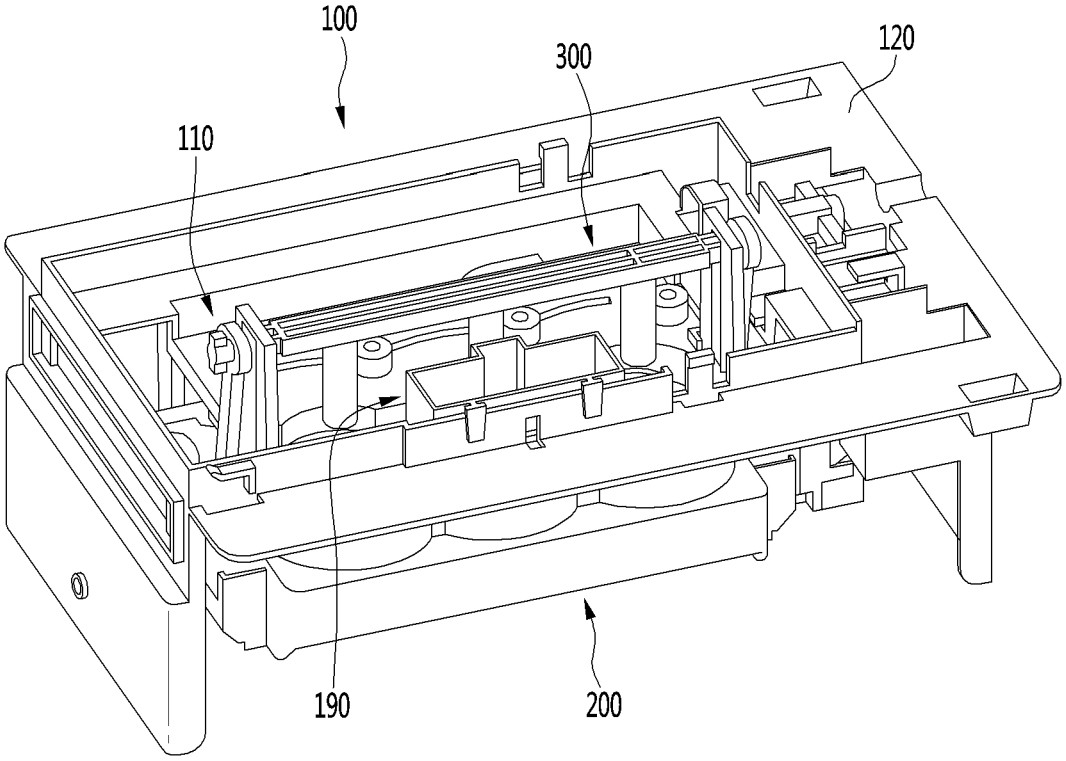
Figure 5:
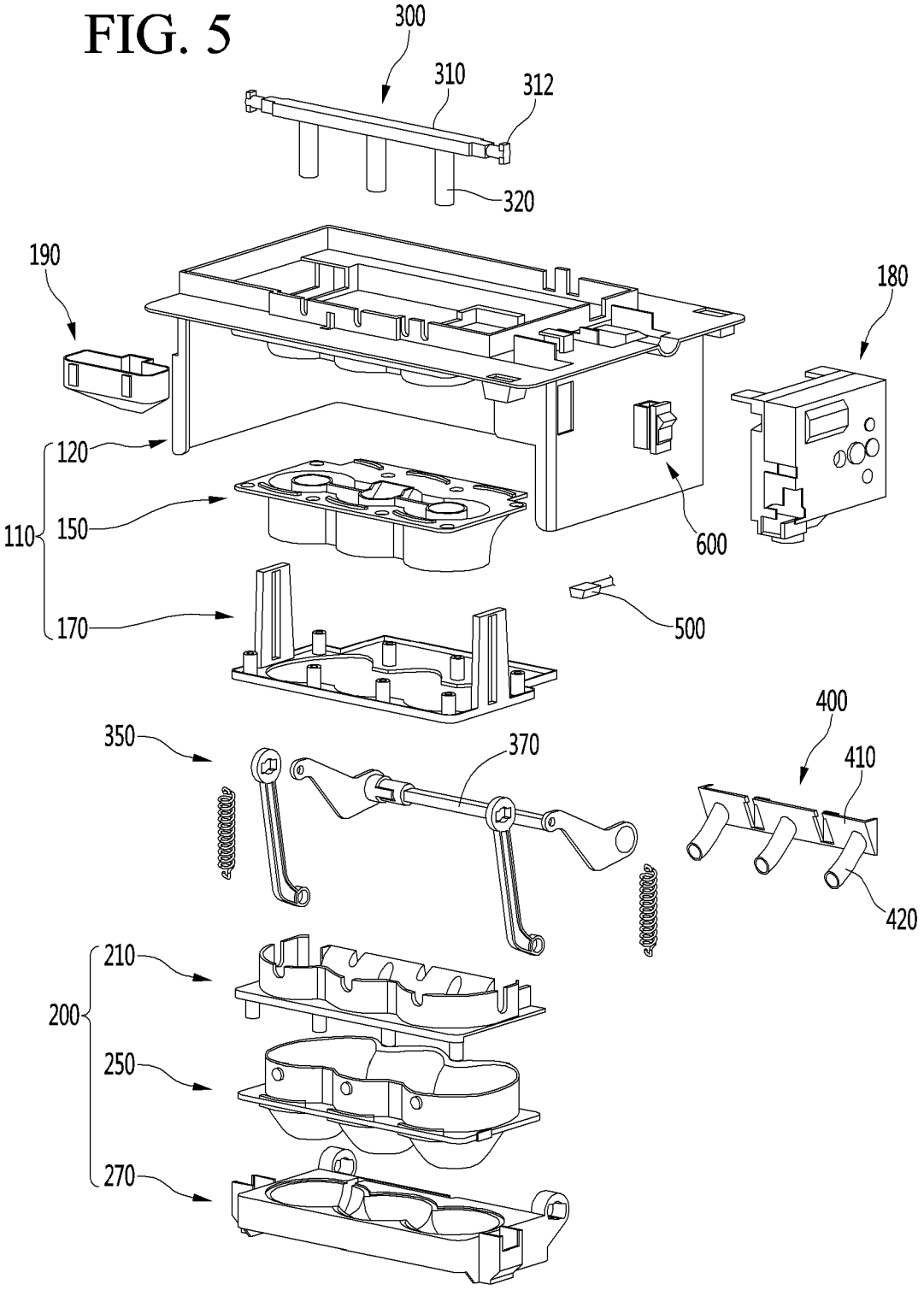
FIG. 5 is an exploded perspective view of an ice maker according to one embodiment of the present disclosure.

FIGS. 3 and 4 are perspective views of the ice maker according to an embodiment, and FIG. 5 is an exploded perspective view of the ice maker according to an embodiment.

Referring to FIGS. 3 to 5, the ice maker 100 may include an upper assembly 110 and a lower assembly 200.

The lower assembly 200 may rotate with respect to the upper assembly 110. For example, the lower assembly 200 may be connected to be rotatable with respect to the upper assembly 110.

In a state in which the lower assembly 200 contacts the upper assembly 110, the lower assembly 200 together with the upper assembly 110 may make spherical ice.

That is, the upper assembly 110 and the lower assembly 200 may define an ice chamber 111 for making the spherical ice. The ice chamber 111 may have a chamber having a substantially spherical shape.

As used herein, a term "spherical or hemisphere form" not only includes a geometrically complete sphere or hemisphere form but also a geometrically complete sphere-like or geometrically complete hemisphere-like form.

The upper assembly 110 and the lower assembly 200 may define a plurality of ice chambers 111.

Hereinafter, a structure in which three ice chambers are defined by the upper assembly 110 and the lower assembly 200 will be described as an example, and also, the embodiments are not limited to the number of ice chambers 111.

In the state in which the ice chamber 111 is defined by the upper assembly 110 and the lower assembly 200, water is supplied to the ice chamber 111 through a water supply part 190.

The water supply part 190 is coupled to the upper assembly 110 to guide water supplied from the outside to the ice chamber 111.

After the ice is made, the lower assembly 200 may rotate in a forward direction. Thus, the spherical ice made between the upper assembly 110 and the lower assembly 200 may be separated from the upper assembly 110 and the lower assembly 200.

The ice maker 100 may further include a driving unit 180 so that the lower assembly 200 is rotatable with respect to the upper assembly 110.

The driving unit 180 may include a driving motor and a power transmission part for transmitting power of the driving motor to the lower assembly 200. The power transmission part may include one or more gears.

The driving motor may be a bi-directional rotatable motor. Thus, the lower assembly 200 may rotate in both directions.

The ice maker 100 may further include an upper ejector 300 so that the ice is capable of being separated from the upper assembly 110.

The upper ejector 300 may be constructed so that the ice closely attached to the upper assembly 110 is separated from the upper assembly 110.

The upper ejector 300 may include an ejector body 310 and a plurality of upper ejecting pins 320 extending in a direction crossing the ejector body 310.

The upper ejecting pins 320 may be provided in the same number of ice chambers 111.

A separation prevention protrusion 312 for preventing a connection unit 350 from being separated in the state of being coupled to the connection unit 350 that will be described later may be provided on each of both ends of the ejector body 310.

For example, the pair of separation prevention protrusions 312 may protrude in opposite directions from the ejector body 310.

While the upper ejecting pin 320 passing through the upper assembly 110 and inserted into the ice chamber 111, the ice within the ice chamber 111 may be pressed.

The ice pressed by the upper ejecting pin 320 may be separated from the upper assembly 110.

Also, the ice maker 100 may further include a lower ejector 400 so that the ice closely attached to the lower assembly 200 is capable of being separated.

The lower ejector 400 may press the lower assembly 200 to separate the ice closely attached to the lower assembly 200 from the lower assembly 200. For example, the lower ejector 400 may be fixed to the upper assembly 110.

The lower ejector 400 may include an ejector body 410 and a plurality of lower ejecting pins 420 protruding from the ejector body 410. The lower ejecting pins 420 may be provided in the same number of ice chambers 111.

While the lower assembly 200 rotates to transfer the ice, rotation force of the lower assembly 200 may be transmitted to the upper ejector 300.

For this, the ice maker 100 may further include the connection unit 350 connecting the lower assembly 200 to the upper ejector 300. The connection unit 350 may include one or more links.

For example, when the lower assembly 200 rotates in one direction, the upper ejector 300 may descend by the connection unit 350 to allow the upper ejector pin 320 to press the ice of the ice chamber 111.

On the other hand, when the lower assembly 200 rotates in the other direction, the upper ejector 300 may ascend by the connection unit 350 to return to its original position.

Hereinafter, the upper assembly 110 and the lower assembly 200 will be described in more detail.

The upper assembly 110 may include an upper tray 150 defining a portion of the ice chamber 111 making the ice. For example, the upper tray 150 may define an upper portion of the ice chamber 111.

The upper assembly 110 may further include an upper support 170 fixing a position of the upper tray 150.

The upper support 170 may restrict downward movement of the upper tray 150.

The upper assembly 110 may further include an upper case 120 fixing a position of the upper tray 150.

The upper tray 150 may be disposed below the upper case 120.

As described above, the upper case 120, the upper tray 150, and the upper support 170, which are vertically aligned, may be coupled to each other through a coupling member.

That is, the upper tray 150 may be fixed to the upper case 120 through coupling of the coupling member.

For example, the water supply part 190 may be fixed to the upper case 120.

The ice maker 100 may further include a temperature sensor 500 detecting a temperature of the ice chamber 111.

In one example, the temperature sensor 500 detects the temperature of the upper tray 150 thus to indirectly detect the temperature of the water or the temperature of the ice in the ice chamber 111.

For example, the temperature sensor 500 may be mounted on the upper case 120. Also, when the upper tray 150 is fixed to the upper case 120, the temperature sensor 500 may contact the upper tray 150.

The lower assembly 200 may include a lower tray 250 defining the other portion of the ice chamber 111 making the ice. For example, the lower tray 250 may define a lower portion of the ice chamber 111.

The lower assembly 200 may further include a lower support 270 supporting a lower portion of the lower tray 250.

The lower assembly 200 may further include a lower case 210 of which at least a portion covers an upper side of the lower tray 250.

The lower case 210, the lower tray 250, and the lower support 270 may be coupled to each other through a coupling member.

The ice maker 100 may further include a switch for turning on/off the ice maker 100. When the user turns on the switch 600, the ice maker 100 may make ice.

That is, when the switch 600 is turned on, water may be supplied to the ice maker 100. Then, an ice making process of making ice by using cold air and an ice separating process of transferring the ice through the rotation of the lower assembly 200.

On the other hand, when the switch 600 is manipulated to be turned off, the making of the ice through the ice maker 100 may be impossible. For example, the switch 600 may be provided in the upper case 120.

<Upper Case>

Figure 6:
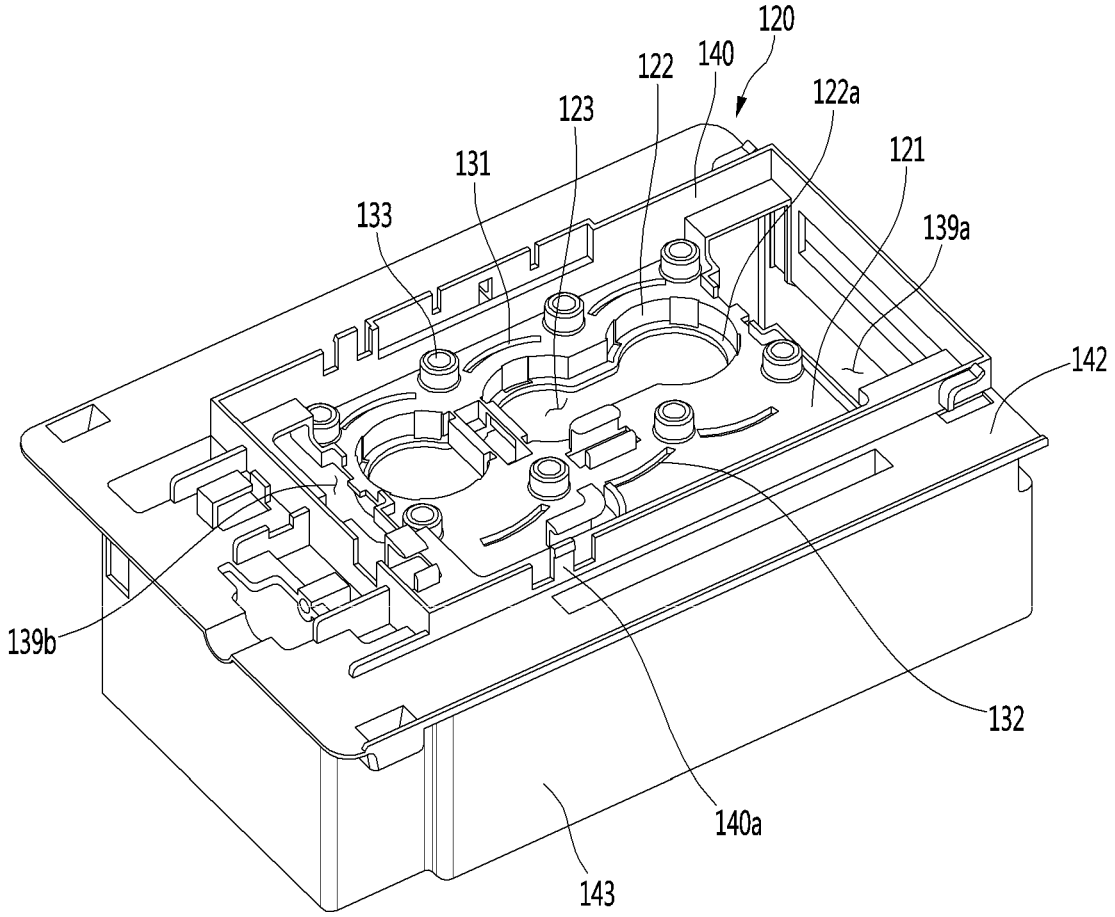
FIG. 6 is a top perspective view of an upper case according to one embodiment of the present disclosure.
Figure 7:
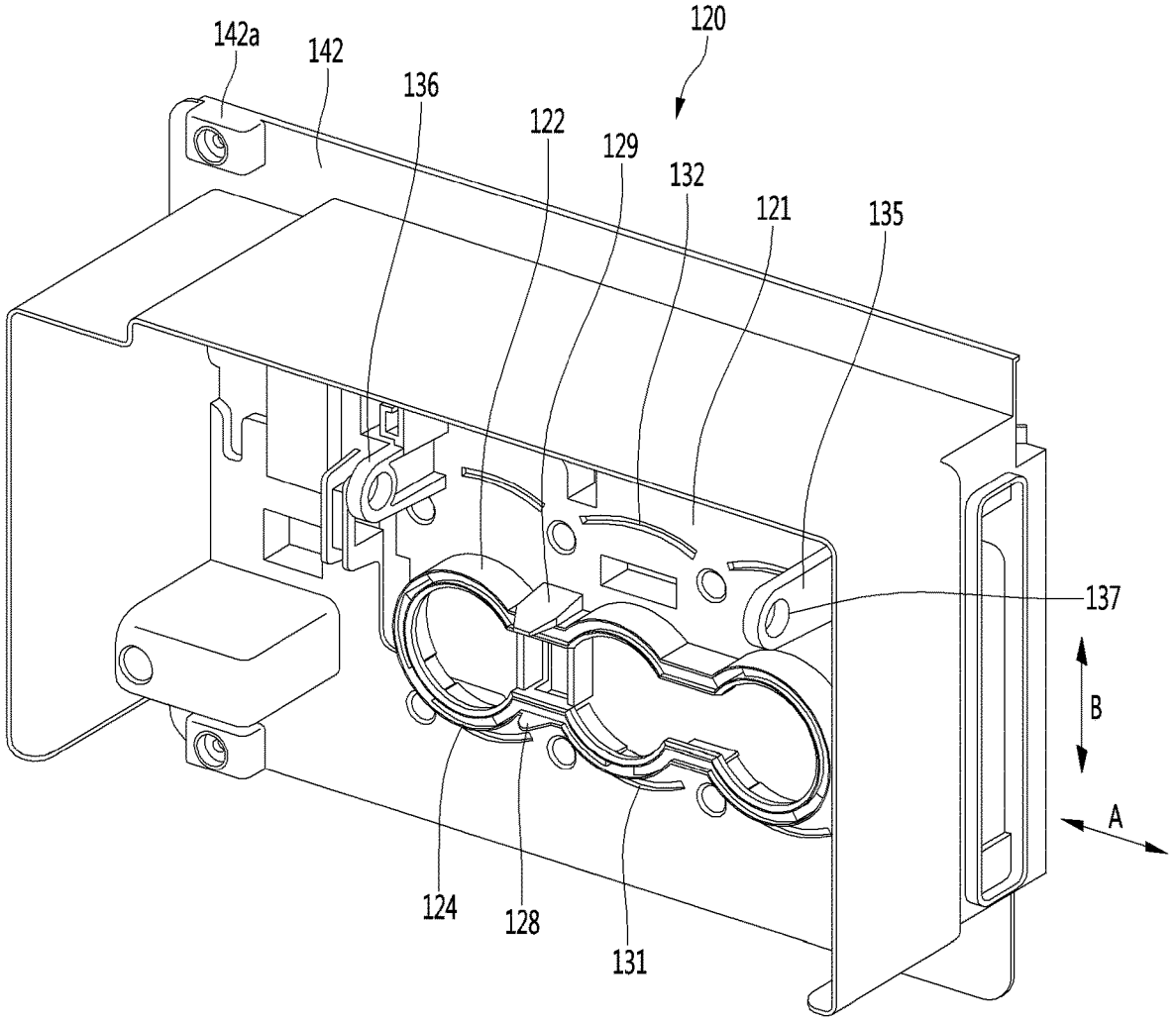
FIG. 7 is a bottom perspective view of an upper case according to one embodiment of the present disclosure.

FIG. 6 is a top perspective view of the upper case according to an embodiment, and FIG. 7 is a bottom perspective view of the upper case according to an embodiment.

Referring to FIGS. 6 and 7, the upper case 120 may be fixed to a housing 101 within the freezing compartment 4 in a state in which the upper tray 150 is fixed.

The upper case 120 may include an upper plate for fixing the upper tray 150.

The upper tray 150 may be fixed to the upper plate 121 in a state in which a portion of the upper tray 150 contacts a bottom surface of the upper plate 121.

An opening 123 through which a portion of the upper tray 150 passes may be defined in the upper plate 121.

For example, when the upper tray 150 is fixed to the upper plate 121 in a state in which the upper tray 150 is disposed below the upper plate 121, a portion of the upper tray 150 may protrude upward from the upper plate 121 through the opening 123.

Alternatively, the upper tray 150 may not protrude upward from the upper plate 121 through opening 123 but protrude downward from the upper plate 121 through the opening 123.

The upper plate 121 may include a recess 122 that is recessed downward. The opening 123 may be defined in a bottom surface 122*a* of the recess 122.

Thus, the upper tray 150 passing through the opening 123 may be disposed in a space defined by the recess 122.

A heater coupling part 124 for coupling an upper heater (see reference numeral 148 of FIG. 14) that heats the upper tray 150 so as to transfer the ice may be provided in the upper case 120.

For example, the heater coupling part 124 may be provided on the upper plate 121. The heater coupling part 124 may be disposed below the recess 122.

The upper case 120 may further include a plurality of installation ribs 128 and 129 for installing the temperature sensor 500.

The pair of installation ribs 128 and 129 may be disposed to be spaced apart from each other in a direction of an arrow B of FIG. 7. The pair of installation ribs 128 and 129 may be disposed to face each other, and the temperature sensor 500 may be disposed between the pair of installation ribs 128 and 129.

The pair of installation ribs 128 and 129 may be provided on the upper plate 121.

A plurality of slots 131 and 132 coupled to the upper tray 150 may be provided in the upper plate 121.

A portion of the upper tray 150 may be inserted into the plurality of slots 131 and 132.

The plurality of slots 131 and 132 may include a first upper slot 131 and a second upper slot 132 disposed at an opposite side of the first upper slot 131 with respect to the opening 123.

The opening 123 may be defined between the first upper slot 131 and the second upper slot 132.

The first upper slot 131 and the second upper slot 132 may be spaced apart from each other in a direction of an arrow B of FIG. 7.

Although not limited, the plurality of first upper slots 131 may be arranged to be spaced apart from each other in a direction of an arrow A (hereinafter, referred to as a first direction) that a direction crossing a direction of an arrow B (hereinafter, referred to as a second direction).

Also, the plurality of second upper slots 132 may be arranged to be spaced apart from each other in the direction of the arrow A.

In this specification, the direction of the arrow A may be the same direction as the arranged direction of the plurality of ice chambers 111.

For example, the first upper slot 131 may be defined in a curved shape. Thus, the first upper slot 131 may increase in length.

For example, the second upper slot 132 may be defined in a curved shape. Thus, the second upper slot 132 may increase in length.

When each of the upper slots 131 and 132 increases in length, a protrusion (that is disposed on the upper tray) inserted into each of the upper slots 131 and 132 may increase in length to improve coupling force between the upper tray 150 and the upper case 120.

A distance between the first upper slot 131 and the opening 123 may be different from that between the second upper slot 132 and the opening 123. For example, the distance between the first upper slot 131 and the opening 123 may be greater than that between the second upper slot 132 and the opening 123.

Also, when viewed from the opening 123 toward each of the upper slots 131, a shape that is convexly rounded from each of the slots 131 toward the outside of the opening 123 may be provided.

The upper plate 121 may further include a sleeve 133 into which a coupling boss of the upper support, which will be described later, is inserted.

The sleeve 133 may have a cylindrical shape and extend upward from the upper plate 121.

For example, a plurality of sleeves 133 may be provided on the upper plate 121. The plurality of sleeves 133 may be arranged to be spaced apart from each other in the direction of the arrow A. Also, the plurality of sleeves 133 may be arranged in a plurality of rows in the direction of the arrow B.

A portion of the plurality of sleeves may be disposed between the two first upper slots 131 adjacent to each other.

The other portion of the plurality of sleeves may be disposed between the two second upper slots 132 adjacent to each other or be disposed to face a region between the two second upper slots 132.

The upper case 120 may further include a plurality of hinge supports 135 and 136 allowing the lower assembly 200 to rotate.

The plurality of hinge supports 135 and 136 may be disposed to be spaced apart from each other in the direction of the arrow A with respect to FIG. 7. Also, a first hinge hole 137 may be defined in each of the hinge supports 135 and 136.

For example, the plurality of hinge supports 135 and 136 may extend downward from the upper plate 121.

The upper case 120 may further include a vertical extension part 140 vertically extending along a circumference of the upper plate 121. The vertical extension part 140 may extend upward from the upper plate 121.

The vertical extension part 140 may include one or more coupling hooks 140*a*. The upper case 120 may be hook-coupled to the housing 101 by the coupling hooks 140*a*.

The water supply part 190 may be coupled to the vertical extension part 140.

The upper case 120 may further include a horizontal extension part 142 horizontally extending to the outside of the vertical extension part 140.

A screw coupling part 142*a* protruding outward to screw-couple the upper case 120 to the housing 101 may be provided on the horizontal extension part 142.

The upper case 120 may further include a side circumferential part 143. The side circumferential part 143 may extend downward from the horizontal extension part 142.

The side circumferential part 143 may be disposed to surround a circumference of the lower assembly 200. That is, the side circumferential part 143 may prevent the lower assembly 200 from being exposed to the outside. In addition, the side circumferential part 143 enables the time when cold air stands still around the ice chamber 111 to be increased.

Although the upper case is coupled to the separate housing 101 within the freezing compartment 4 as described above, the embodiment is not limited thereto. For example, the upper case 120 may be directly coupled to a wall defining the freezing compartment 4.

<Upper Tray>

Figure 8:
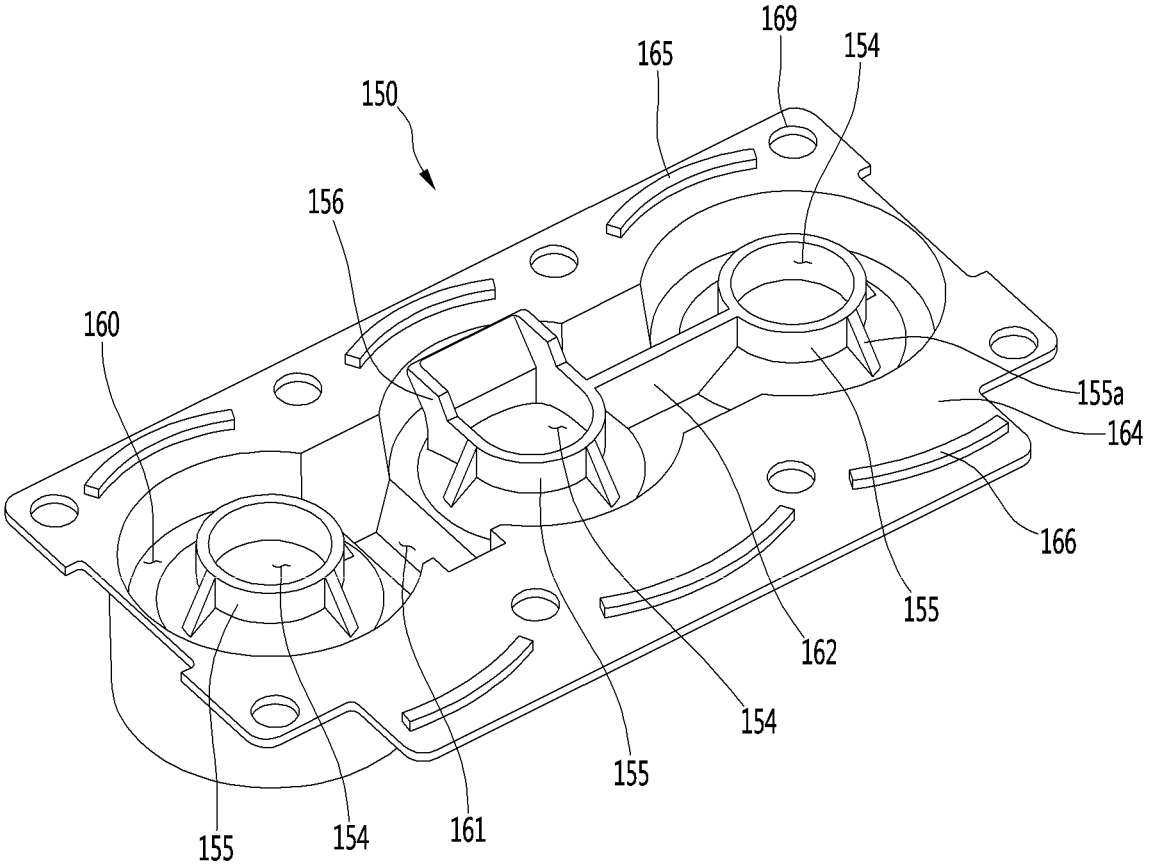
FIG. 8 is a top perspective view of an upper tray according to one embodiment of the present disclosure.
Figure 9:
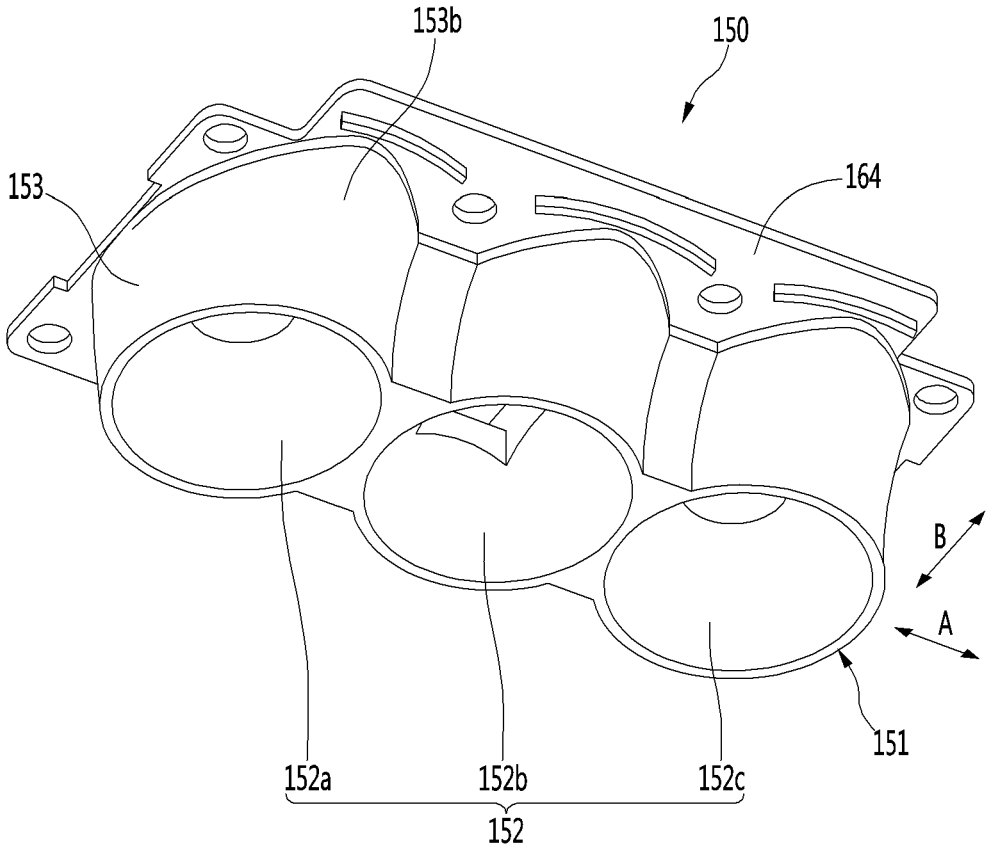
FIG. 9 is a bottom perspective view of an upper tray according to one embodiment of the present disclosure.
Figure 10:
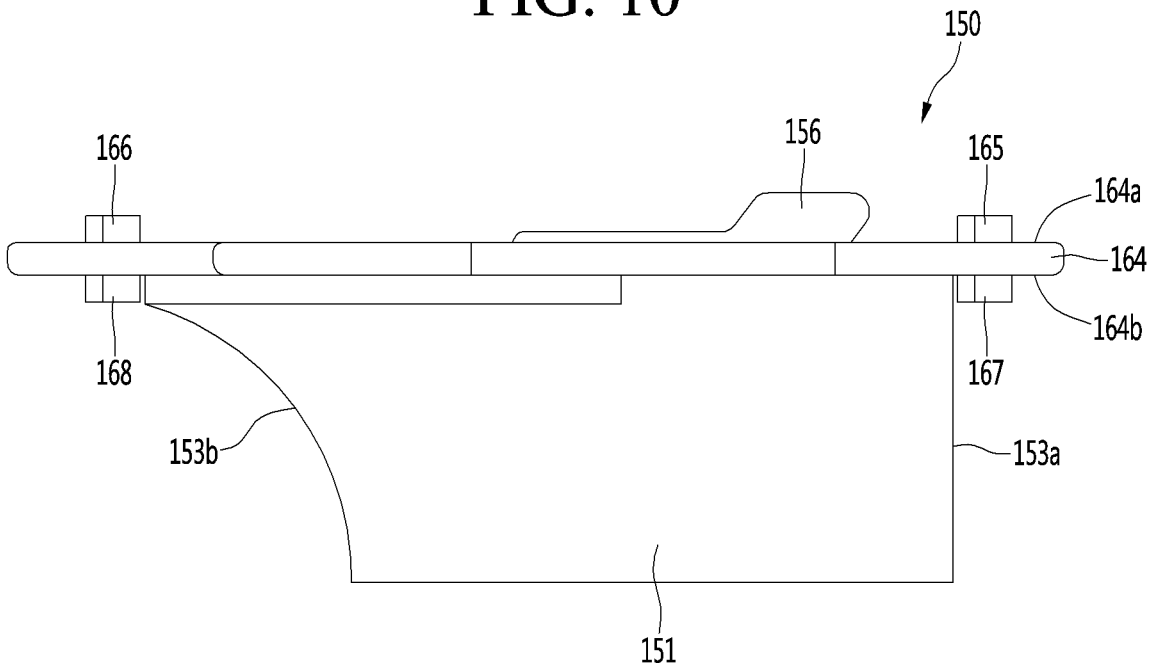
FIG. 10 is a side elevation view of an upper tray according to one embodiment of the present disclosure.

FIG. 8 is a top perspective view of the upper tray according to an embodiment, FIG. 9 is a bottom perspective view of the upper tray according to an embodiment, and FIG. 10 is a side view of the upper tray according to an embodiment.

Referring to FIGS. 8 to 10, the upper tray 150 may be made of a non-metal material and a flexible material that is capable of being restored to its original shape after being deformed by an external force.

For example, the upper tray 150 may be made of a silicone material. Like this embodiment, when the upper tray 150 is made of the silicone material, even though external force is applied to deform the upper tray 150 during the ice separating process, the upper tray 150 may be restored to its original shape. Thus, in spite of repetitive ice making, spherical ice may be made.

If the upper tray 150 is made of a metal material, when the external force is applied to the upper tray 150 to deform the upper tray 150 itself, the upper tray 150 may not be restored to its original shape any more.

In this case, after the upper tray 150 is deformed in shape, the spherical ice may not be made. That is, it is impossible to repeatedly make the spherical ice.

On the other hand, like this embodiment, when the upper tray 150 is made of the flexible material that is capable of being restored to its original shape, this limitation may be solved.

Also, when the upper tray 150 is made of the silicone material, the upper tray 150 may be prevented from being melted or thermally deformed by heat provided from an upper heater that will be described later.

The upper tray 150 may include an upper tray body 151 defining an upper chamber 152 that is a portion of the ice chamber 111.

The upper tray body 151 may be define a plurality of upper chambers 152.

For example, the plurality of upper chambers 152 may define a first upper chamber 152*a*, a second upper chamber 152*b*, and a third upper chamber 152*c*.

The upper tray body 151 may include three chamber walls 153 defining three independent upper chambers 152*a*, 152*b*, and 152*c*. The three chamber walls 153 may be connected to each other to form one body.

The first upper chamber 152*a*, the second upper chamber 152*b*, and the third upper chamber 152*c* may be arranged in a line. For example, the first upper chamber 152*a*, the second upper chamber 152*b*, and the third upper chamber 152*c* may be arranged in a direction of an arrow A with respect to FIG.

9. The direction of the arrow A of FIG. 9 may be the same direction as the direction of the arrow A of FIG. 7.

The upper chamber 152 may have a hemispherical shape. That is, an upper portion of the spherical ice may be made by the upper chamber 152.

An upper opening 154 may be defined in an upper side of the upper tray body 151. The upper opening 154 may be communicated with the upper chamber 152.

For example, three upper openings 154 may be defined in the upper tray body 151.

Cold air may be guided into the ice chamber 111 through the upper opening 154. Further, water may be supplied into the ice chamber 111 through the upper opening 154.

In the ice separating process, the upper ejector 300 may be inserted into the upper chamber 152 through the upper opening 154.

While the upper ejector 300 is inserted through the upper opening 154, an inlet wall 155 may be provided on the upper tray 150 to minimize deformation of the upper opening 154 in the upper tray 150.

The inlet wall 155 may be disposed along a circumference of the upper opening 154 and extend upward from the upper tray body 151.

The inlet wall 155 may have a cylindrical shape. Thus, the upper ejector 30 may pass through the upper opening 154 via an inner space of the inlet wall 155.

One or more first connection ribs 155*a* may be provided along a circumference of the inlet wall 155 to prevent the inlet wall 155 from being deformed while the upper ejector 300 is inserted into the upper opening 154.

The first connection rib 155*a* may connect the inlet wall 155 to the upper tray body 151. For example, the first connection rib 155*a* may be integrated with the circumference of the inlet wall 155 and an outer face of the upper tray body 151.

Although not limited, the plurality of connection ribs 155*a* may be disposed along the circumference of the inlet wall 155.

The two inlet walls 155 corresponding to the second upper chamber 152*b* and the third upper chamber 152*c* may be connected to each other through the second connection rib 162. The second connection rib 162 may also prevent the inlet wall 155 from being deformed.

A water supply guide 156 may be provided in the inlet wall 155 corresponding to one of the three upper chambers 152*a*, 152*b*, and 152*c*.

Although not limited, the water supply guide 156 may be provided in the inlet wall corresponding to the second upper chamber 152*b* located in a center portion of the upper tray.

The water supply guide 156 may be inclined upward from the inlet wall 155 in a direction which is away from the second upper chamber 152*b*.

The upper tray 150 may further include a first accommodation part 160. A heater coupling part 124 of the upper case 120 may be accommodated in the first accommodation part 160.

The upper heater (see reference numeral 148 of FIG. 14) may be provided in the heater coupling part 124. Thus, it may be understood that the upper heater (see reference numeral 148 of FIG. 14) is accommodated in the first accommodation part 160.

The first accommodation part 160 may be disposed in a shape that surrounds the upper chambers 152*a*, 152*b*, and 152*c*. The first accommodation part 160 may be provided by recessing a top surface of the upper tray body 151 downward.

The heater coupling part 124 to which the upper heater (see reference numeral 148 of FIG. 14) is coupled may be accommodated in the first accommodation part 160.

The first accommodation part 160 may be lower than the upper opening 154.

The upper tray 150 may further include a second accommodation part 161 (or referred to as a sensor accommodation part) in which the temperature sensor 500 is accommodated.

For example, the second accommodation part 161 may be provided in the upper tray body 151. Although not limited, the second accommodation part 161 may be provided by recessing a bottom surface of the first accommodation part 160 downward.

Also, the second accommodation part 161 may be disposed between the two upper chambers adjacent to each other. For example, the second accommodation part 161 may be disposed between the first upper chamber 152*a* and the second upper chamber 152*b*.

Thus, an interference between the upper heater (see reference numeral 148 of FIG. 14) accommodated in the first accommodation part 160 and the temperature sensor 500 may be prevented.

In the state in which the temperature sensor 500 is accommodated in the second accommodation part 161, the temperature sensor 500 may contact an outer face of the upper tray body 151.

The chamber wall 153 of the upper tray body 151 may include a vertical wall 153*a* and a curved wall 153*b*.

The curved wall 153*b* may be rounded upward in a direction that is away from the upper chamber 152.

The upper tray 150 may further include a horizontal extension part 164 horizontally extending from the circumference of the upper tray body 151. For example, the horizontal extension part 164 may extend along a circumference of an upper edge of the upper tray body 151.

The horizontal extension part 164 may contact the upper case 120 and the upper support 170.

For example, a bottom surface 164*b* (or referred to as a "first surface") of the horizontal extension part 164 may contact the upper support 170, and a top surface 164*a* (or referred to as a "second surface") of the horizontal extension part 164 may contact the upper case 120.

At least a portion of the horizontal extension part 164 may be disposed between the upper case 120 and the upper support 170.

The horizontal extension part 164 may include a plurality of upper protrusions 165 and 166 respectively inserted into the plurality of upper slots 131 and 132.

The plurality of upper protrusions 165 and 166 may include a first upper protrusion 165 and a second upper protrusion 166 disposed at an opposite side of the first upper protrusion 165 with respect to the upper opening 154.

The first upper protrusion 165 may be inserted into the first upper slot 131, and the second upper protrusion 166 may be inserted into the second upper slot 132.

The first upper protrusion 165 and the second upper protrusion 166 may protrude upward from the top surface 164*a* of the horizontal extension part 164.

The first upper protrusion 165 and the second upper protrusion 166 may be spaced apart from each other in the direction of the arrow B of FIG. 9. The direction of the arrow B of FIG. 9 may be the same direction as the direction of the arrow B of FIG. 7.

Although not limited, the plurality of first upper protrusions 165 may be arranged to be spaced apart from each other in the direction of the arrow A.

The plurality of second upper protrusions 166 may be arranged to be spaced apart from each other in the direction of the arrow A.

For example, the first upper protrusion 165 may be provided in a curved shape. Also, for example, the second upper protrusion 166 may be provided in a curved shape.

In this embodiment, each of the upper protrusions 165 and 166 may be constructed so that the upper tray 150 and the upper case 120 are coupled to each other, and also, the horizontal extension part is prevented from being deformed during the ice making process or the ice separating process.

Here, when each of the upper protrusions 165 and 166 is provided in the curved shape, distances between the upper protrusions 165 and 166 and the upper chamber 152 in a longitudinal direction of the upper protrusions 165 and 166 may be equal or similar to each other to effectively prevent the horizontal extension parts 164 from being deformed.

For example, the deformation in the horizontal direction of the horizontal extension part 164 may be minimized to prevent the horizontal extension part 164 from being plastic-deformed. If when the horizontal extension part 164 is plastic-deformed, since the upper tray body is not positioned at the correct position during the ice making, the shape of the ice may not close to the spherical shape.

The horizontal extension part 164 may further include a plurality of lower protrusions 167 and 168. The plurality of lower protrusions 167 and 168 may be inserted into a lower slot of the upper support 170, which will be described below.

The plurality of lower protrusions 167 and 168 may include a first lower protrusion 167 and a second lower protrusion 168 disposed at an opposite side of the first lower protrusion 167 with respect to the upper chamber 152.

The first lower protrusion 167 and the second lower protrusion 168 may protrude downward from the bottom surface 164*b* of the horizontal extension part 164.

The first lower protrusion 167 may be disposed at an opposite to the first upper protrusion 165 with respect to the horizontal extension part 164. The second lower protrusion 168 may be disposed at an opposite side of the second upper protrusion 166 with respect to the horizontal extension part 164.

The first lower protrusion 167 may be spaced apart from the vertical wall 153*a* of the upper tray body 151. The second lower protrusion 168 may be spaced apart from the curved wall 153*b* of the upper tray body 151.

Each of the plurality of lower protrusions 167 and 168 may also be provided in a curved shape. Since the protrusions 165, 166, 167, and 168 are disposed on each of the top and bottom surfaces 164*a* and 164*b* of the horizontal extension part 164, the deformation in the horizontal direction of the horizontal extension part 164 may be effectively prevented.

A through-hole 169 through which the coupling boss of the upper support 170, which will be described later, may be provided in the horizontal extension part 164.

For example, a plurality of through-holes 169 may be provided in the horizontal extension part 164.

A portion of the plurality of through-holes 169 may be disposed between the two first upper protrusions 165 adjacent to each other or the two first lower protrusions 167 adjacent to each other.

The other portion of the plurality of through-holes 169 may be disposed between the two second lower protrusions 168 adjacent to each other or be disposed to face a region between the two second lower protrusions 168.

<Upper Support>

Figure 11:
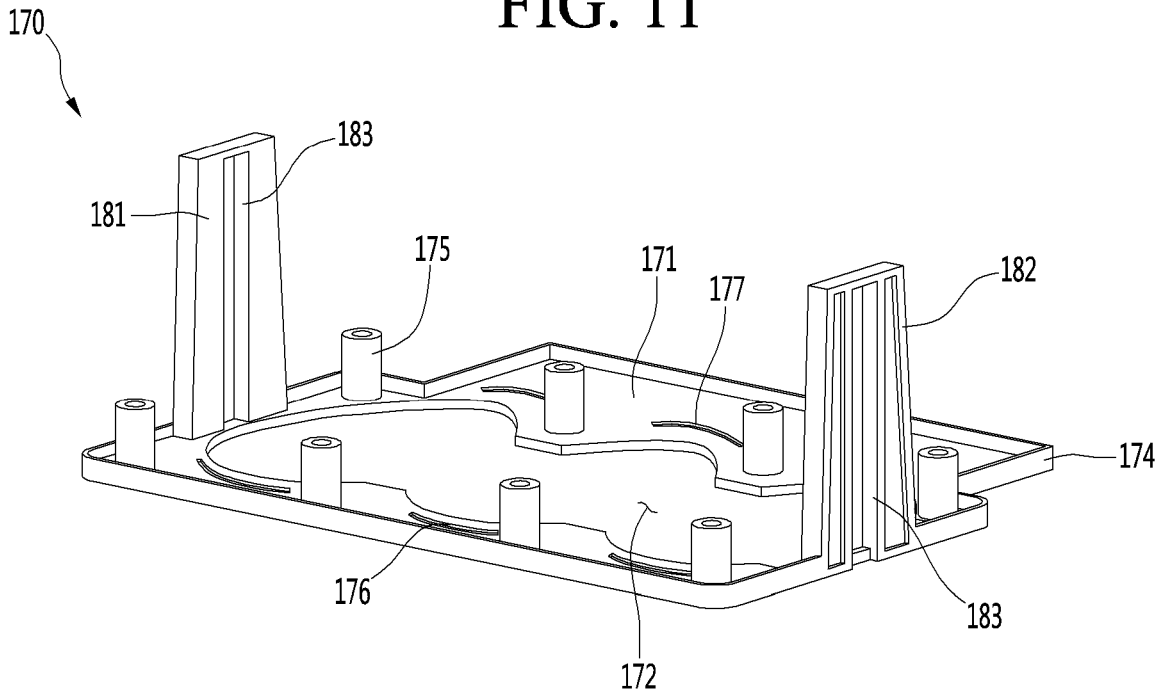
FIG. 11 is a top perspective view of an upper support according to one embodiment of the present disclosure.
Figure 12:
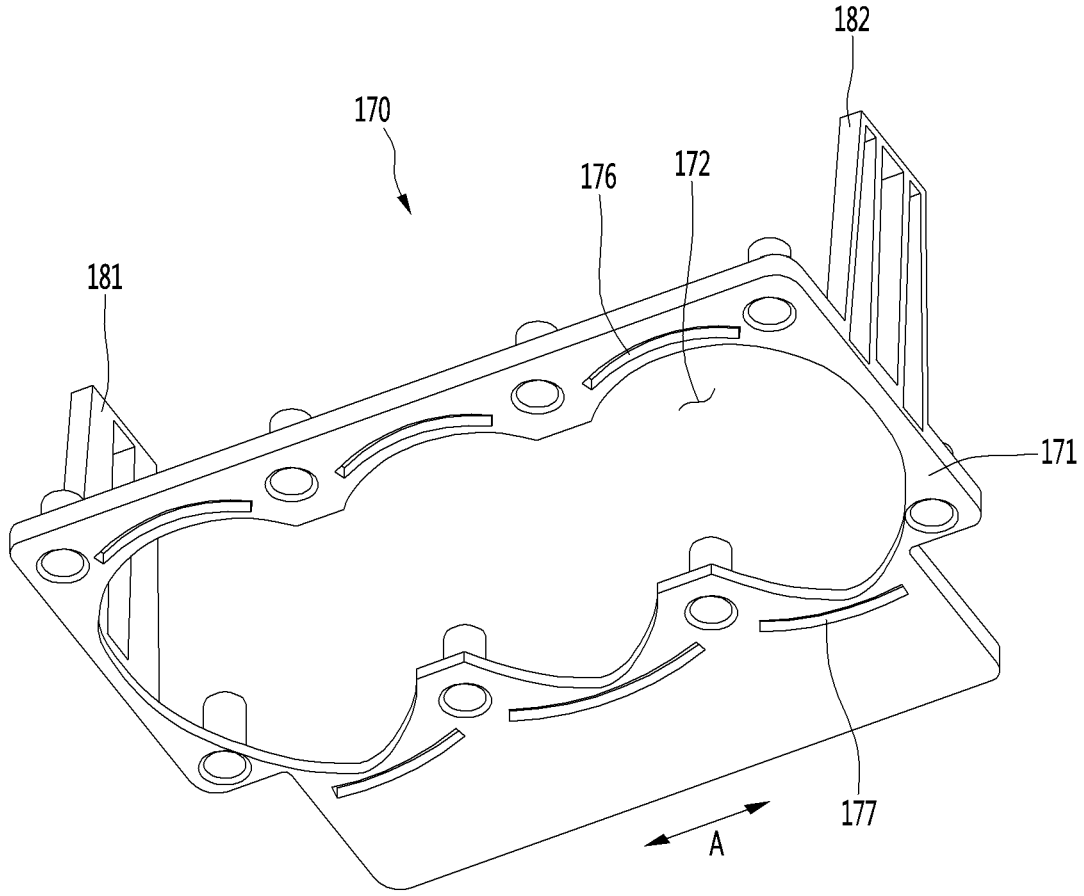
FIG. 12 is a bottom perspective view of an upper support according to one embodiment of the present disclosure.

FIG. 11 is a top perspective view of the upper support according to an embodiment, and FIG. 12 is a bottom perspective view of the upper support according to an embodiment.

Referring to FIGS. 11 and 12, the upper support 170 may support the upper tray 150 in an ice making process, and prevent the upper tray 150 from drooping in an ice separation process.

The upper support 170 may include a support plate 171 contacting the upper tray 150.

For example, a top surface of the support plate 171 may contact the bottom surface 164*b* of the horizontal extension part 164 of the upper tray 150.

A plate opening 172 through which the upper tray body 151 passes may be defined in the support plate 171. Therefore, the horizontal extension part 164 of the upper tray 150 may be settled in the support plate 171 in a state that the upper tray body 151 penetrates the plate opening 172.

A circumferential wall 174 that is bent upward may be provided on an edge of the support plate 171. For example, the circumferential wall 174 may contact at least a portion of a circumference of a side surface of the horizontal extension part 164.

Also, a top surface of the circumferential wall 174 may contact a bottom surface of the upper plate 121.

The support plate 171 may include a plurality of lower slots 176 and 177.

The plurality of lower slots 176 and 177 may include a first lower slot 176 into which the first lower protrusion 167 is inserted and a second lower slot 177 into which the second lower protrusion 168 is inserted.

The plurality of first lower slots 176 may be disposed to be spaced apart from each other in the direction of the arrow A on the support plate 171. Also, the plurality of second lower slots 177 may be disposed to be spaced apart from each other in the direction of the arrow A on the support plate 171.

The lower slots 176, 177 may be rounded in the horizontal direction.

In this embodiment, since the horizontal extension part 164 is supported by the support plate 171 in a state that the upper protrusions 167, 168 are inserted into the lower slots 176, 177, the horizontal extension part 164 can be prevented to be stretched in the ice separation process, and accordingly, the upper tray 150 can be prevented from drooping.

The support plate 171 may further include a plurality of coupling bosses 175. The plurality of coupling bosses 175 may protrude upward from the top surface of the support plate 171.

Each of the coupling bosses 175 may pass through the through-hole 169 of the horizontal extension part 164 and be inserted into the sleeve 133 of the upper case 120.

In the state in which the coupling boss 175 is inserted into the sleeve 133, a top surface of the coupling boss 175 may be disposed at the same height as a top surface of the sleeve 133 or disposed at a height lower than that of the top surface of the sleeve 133.

A coupling member coupled to the coupling boss 175 may be, for example, a bolt (see reference symbol B1 of FIG. 3). The bolt B1 may include a body part and a head part having a diameter greater than that of the body part. The bolt B1 may be coupled to the coupling boss 175 from an upper side of the coupling boss 175.

While the body part of the bolt B1 is coupled to the coupling boss 175, when the head part contacts the top surface of the sleeve 133, and the head part contacts the top surface of the sleeve 133 and the top surface of the coupling boss 175, assembling of the upper assembly 110 may be completed.

The upper support 170 may further include a plurality of unit guides 181 and 182 for guiding the connection unit 350 connected to the upper ejector 300.

The plurality of unit guides 181 and 182 may be, for example, disposed to be spaced apart from each other in the direction of the arrow A with respect to FIG. 12.

The unit guides 181 and 182 may extend upward from the top surface of the support plate 171. Each of the unit guides 181 and 182 may be connected to the circumferential wall 174.

Each of the unit guides 181 and 182 may include a guide slot 183 vertically extends.

In a state in which both ends of the ejector body 310 of the upper ejector 300 pass through the guide slot 183, the connection unit 350 is connected to the ejector body 310.

Thus, when the rotation force is transmitted to the ejector body 310 by the connection unit 350 while the lower assembly 200 rotates, the ejector body 310 may vertically move along the guide slot 183.

Since the horizontal extension part 164 of the upper tray 150 is settled in a support plate 171 of the upper support 170, the upper tray 150 may be prevented from drooping downward in a process that an applied force of the ejector body 310 is transferred by using air attached to the upper tray 150 in the air separation process.

<Upper Heater Coupling Structure>

Figure 13:
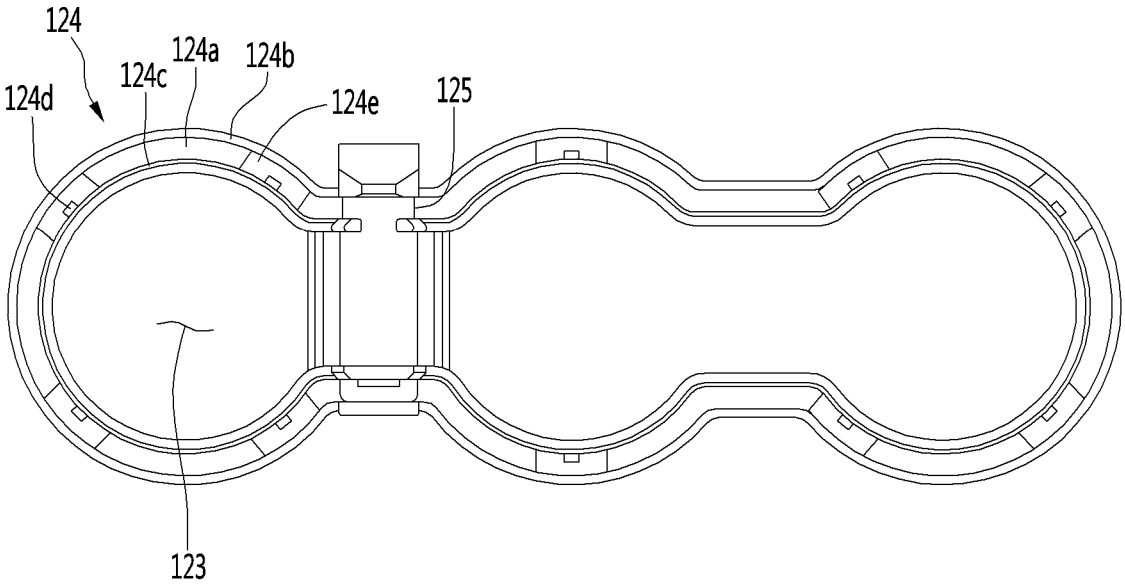
FIG. 13 is an enlarged view showing a heater coupling portion in the upper case of FIG. 6.
Figure 14:
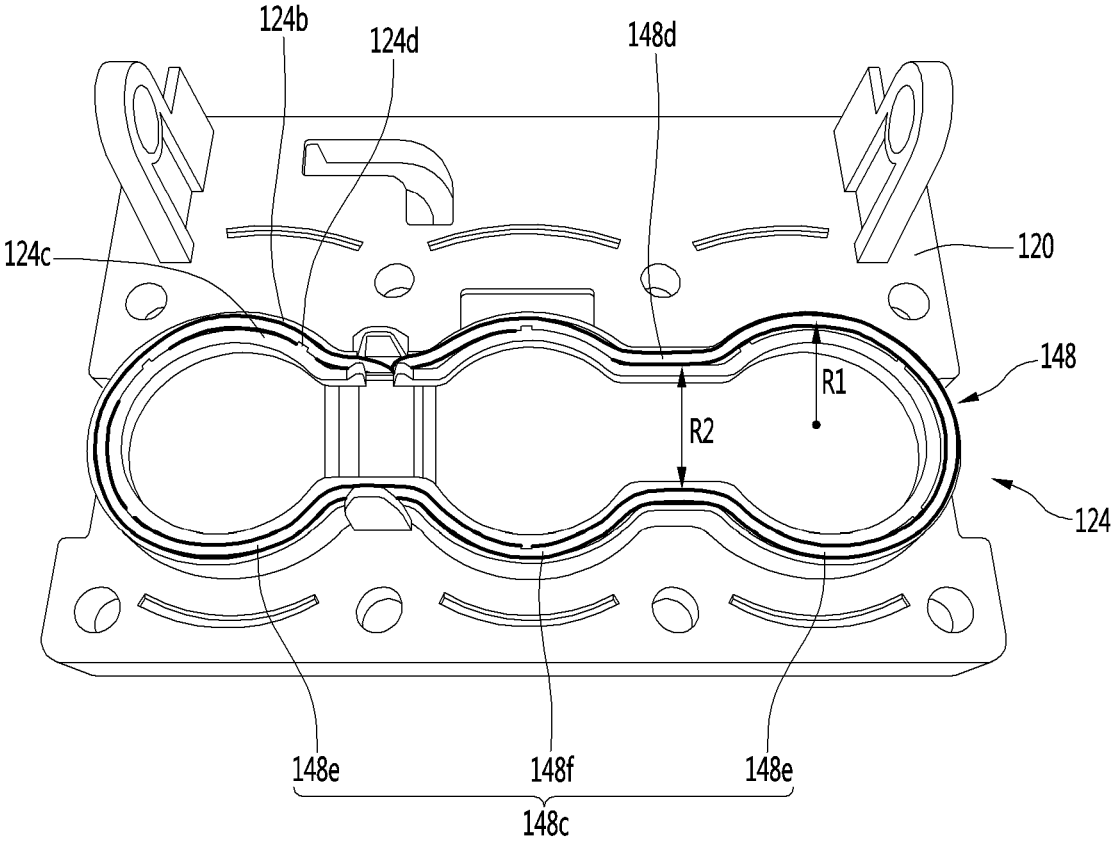
FIG. 14 is a view showing a state in which a heater is coupled to the upper case of FIG. 6.
Figure 15:
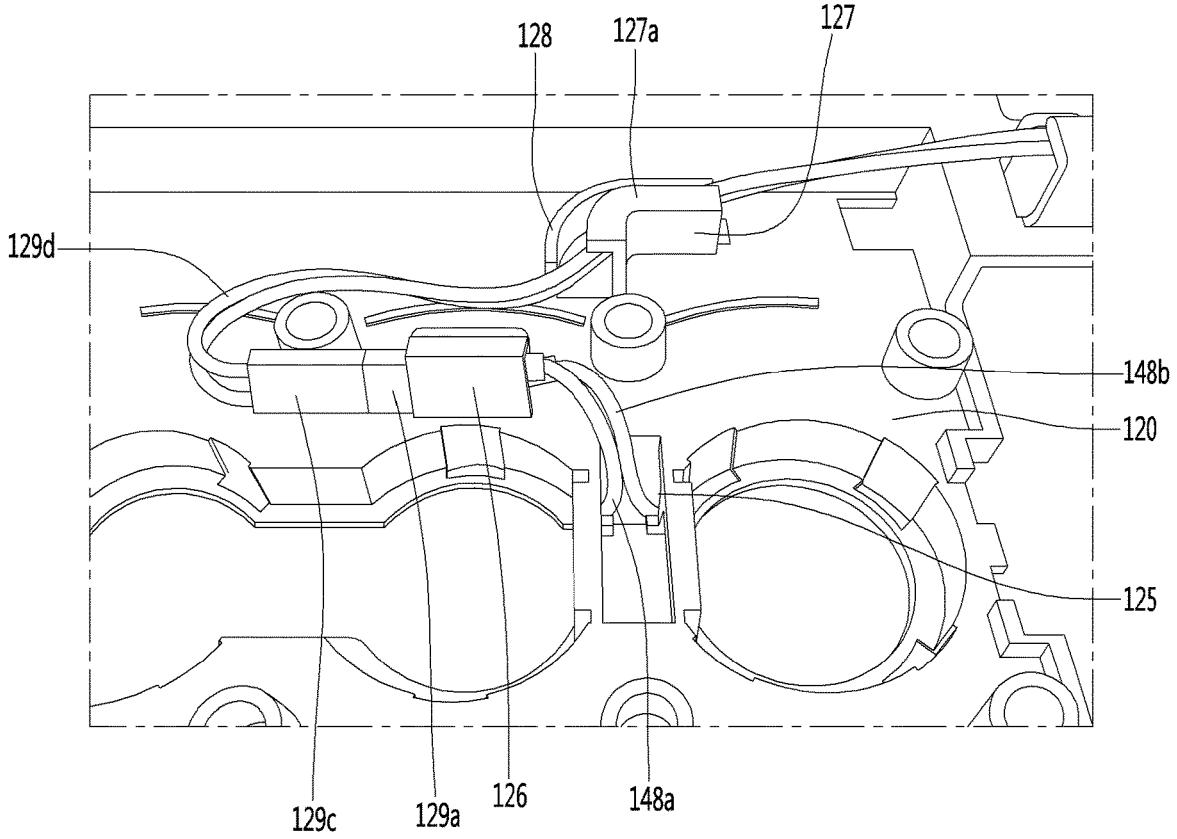
FIG. 15 is a view showing a layout of a wire connected to the heater in the upper case.

FIG. 13 is an enlarged view of the heater coupling part in the upper case of FIG. 6, FIG. 14 is a view illustrating a state in which a heater is coupled to the upper case of FIG. 6, and FIG. 15 is a view illustrating an arrangement of a wire connected to the heater in the upper case.

Referring to FIGS. 9, and 13 to 15, the heater coupling part 124 may include a heater accommodation groove 124*a* accommodating the upper heater 148.

For example, the heater accommodation groove 124*a* may be defined by recessing a portion of a bottom surface of the recess 122 of the upper case 120 upward.

The heater accommodation groove 124*a* may extend along a circumference of the opening 123 of the upper case 120.

For example, the upper heater 148 may be a wire-type heater. Thus, the upper heater 148 may be bendable. The upper heater 148 may be bent to correspond to a shape of the heater accommodation groove 124*a* so as to accommodate the upper heater 148 in the heater accommodation groove 124*a*.

The upper heater 148 may be a DC heater receiving DC power. The upper heater 148 may be turned on to transfer ice.

A case of using a DC heater as the upper heater 148 has a lower output of the heater than a case of using an AC heater as the upper heater 148.

When heat of the upper heater 148 is transferred to the upper tray 150, ice may be separated from a surface (inner face) of the upper tray 150.

If the upper tray 150 is made of a metal material and the AC heater is used as the upper heater 148, the heat of the upper heater 148 can be greatly transferred to the upper chamber 152 by the upper tray 150, thereby easily separating the upper tray 150 from a surface of the ice.

Since the thermal conductivity of the upper tray 150 is high and the heat of the upper heater 148 is strong, a portion corresponding to the upper heater 148 in the ice is melted.

When some of the ice is melted, after the upper heater 148 is turned off, the portion in which the ice is melted by the upper heater 148 is attached back to a surface of the upper tray 150, and accordingly, the ice may be made ice opaque.

That is, an opaque strip having a shape corresponding to the upper heater 148 is formed around the ice.

In addition, when some of the ice is melted and frozen back and then is coupled to the upper tray 150, it is highly likely that the ice will not be easily separated from the upper tray 150 in future in the ice separation process of the upper ejector.

However, in this embodiment, as the DC heater having a low output of the heater is used and the tray 150 is made of the non-metal material and the silicone material, an amount of heat transferred to the upper tray 150 is reduced, and the thermal conductivity of the upper tray 150 are lowered.

Thus, the heat may not be concentrated into the local portion of the ice, and a small amount of heat may be slowly applied to prevent the opaque band from being formed around the ice because the ice is effectively separated from the upper tray.

The upper heater 148 may be disposed to surround the circumference of each of the plurality of upper chambers 152 so that the heat of the upper heater 148 is uniformly transferred to the plurality of upper chambers 152 of the upper tray 150.

Also, the upper heater 148 may contact the circumference of each of the chamber walls 153 respectively defining the plurality of upper chambers 152. Here, the upper heater 148 may be disposed at a position that is lower than that of the upper opening 154.

Since the heater accommodation groove 124*a* is recessed from the recess 122, the heater accommodation groove 124*a* may be defined by an outer wall 124*b* and an inner wall 124*c*.

The upper heater 148 may have a diameter greater than that of the heater accommodation groove 124*a* so that the upper heater 148 protrudes to the outside of the heater coupling part 124 in the state in which the upper heater 148 is accommodated in the heater accommodation groove 124*a*.

Since a portion of the upper heater 148 protrudes to the outside of the heater accommodation groove 124*a* in the state in which the upper heater 148 is accommodated in the heater accommodation groove 124*a*, the upper heater 148 may contact the upper tray 150.

A separation prevention protrusion 124*d* may be provided on one of the outer wall 124*b* and the inner wall 124*c* to prevent the upper heater 148 accommodated in the heater accommodation groove 124*a* from being separated from the heater accommodation groove 124*a*.

In FIG. 13, for example, a plurality of separation prevention protrusions 124*d* are provided on the inner wall 124*c*.

The separation prevention protrusion 124*d* may protrude from an end of the inner wall 124*c* toward the outer wall 124*b*.

Here, a protruding length of the separation prevention protrusion 124*d* may be less than about ½ of a distance between the outer wall 124*b* and the inner wall 124*c* to prevent the upper heater 148 from being easily separated from the heater accommodation groove 124*a* without interfering with the insertion of the upper heater 148 by the separation prevention protrusion 124*d*.

As illustrated in FIG. 14, in the state in which the upper heater 148 is accommodated in the heater accommodation groove 124*a*, the upper heater 148 may be divided into an upper round portion 148*c* and an upper linear portion 148*d*.

That is, the heater accommodation groove 124*a* may include an upper round portion and a linear portion. Thus, the upper heater 148 may be divided into the upper round portion 148*c* and the linear portion 148*d* to correspond to the upper round portion and the linear portion of the heater accommodation groove 124*a*.

The upper round portion 148*c* may be a portion disposed along the circumference of the upper chamber 152 and also a portion that is bent to be rounded in a horizontal direction.

The upper liner portion 148*d* may be a portion connecting the upper round portions 148*c* corresponding to the upper chambers 152 to each other.

The upper round portion 184*c* may comprise a first upper round portion 148*e* corresponding to first and third chambers 152*a*, 152*c* of both sides of an outermost section among a plurality of upper chambers 152.

The first upper round portion 148*e* may be connected by a pair of upper linear portions 148*d*. That is, the pair of upper linear portions 148*d* each may be connected to both ends of one first upper round portion 148*e*.

A length of the first round portion 148*e* is longer than lengths of each of the pair of upper linear portions 148*d*. The pair of upper linear portions 148*d* connected to both ends of the first upper round portion 148*e* may be disposed substantially in parallel.

A distance (R2) between the pair of upper linear portions 148*d* is smaller than double (2*R1) in a radius of curvature of the first upper round portion (148*e*).

As the distance (R2) between the pair of upper linear portions 148*d* gets longer, the pair of upper linear portions 148*d* moves away from the upper chamber 152, and accordingly, it takes a long time to transfer the heat of the pair of upper linear portions 148*d* to the upper chamber 152.

However, according to this embodiment, since the distance (R2) between the pair of upper linear portions 148*d* is smaller than double (2*R1) in a radius of curvature of the first upper round portion 148*e*, an interval between the pair of upper linear portions 148*d* and the upper chamber 152 may be reduced to rapidly transfer the heat of the upper linear portion 148*d* to the upper chamber 152.

The distance (R2) between the pair of upper linear portions 148*d* may be equal to or larger than a radius of curvature (R1) of the first upper round portion 148*e*.

As the distance (R2) between the pair of upper linear portions 148*d* is reduced, there is a large degree of bending in a boundary between the pair of upper linear portions 148*d* and the first upper round portion 148*e*, thereby providing a lot of concern for a short circuit, and also, heat between two upper chambers that are adjacent to each other may be unnecessary concentrated.

However, according to this embodiment, if the distance (R2) between the pair of upper linear portions 148*d* is equal to or larger than the radius of curvature (R1) of the first upper round portion 148*e*, the above-described problem can be prevented.

The upper round portion 148*c* may further comprise a second round portion 148*f* corresponding to the second upper chamber 152*b* disposed between first and third upper chambers 152*a*, 152*c* at both sides of an outermost section among the plurality of upper chambers 152.

As an example, a pair of second upper round portions 148*f* may be spaced apart from each other. This is because each of the pair of second upper round portions 148*f* has to be connected to the first upper round portion 148*e* by the upper linear part 148*d* of both sides.

A length of the second upper round portion 148*f* may be shorter than a length of the first upper round portion 148*e*. The upper linear portions 148*d* at both sides of the second upper round portion 148*f* may be connected.

Since the upper heater 148 is disposed at a position lower than that of the upper opening 154, a linear line connecting two points of the upper round portions, which are spaced apart from each other, to each other may pass through upper chamber 152.

Since the upper round portion 148*c* of the upper heater 148 may be separated from the heater accommodation groove 124*a*, the separation prevention protrusion 124*d* may be disposed to contact the upper round portion 148*c*.

A through-opening 124*e* may be defined in a bottom surface of the heater accommodation groove 124*a*. When the upper heater 148 is accommodated in the heater accommodation groove 124*a*, a portion of the upper heater 148 may be disposed in the through-opening 124*e*. For example, the through-opening 124*e* may be defined in a portion of the upper heater 148 facing the separation prevention protrusion 124*d*.

When the upper heater 148 is bent to be horizontally rounded, tension of the upper heater 148 may increase to cause disconnection, and also, the upper heater 148 may be separated from the heater accommodation groove 124*a*.

However, when the through-opening 124*e* is defined in the heater accommodation groove 124*a* like this embodiment, a portion of the upper heater 148 may be disposed in the through-opening 124*e* to reduce the tension of the upper heater 148, thereby preventing the heater accommodation groove 124*a* from being separated from the upper heater 148.

As illustrated in FIG. 15, in a state in which a power input terminal 148*a* and a power output terminal 148*b* of the upper heater 148 are disposed in parallel to each other, the upper heater 148 may pass through a heater through-hole 125 defined in the upper case 120.

Since the upper heater 148 is accommodated from a lower side of the upper case 120, the power input terminal 148*a* and the power output terminal 148*b* of the upper heater 148 may extend upward to pass through the heater through-hole 125.

The power input terminal 148*a* and the power output terminal 148*b* passing through the heater through-hole 125 may be connected to one first connector 129*a*.

Also, a second connector 129*c* to which two wires 129*d* connected to correspond to the power input terminal 148*a* and the power output terminal 148*b* are connected may be connected to the first connector 129*a*.

A first guide part 126 guiding the upper heater 148, the first connector 129*a*, the second connector 129*c*, and the wire 129*d* may be provided on the upper plate 121 of the upper case 120.

In FIG. 15, for example, a structure in which the first guide part 126 guides the first connector 129*a* is illustrated.

The first guide part 126 may extend upward from the top surface of the upper plate 121 and have an upper end that is bent in the horizontal direction.

Thus, the upper bent portion of the first guide part 126 may limit upward movement of the first connector 129*a*.

The wire 129*d* may be led out to the outside of the upper case 120 after being bent in an approximately "U" shape to prevent interference with the surrounding structure.

Since the wire 129*d* is bent at least once, the upper case 120 may further include wire guides 127 and 128 for fixing a position of the wire 129*d*.

The wire guides 127 and 128 may include a first guide 127 and a second guide 128, which are disposed to be spaced apart from each other in the horizontal direction. The first guide 127 and the second guide 128 may be bent in a direction corresponding to the bending direction of the wire 129*d* to minimize damage of the wire 129*d* to be bent.

That is, each of the first guide 127 and the second guide 128 may include a curved portion.

To limit upward movement of the wire 129*d* disposed between the first guide 127 and the second guide 128, at least one of the first guide 127 and the second guide 128 may include an upper guide 127*a* extending toward the other guide.

Figure 16:
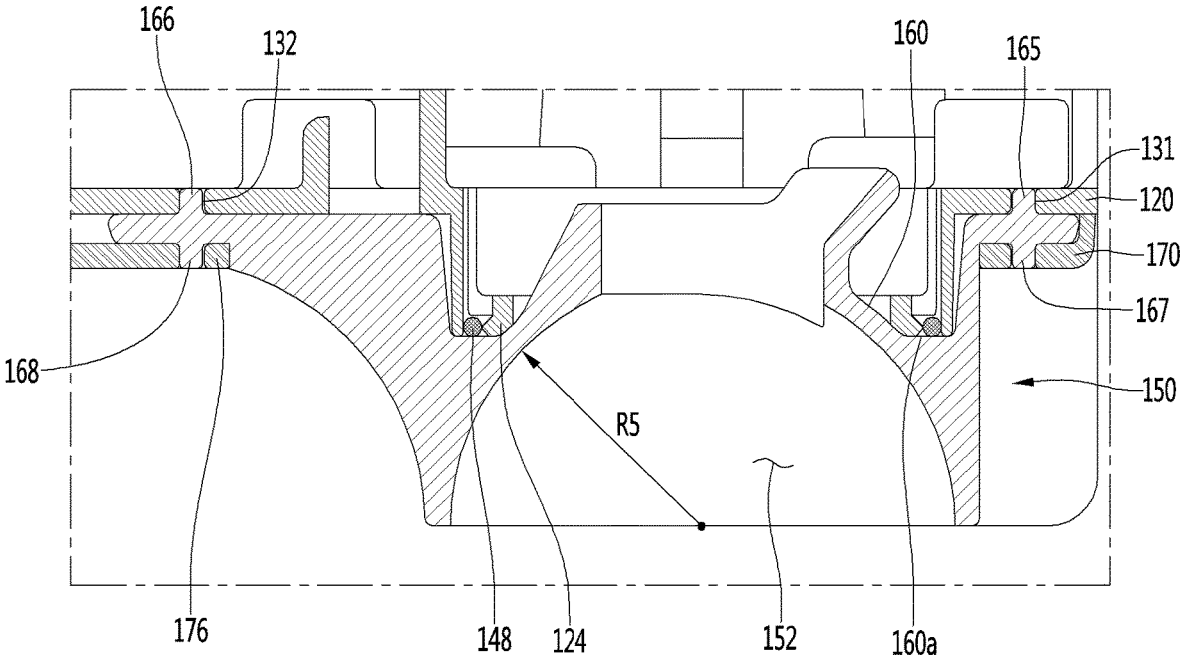
FIG. 16 is a sectional view showing a state in which the upper assembly has been assembled.

FIG. 16 is a cross-sectional view illustrating a state in which an upper assembly is assembled.

Referring to FIGS. 14 and 16, in the state in which the upper heater 148 is coupled to the heater coupling part 124 of the upper case 120, the upper case 120, the upper tray 150, and the upper support 170 may be coupled to each other.

The first upper protrusion 165 of the upper tray 150 may be inserted into the first upper slot 131 of the upper case 120. Also, the second upper protrusion 166 of the upper tray 150 may be inserted into the second upper slot 132 of the upper case 120.

Then, the first lower protrusion 167 of the upper tray 150 may be inserted into the first lower slot 176 of the upper support 170, and the second lower protrusion 168 of the upper tray 150 may be inserted into the second lower slot 177 of the upper support 170.

Thus, the coupling boss 175 of the upper support 170 may pass through the through-hole of the upper tray 150 and then be accommodated in the sleeve 133 of the upper case 120. In this state, the bolt B1 may be coupled to the coupling boss 175 from an upper side of the coupling boss 175.

In the state in which the bolt B1 is coupled to the coupling boss 175, the head part of the bolt B1 may be disposed at a position higher than that of the upper plate 121.

On the other hand, since the hinge supports 135 and 136 are disposed lower than the upper plate 121, while the lower assembly 200 rotates, the upper assembly 110 or the connection unit 350 may be prevented from interfering with the head part of the bolt B1.

While the upper assembly 110 is assembled, a plurality of unit guides 181 and 182 of the upper support 170 may protrude upward from the upper plate 121 through the through-opening (see reference numerals 139*a* and 139*b* of FIG. 6) defined in both sides of the upper plate 121.

As described above, the upper ejector 300 passes through the guide slots 183 of the unit guides 181 and 182 protruding upward from the upper plate 121.

Thus, the upper ejector 300 may descend in the state of being disposed above the upper plate 121 and be inserted into the upper chamber 152 to separate ice of the upper chamber 152 from the upper tray 150.

When the upper assembly 110 is assembled, the heater coupling part 124 to which the upper heater 148 is coupled may be accommodated in the first accommodation part 160 of the upper tray 150.

In the state in which the heater coupling part 124 is accommodated in the first accommodation part 160, the upper heater 148 may contact the bottom surface 160*a* of the first accommodation part 160.

Like this embodiment, when the upper heater 148 is accommodated in the heater coupling part 124 having the recessed shape to contact the upper tray body 151, heat of the upper heater 148 may be minimally transferred to other portion except for the upper tray body 151.

At least a portion of the upper heater 148 may be disposed to vertically overlap the upper chamber 152 so that the heat of the upper heater 148 is smoothly transferred to the upper chamber 152.

In this embodiment, the upper round portion 148*c* of the upper heater 148 may vertically overlap the upper chamber 152.

As an example, the radius of curvature (R1) of the round portion 148*c* is smaller than a radius (R5) of the upper chamber 152.

The upper heater 148 is lower than the support plate 171 in a state that the upper tray 150 is supported by the upper support 170.

<Lower Case>

Figure 17:
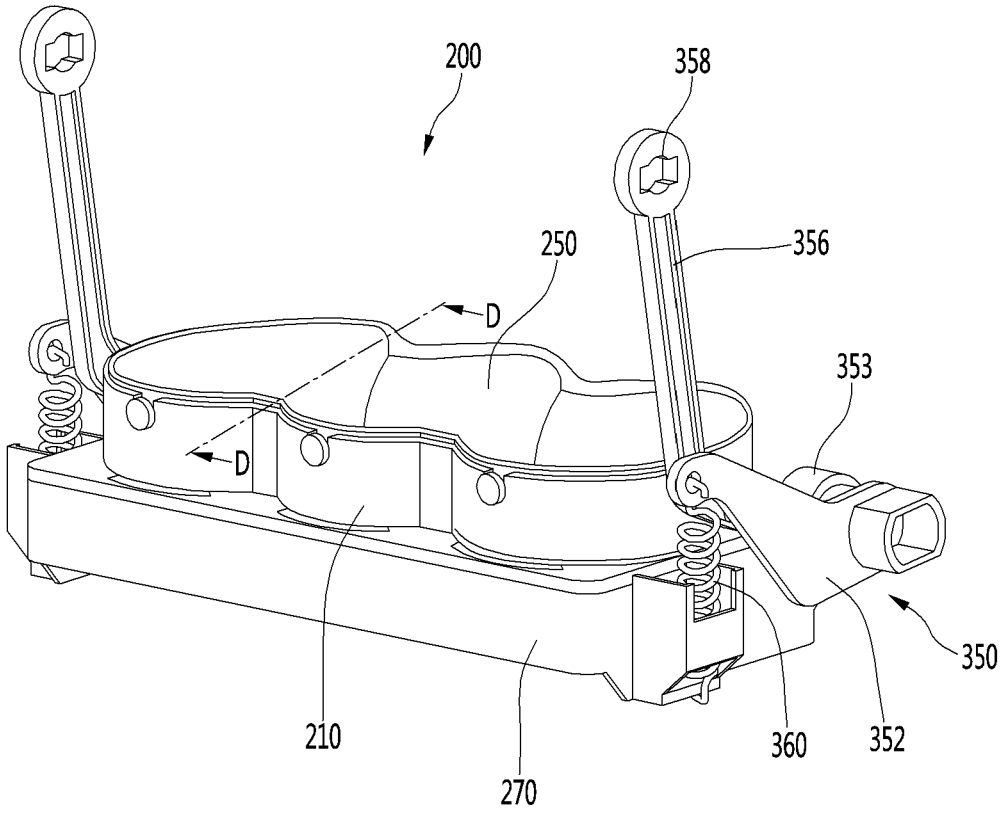
FIG. 17 is a perspective view of a lower assembly according to one embodiment of the present disclosure.
Figure 18:
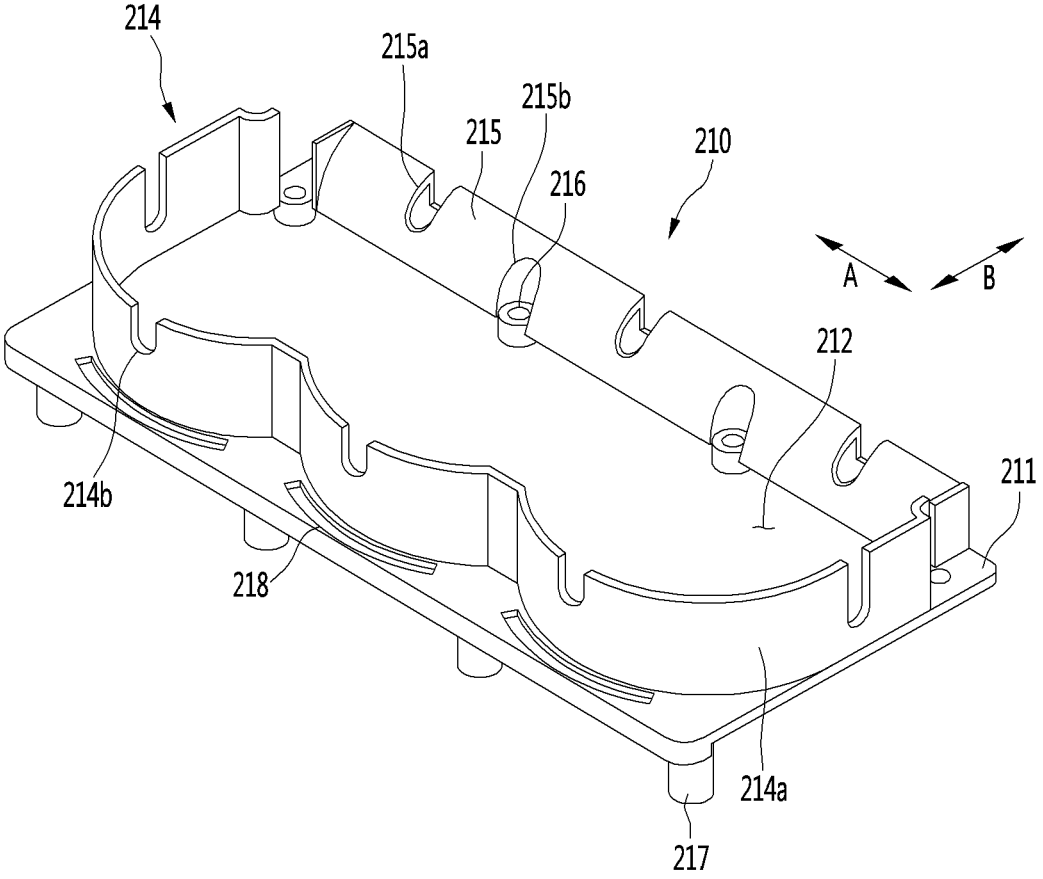
FIG. 18 is a top perspective view of a lower case according to one embodiment of the present disclosure.
Figure 19:
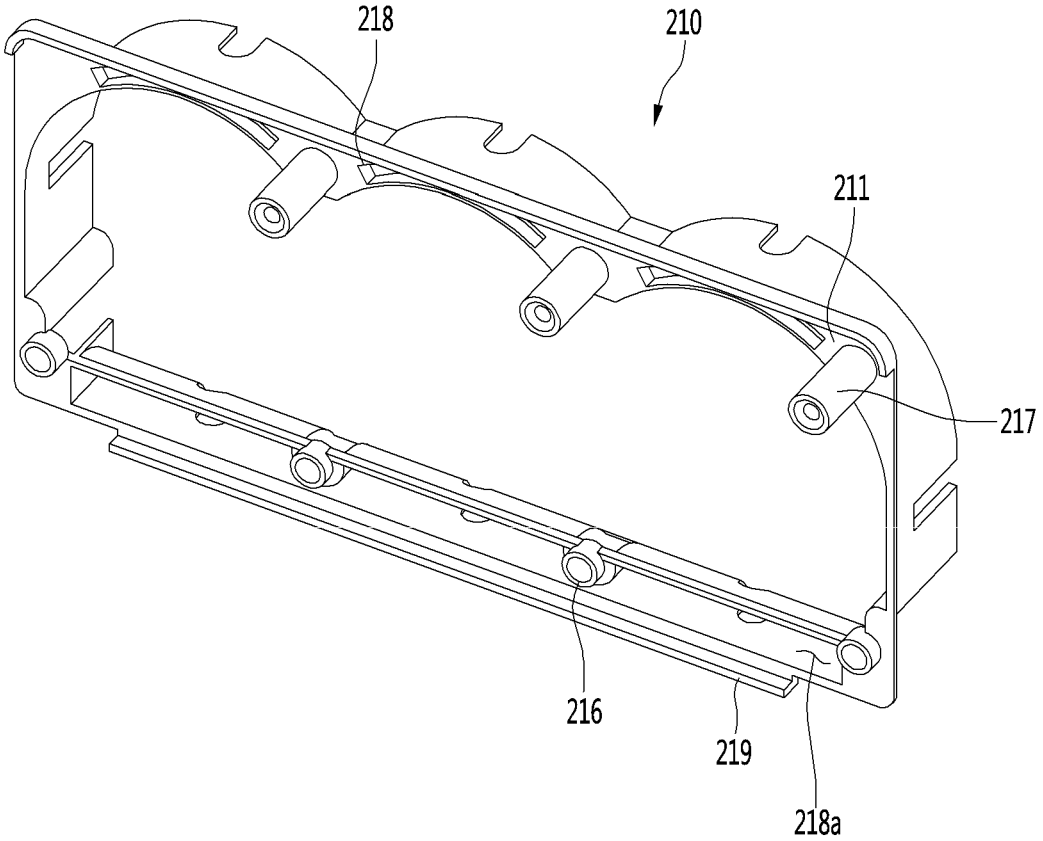
FIG. 19 is a bottom perspective view of a lower case according to one embodiment of the present disclosure.

FIG. 17 is a perspective view of a lower assembly according to an embodiment, FIG. 18 is a top perspective view of a lower case according to an embodiment, and FIG. 19 is a bottom perspective view of the lower case according to an embodiment.

Referring to FIGS. 17 to 19, the lower assembly 200 may include a lower tray 250. The lower tray 250 defines the ice chamber 111 together with the upper tray 150.

The lower assembly 200 may further include a lower support 270 that supports the lower tray 250. The lower support 270 and the lower tray 250 may rotate together while the lower tray 250 is seated on the lower support 270.

The lower assembly 200 may further include a lower case 210 for fixing a position of the lower tray 250.

The lower case 210 may surround the circumference of the lower tray 250, and the lower support 270 may support the lower tray 250.

The connection unit 350 may be coupled to the lower support 270.

The connection unit 350 may include a first link 352 that receives power of the driving unit 180 to allow the lower support 270 to rotate and a second link 356 connected to the lower support 270 to transmit rotation force of the lower support 270 to the upper ejector 300 when the lower support 270 rotates.

The first link 352 and the lower support 270 may be connected to each other by an elastic member 360. For example, the elastic member 360 may be a coil spring.

The elastic member 360 may have one end connected to the first link 362 and the other end connected to the lower support 270.

In an ice making position, the elastic member 360 provide elastic force to the lower support 270 so that contact between the upper tray 150 and the lower tray 250 is maintained.

In this embodiment, the first link 352 and the second link 356 may be disposed on both sides of the lower support 270, respectively.

One of the two first links may be connected to the driving unit 180 to receive the rotation force from the driving unit 180.

The two first links 352 may be connected to each other by a connection shaft (see reference numeral 370 of FIG. 5).

A hole 358 through which the ejector body 310 of the upper ejector 300 passes may be defined in an upper end of the second link 356.

The lower case 210 may include a lower plate 211 for fixing the lower tray 250.

A portion of the lower tray 250 may be fixed to contact a bottom surface of the lower plate 211.

An opening 212 through which a portion of the lower tray 250 passes may be defined in the lower plate 211.

For example, when the lower tray 250 is fixed to the lower plate 211 in a state in which the lower tray 250 is disposed below the lower plate 211, a portion of the lower tray 250 may protrude upward from the lower plate 211 through the opening 212.

The lower case 210 may further include a circumferential wall 214 surrounding the lower tray 250 passing through the lower plate 211.

The circumferential wall 214 may include a vertical wall 214*a* and a curved wall 215.

The vertical wall 214*a* is a wall vertically extending upward from the lower plate 211. The curved wall 215 is a wall that is rounded in a direction that is away from the opening 212 upward from the lower plate 211.

The vertical wall 214*a* may include a first coupling slit 214*b* coupled to the lower tray 250. The first coupling slit 214*b* may be defined by recessing an upper end of the vertical wall downward.

The curved wall 215 may include a second coupling slit 215*a* to the lower tray 250.

The second coupling slit 215*a* may be defined by recessing an upper end of the curved wall 215 downward.

The lower case 210 may further include a first coupling boss 216 and a second coupling boss 217.

The first coupling boss 216 may protrude downward from the bottom surface of the lower plate 211. For example, the plurality of first coupling bosses 216 may protrude downward from the lower plate 211.

The plurality of first coupling bosses 216 may be arranged to be spaced apart from each other in the direction of the arrow A with respect to FIG. 18.

The second coupling boss 217 may protrude downward from the bottom surface of the lower plate 211. For example, the plurality of second coupling bosses 217 may protrude from the lower plate 211. The plurality of second coupling bosses 217 may be arranged to be spaced apart from each other in the direction of the arrow A with respect to FIG. 18.

The first coupling boss 216 and the second coupling boss 217 may be disposed to be spaced apart from each other in the direction of the arrow B.

In this embodiment, a length of the first coupling boss 216 and a length of the second coupling boss 217 may be different from each other. For example, the first coupling boss 216 may have a length less than that of the second coupling boss 217.

The first coupling member may be coupled to the first coupling boss 216 at an upper portion of the first coupling boss 216. On the other hand, the second coupling member may be coupled to the second coupling boss 217 at a lower portion of the second coupling boss 217.

A groove 215*b* for movement of the coupling member may be defined in the curved wall 215 to prevent the first coupling member from interfering with the curved wall 215 while the first coupling member is coupled to the first coupling boss 216.

The lower case 210 may further include a slot 218 coupled to the lower tray 250.

A portion of the lower tray 250 may be inserted into the slot 218. The slot 218 may be disposed adjacent to the vertical wall 214*a*.

For example, a plurality of slots 218 may be defined to be spaced apart from each other in the direction of the arrow A of FIG. 18. Each of the slots 218 may have a curved shape.

The lower case 210 may further include an accommodation groove 218*a* into which a portion of the lower tray 250 is inserted.

The accommodation groove 218*a* may be defined by recessing a portion of the lower plate 211 toward the curved wall 215.

The lower case 210 may further include an extension wall 219 contacting a portion of the circumference of the side surface of the lower plate 211 in the state of being coupled to the lower tray 250. The extension wall 219 may linearly extend in the direction of the arrow A.

<Lower Tray>

Figure 20:
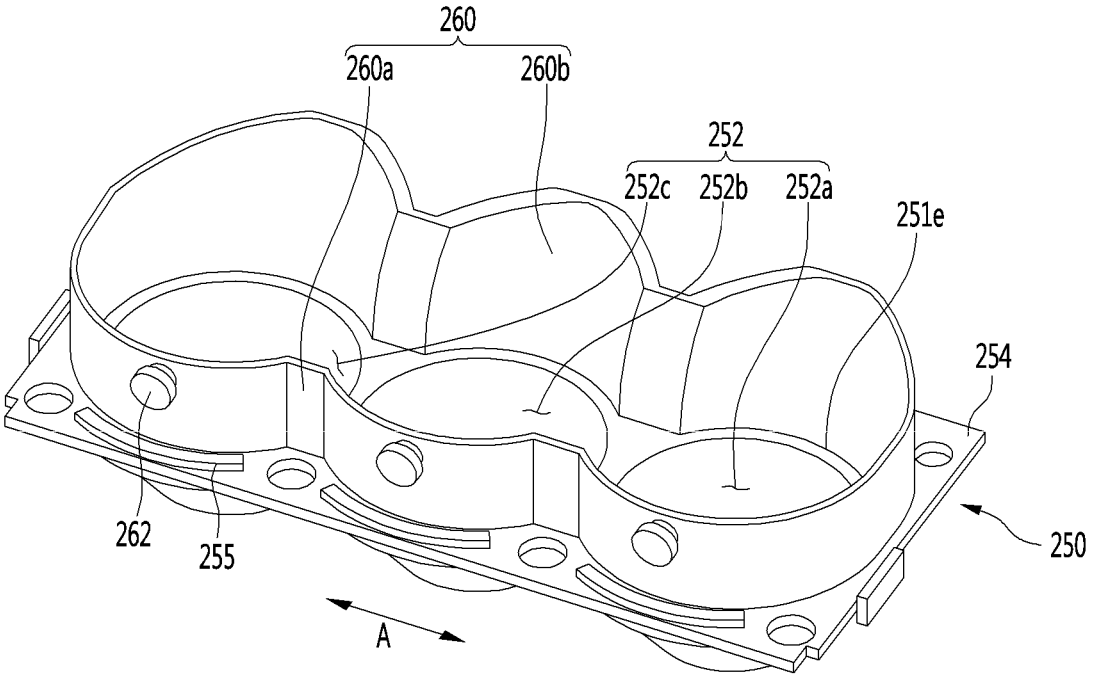
FIG. 20 is a top perspective view of a lower tray according to one embodiment of the present disclosure.
Figure 21:
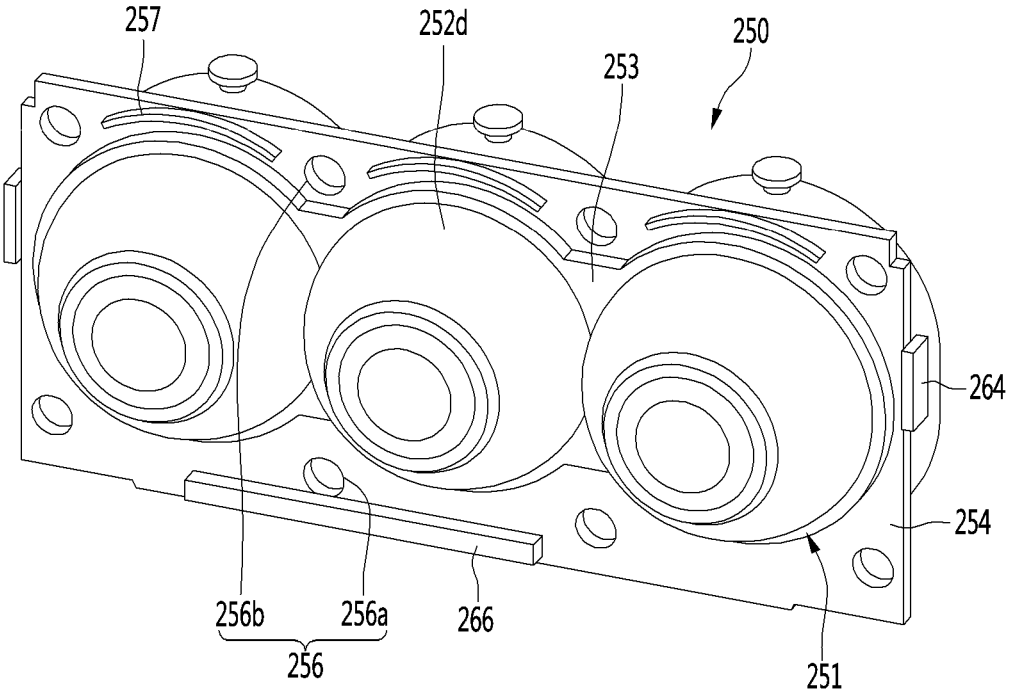
FIG. 21 and FIG. 22 are bottom perspective views of a lower tray according to one embodiment of the present disclosure.
Figure 22:
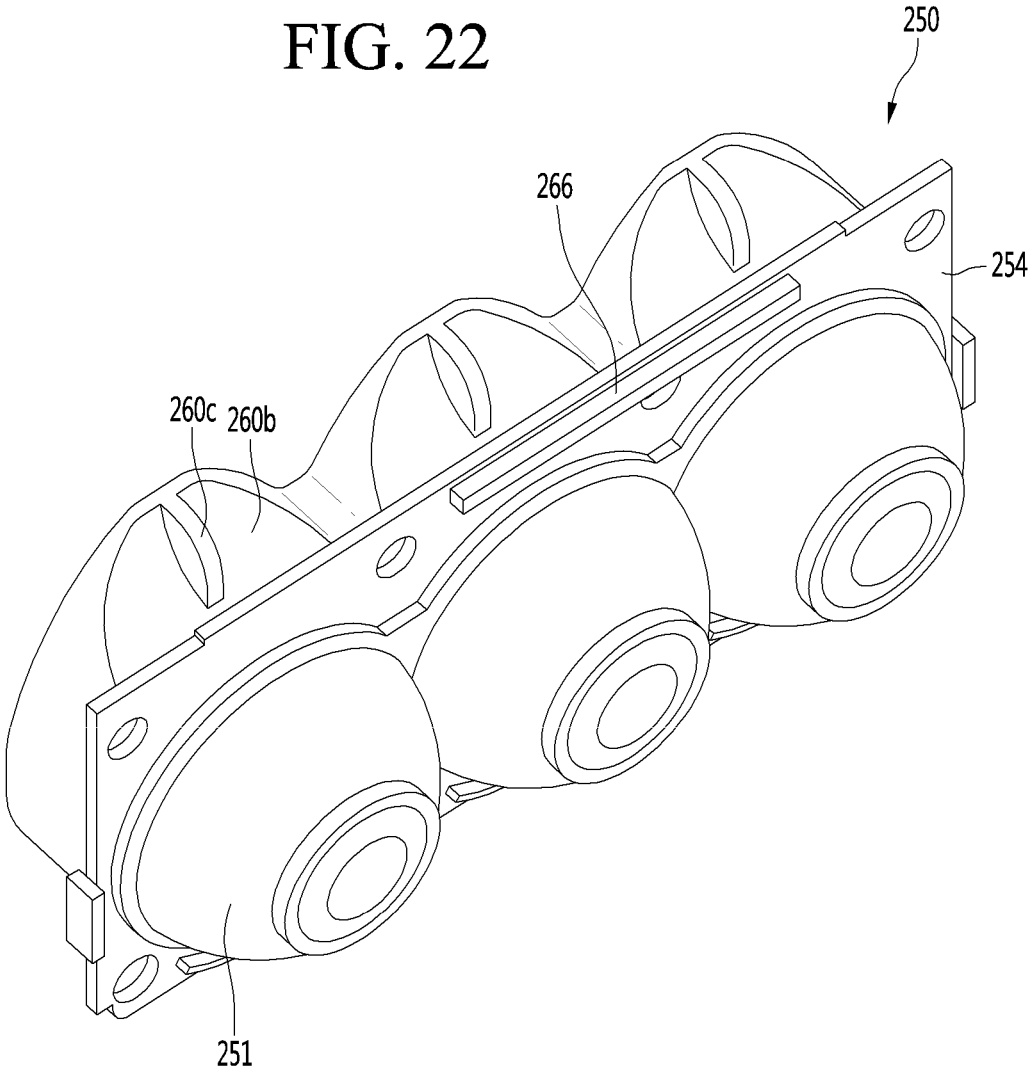
Figure 23:
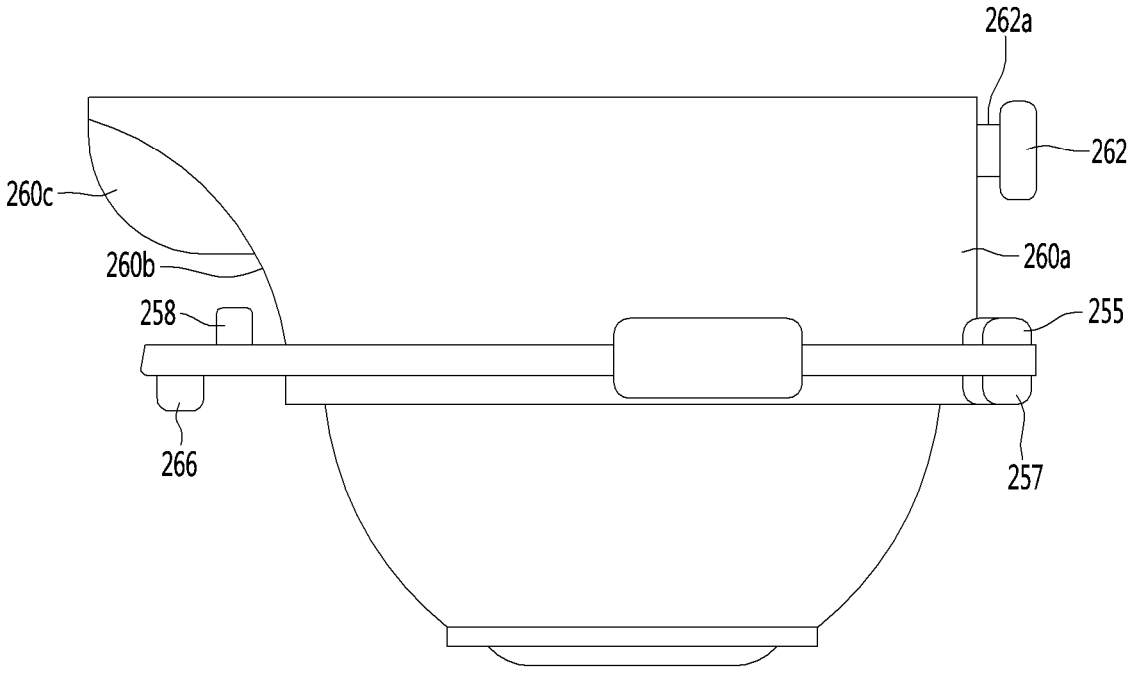
FIG. 23 is a side elevation view of a lower tray according to one embodiment of the present disclosure.

FIG. 20 is a top perspective view of the lower tray according to an embodiment, FIGS. 21 and 22 are bottom perspective views of the lower tray according to an embodiment, and FIG. 23 is a side view of the lower tray according to an embodiment.

Referring to FIGS. 20 to 23, the lower tray 250 may be made of a flexible material that is capable of being restored to its original shape after being deformed by an external force.

For example, the lower tray 250 may be made of a silicone material. Like this embodiment, when the lower tray 250 is made of a silicone material, the lower tray 250 may be restored to its original shape even through external force is applied to deform the lower tray 250 during the ice separating process. Thus, in spite of repetitive ice making, spherical ice may be made.

If the lower tray 250 is made of a metal material, when the external force is applied to the lower tray 250 to deform the lower tray 250 itself, the lower tray 250 may not be restored to its original shape any more.

In this case, after the lower tray 250 is deformed in shape, the spherical ice may not be made. That is, it is impossible to repeatedly make the spherical ice.

On the other hand, like this embodiment, when the lower tray 250 is made of the flexible material that is capable of being restored to its original shape, this limitation may be solved.

Also, when the lower tray 250 is made of the silicone material, the lower tray 250 may be prevented from being melted or thermally deformed by heat provided from an upper heater that will be described later.

The lower tray 250 may include a lower tray body 251 defining a lower chamber 252 that is a portion of the ice chamber 111.

The lower tray body 251 may be define a plurality of lower chambers 252.

For example, the plurality of lower chambers 252 may include a first lower chamber 252*a*, a second lower chamber 252*b*, and a third lower chamber 252*c*.

The lower tray body 251 may include three chamber walls 252*d* defining three independent lower chambers 252*a*, 252*b*, and 252*c*. The three chamber walls 252*d* may be integrated in one body to form the lower tray body 251.

The first lower chamber 252*a*, the second lower chamber 252*b*, and the third lower chamber 252*c* may be arranged in a line. For example, the first lower chamber 252*a*, the second lower chamber 252*b*, and the third lower chamber 252*c* may be arranged in a direction of an arrow A with respect to FIG. 20.

Accordingly, the lower chamber 252 may have a hemispherical shape or a shape similar to the hemispherical shape. That is, a lower portion of the spherical ice may be made by the lower chamber 252.

The lower tray 250 may further include a first extension part 253 horizontally extending from an edge of an upper end of the lower tray body 251. The first extension part 253 may be continuously formed along the circumference of the lower tray body 251.

The lower tray 250 may further include a circumferential wall 260 extended upward from an upper surface of the first extension part 253.

In this embodiment, since the first extension part 253 extends from the lower tray 250 and the circumferential wall 260 extends from the first extension part 253, a bottom surface of the upper tray body 151 may contact a top surface 251*e* of the lower tray body 251.

In addition, the circumferential wall 260 may surround the upper tray body 151 settled in a top surface 251*e* of the lower tray body 251 without interfering with the upper tray body 151.

The circumferential wall 260 may include a first wall 260*a* surrounding the vertical wall 153*a* of the upper tray body 151 and a second wall 260*b* surrounding the curved wall 153*b* of the upper tray body 151.

The first wall 260*a* is a vertical wall vertically extending from the top surface of the first extension part 253. The second wall 260*b* is a curved wall having a shape corresponding to that of the upper tray body 151. That is, the second wall 260*b* may be rounded upward from the first extension part 253 in a direction that is away from the lower chamber 252.

The lower tray 250 may further include a second extension part 254 horizontally extending from the circumferential wall 260.

The second extension part 254 may be disposed higher than the first extension part 253. Thus, the first extension part 253 and the second extension part 254 may be stepped with respect to each other.

The second extension part 254 may include a first upper protrusion 255 inserted into the slot 218 of the lower case 210. The first upper protrusion 255 may be disposed to be horizontally spaced apart from the circumferential wall 260.

For example, the first upper protrusion 255 may protrude upward from a top surface of the second extension part 254 at a position adjacent to the first wall 260*a*.

Although not limited, a plurality of first upper protrusions 255 may be arranged to be spaced apart from each other in the direction of the arrow A with respect to FIG. 20. The first upper protrusion 255 may extend, for example, in a curved shape. That is, the first upper protrusion 255 is curved in a horizontal direction.

The second extension part 254 may include a first lower protrusion 257 inserted into a protrusion groove of the lower case 210, which will be described later. The first lower protrusion 257 may protrude downward from a bottom surface of the second extension part 254.

Although not limited, the plurality of first lower protrusions 257 may be arranged to be spaced apart from each other in the direction of arrow A. That is, the first lower protrusion 257 is curved in a horizontal direction.

The first upper protrusion 255 and the first lower protrusion 257 may be disposed at opposite sides with respect to a vertical direction of the second extension part 254. At least a portion of the first upper protrusion 255 may vertically overlap the second lower protrusion 257.

A plurality of through-holes may be defined in the second extension part 254.

The plurality of through-holes 256 may include a first through-hole 256*a* through which the first coupling boss 216 of the lower case 210 passes and a second through-hole 256*b* through which the second coupling boss 217 of the lower case 210 passes.

For example, the plurality of through-holes 256*a* may be defined to be spaced apart from each other in the direction of the arrow A of FIG. 20.

Also, the plurality of second through-holes 256*b* may be disposed to be spaced apart from each other in the direction of the arrow A of FIG. 20.

The plurality of first through-holes 256*a* and the plurality of second through-holes 256*b* may be disposed at opposite sides with respect to the lower chamber 252.

A portion of the plurality of second through-holes 256*b* may be defined between the two first upper protrusions 255. Also, a portion of the plurality of second through-holes 256*b* may be defined between the two first lower protrusions 257.

The second extension part 254 may further a second upper protrusion 258. The second upper protrusion 258 may be disposed at an opposite side of the first upper protrusion 255 with respect to the lower chamber 252.

The second upper protrusion 258 may be disposed to be horizontally spaced apart from the circumferential wall 260. For example, the second upper protrusion 258 may protrude upward from a top surface of the second extension part 254 at a position adjacent to the second wall 260*b*.

Although not limited, the plurality of second upper protrusions 258 may be arranged to be spaced apart from each other in the direction of the arrow A of FIG. 20.

The second upper protrusion 258 may be accommodated in the accommodation groove 218*a* of the lower case 210. In the state in which the second upper protrusion 258 is accommodated in the accommodation groove 218*a*, the second upper protrusion 258 may contact the curved wall 215 of the lower case 210.

The circumferential wall 260 of the lower tray 250 may include a first coupling protrusion 262 coupled to the lower case 210.

The first coupling protrusion 262 may horizontally protrude from the first wall 260*a* of the circumferential wall 260. The first coupling protrusion 262 may be disposed on an upper portion of a side surface of the first wall 260*a*.

The first coupling protrusion 262 may include a neck part 262*a* having a relatively less diameter when compared to those of other portions. The neck part 262*a* may be inserted into a first coupling slit 214*b* defined in the circumferential wall 214 of the lower case 210.

The circumferential wall 260 of the lower tray 250 may further include a second coupling protrusion 262*c* coupled to the lower case 210.

The second coupling protrusion 262*c* may horizontally protrude from the second wall 260*b* of the circumferential wall 260. The second coupling protrusion 262*c* is lower than an upper end of the circumferential wall 260.

The second coupling protrusion 260*c* may be inserted into a second coupling slit 215*a* defined in the circumferential wall 214 of the lower case 210.

The second extension part 254 may include a second lower protrusion 266. The second lower protrusion 266 may be disposed at an opposite side of the second lower protrusion 257 with respect to the lower chamber 252.

The second lower protrusion 266 may protrude downward from a bottom surface of the second extension part 254. For example, the second lower protrusion 266 may linearly extend.

A portion of the plurality of first through-holes 256*a* may be defined between the second lower protrusion 266 and the lower chamber 252.

The second lower protrusion 266 may be accommodated in a guide groove defined in the lower support 270, which will be described later.

The second extension part 254 may further a side restriction part 264. The side restriction part 264 restricts horizontal movement of the lower tray 250 in the state in which the lower tray 250 is coupled to the lower case 210 and the lower support 270.

The side restriction part 264 laterally protrudes from the second extension part 254 and has a vertical length greater than a thickness of the second extension part 254. For example, one portion of the side restriction part 264 may be disposed higher than the top surface of the second extension part 254, and the other portion of the side restriction part 264 may be disposed lower than the bottom surface of the second extension part 254.

Thus, the one portion of the side restriction part 264 may contact a side surface of the lower case 210, and the other portion may contact a side surface of the lower support 270. In one example, the lower tray body 251 may has a heater contact portion 251*a* which the lower heater 296 contacts. In one example, the heater contact portion 251*a* may be formed on each of the chamber walls 252*d*. The heater contact portion 251*a* may protrude from the respective chamber wall 252*d*. In one example, the heater contact portion 251*a* may be formed in a circular ring shape.

<Lower Support>

Figure 24:
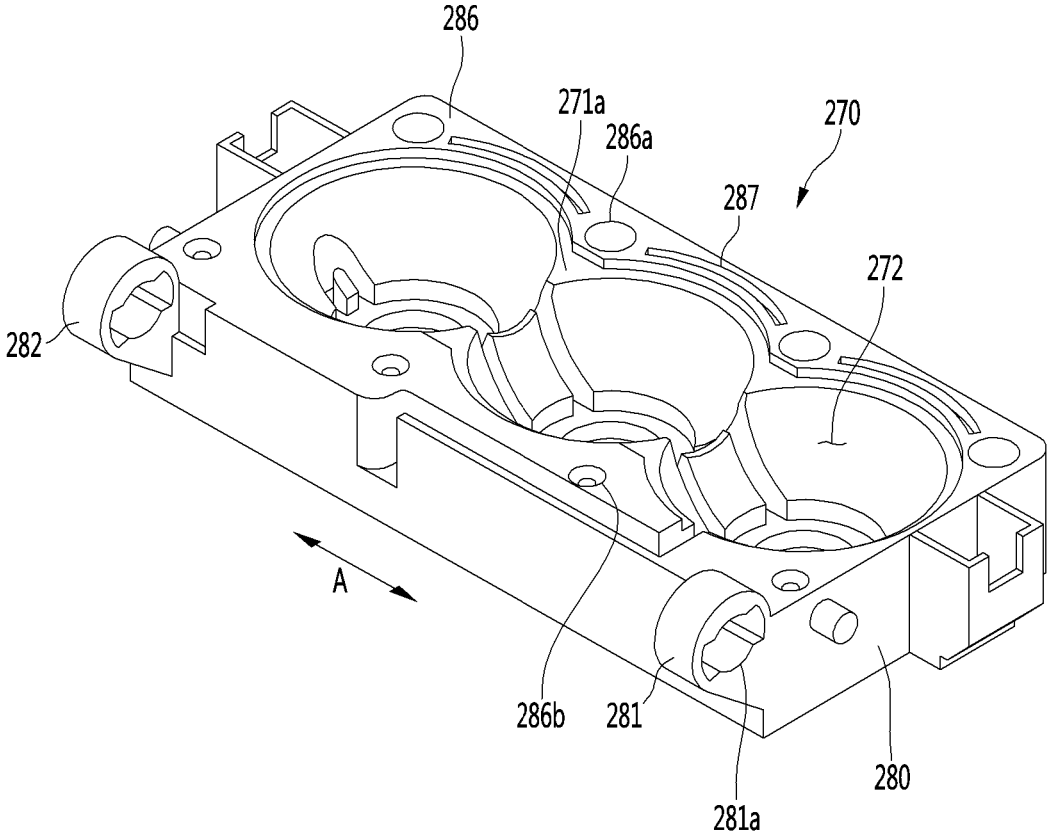
FIG. 24 is a top perspective view of a lower support according to one embodiment of the present disclosure.
Figure 25:
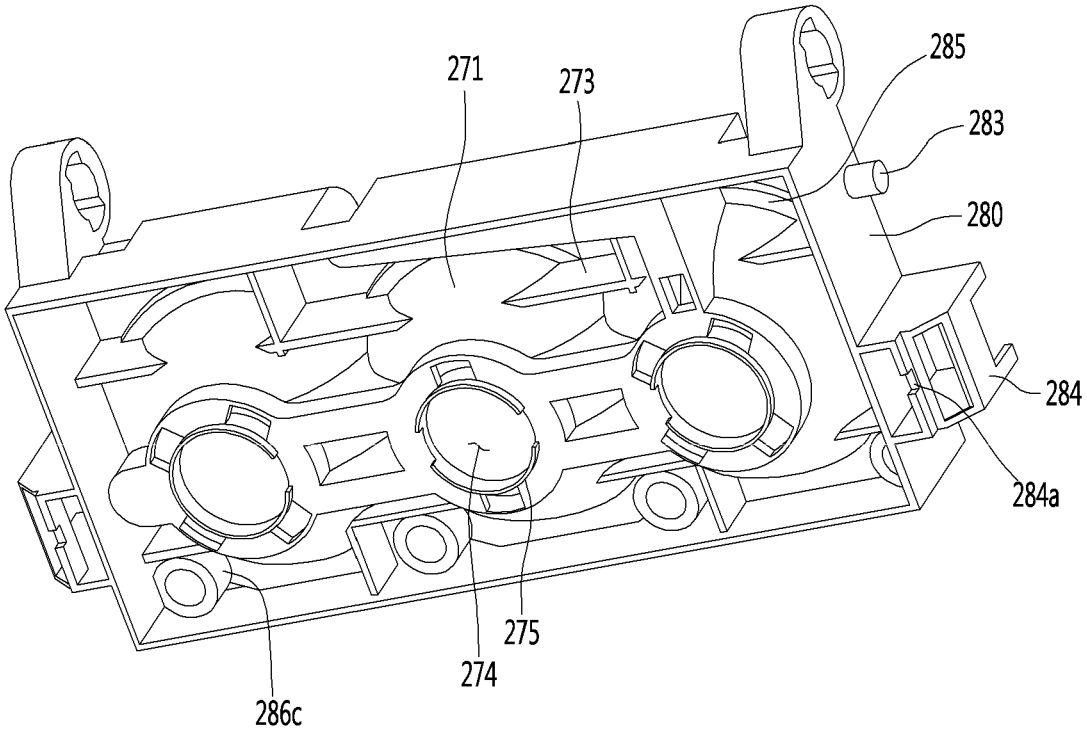
FIG. 25 is a bottom perspective view of a lower support according to one embodiment of the present disclosure.
Figure 26:
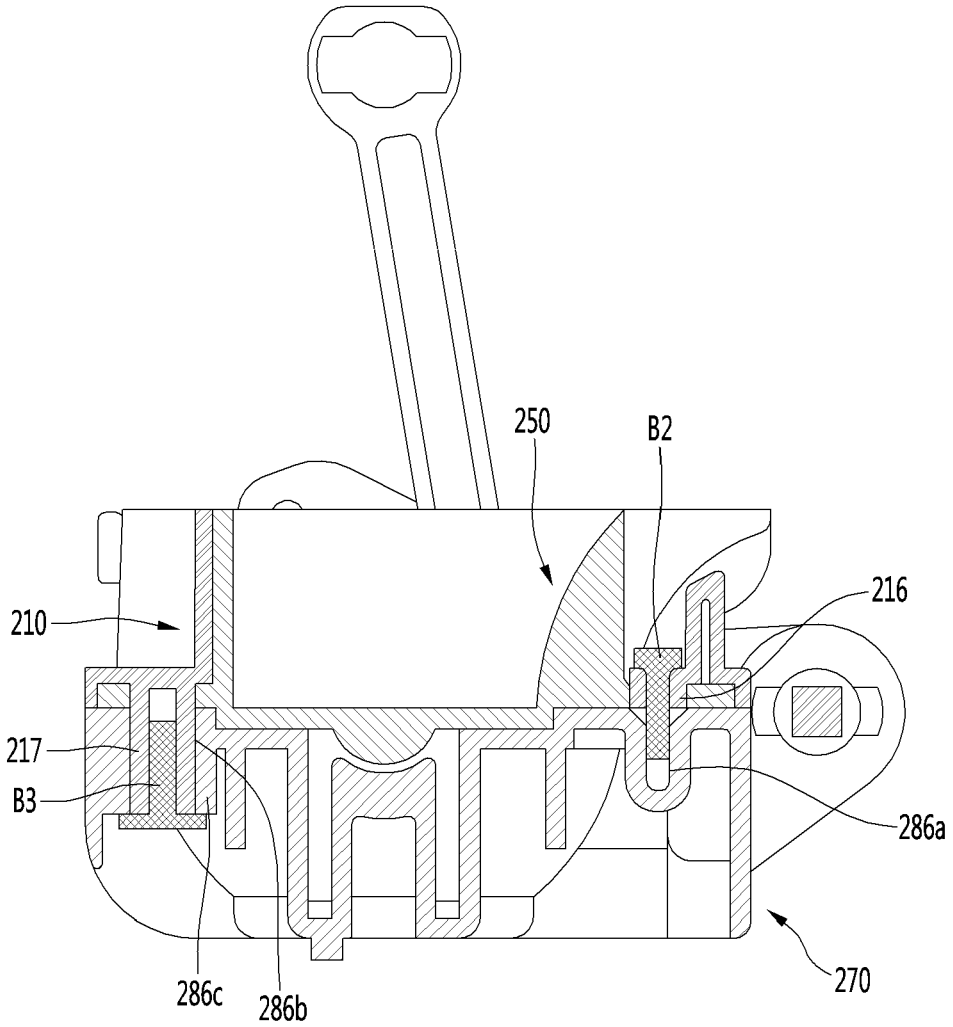
FIG. 26 is a cross-sectional view taken along line D-D of FIG. 17 for showing a state that a lower assembly is assembled.

FIG. 24 is a top perspective view of the lower support according to an embodiment, FIG. 25 is a bottom perspective view of the lower support according to an embodiment, and FIG. 26 is a cross-sectional view taken along line D-D of FIG. 17 for showing a state that a lower assembly is assembled.

Referring to FIGS. 24 to 26, the lower support 270 may include a support body 271 supporting the lower tray 250.

The support body 271 may include three chamber accommodation parts 272 accommodating the three chamber walls 252*d* of the lower tray 250. The chamber accommodation part 272 may have a hemispherical shape.

The support body 271 may have a lower opening 274 through which the lower ejector 400 passes during the ice separating process. For example, three lower openings 274 may be defined to correspond to the three chamber accommodation parts 272 in the support body 271.

A reinforcement rib 275 reinforcing strength may be disposed along a circumference of the lower opening 274.

Also, the adjacent two accommodation part 272 of the three accommodation parts 272 may be connected to each other by a connection rib 273. The connection rib 273 may reinforce strength of the chamber walls 252*d*.

The lower support 270 may further include a first extension wall 285 horizontally extending from an upper end of the support body 271.

The lower support 270 may further include a second extension wall 286 that is formed to be stepped with respect to the first extension wall 285 on an edge of the first extension wall 285.

A top surface of the second extension wall 286 may be disposed higher than the first extension wall 285.

The first extension part 253 of the lower tray 250 may be seated on a top surface 271*a* of the support body 271, and the second extension part 254 may surround side surface of the first extension part 253 of the lower tray 250. Here, the second extension wall 286 may contact the side surface of the first extension part 253 of the lower tray 250.

The lower support 270 may further include a first protrusion groove 287 accommodating the first lower protrusion 257 of the lower tray 250.

The first protrusion groove 287 may extend in a curved shape. The first protrusion groove 287 may be defined, for example, in a second extension wall 286.

The lower support 270 may further include a first coupling groove 286*a* to which a first coupling member B2 passing through the first coupling boss 216 of the upper case 210 is coupled.

The first coupling groove 286*a* may be provided, for example, in the second extension wall 286.

The plurality of first coupling grooves 286*a* may be disposed to be spaced apart from each other in the direction of the arrow A in the second extension wall 286. A portion of the plurality of first coupling grooves 286*a* may be defined between the adjacent two protrusion grooves 287.

The lower support 270 may further include a boss through-hole 286*b* through which the second coupling boss 217 of the upper case 210 passes.

The boss through-hole 286*b* may be provided, for example, in the second extension wall 286. A sleeve 286*c* surrounding the second coupling boss 217 passing through the boss through-hole 286*b* may be disposed on the second extension wall 286. The sleeve 286*c* may have a cylindrical shape with an opened lower portion.

The first coupling member B2 may be coupled to the first coupling groove 286*a* after passing through the first coupling boss 216 from an upper side of the lower case 210.

The second coupling member B3 may be coupled to the second coupling boss 217 from a lower side of the lower support 270.

The sleeve 286*c* may have a lower end that is disposed at the same height as a lower end of the second coupling boss 217 or disposed at a height lower than that of the lower end of the second coupling boss 217.

Thus, while the second coupling member B3 is coupled, the head part of the second coupling member B3 may contact bottom surfaces of the second coupling boss 217 and the sleeve 286*c* or may contact a bottom surface of the sleeve 286*c*.

The lower support 270 may further include an outer wall 280 disposed to surround the lower tray body 251 in a state of being spaced outward from the outside of the lower tray body 251.

The outer wall 280 may, for example, extend downward along an edge of the second extension wall 286.

The lower support 270 may further include a plurality of hinge bodies 281 and 282 respectively connected to hinge supports 135 and 136 of the upper case 210.

The plurality of hinge bodies 281 and 282 may be disposed to be spaced apart from each other in a direction of an arrow A of FIG. 24. Each of the hinge bodies 281 and 282 may further include a second hinge hole 281*a*.

The shaft connection part 353 of the first link 352 may pass through the second hinge hole 281*a*. The connection shaft 370 may be connected to the shaft connection part 353.

A distance between the plurality of hinge bodies 281 and 282 may be less than that between the plurality of hinge supports 135 and 136. Thus, the plurality of hinge bodies 281 and 282 may be disposed between the plurality of hinge supports 135 and 136.

The lower support 270 may further include a coupling shaft 283 to which the second link 356 is rotatably coupled. The coupling shaft 383 may be disposed on each of both surfaces of the outer wall 280.

Also, the lower support 270 may further include an elastic member coupling part 284 to which the elastic member 360 is coupled. The elastic member coupling part 284 may define a space in which a portion of the elastic member 360 is accommodated. Since the elastic member 360 is accommodated in the elastic member coupling part 284 to prevent the elastic member 360 from interfering with the surrounding structure.

Also, the elastic member coupling part 284 may include a hook part 284*a* on which a lower end of the elastic member 360 is hooked.

<Coupling Structure of Lower Heater>

Figure 27:
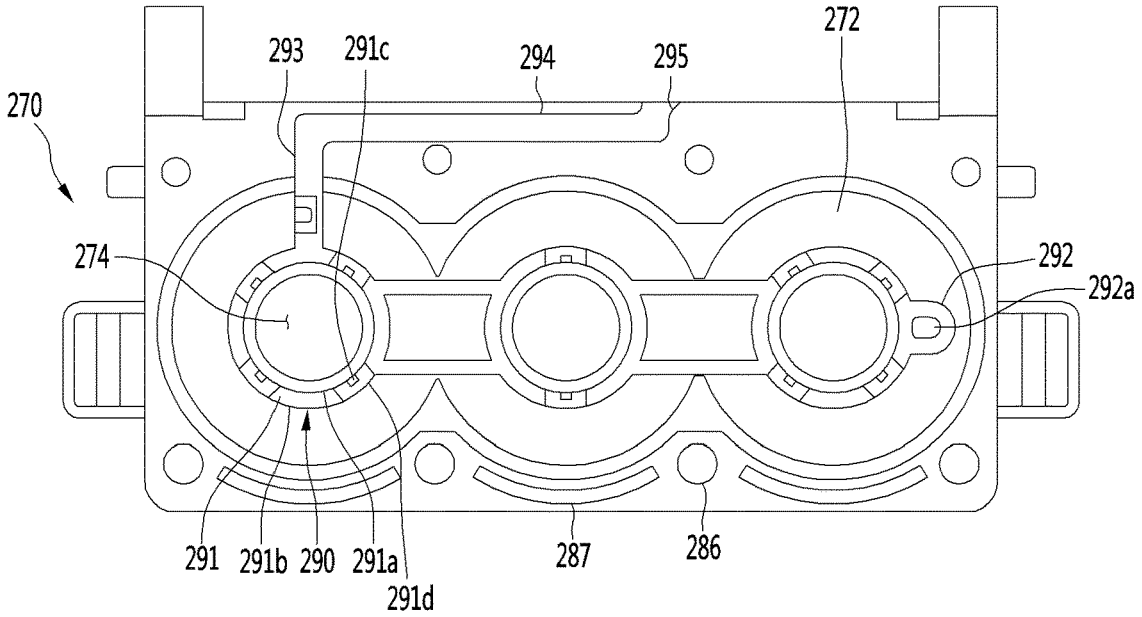
FIG. 27 is a plan view of a lower support according to one embodiment of the present disclosure.
Figure 28:
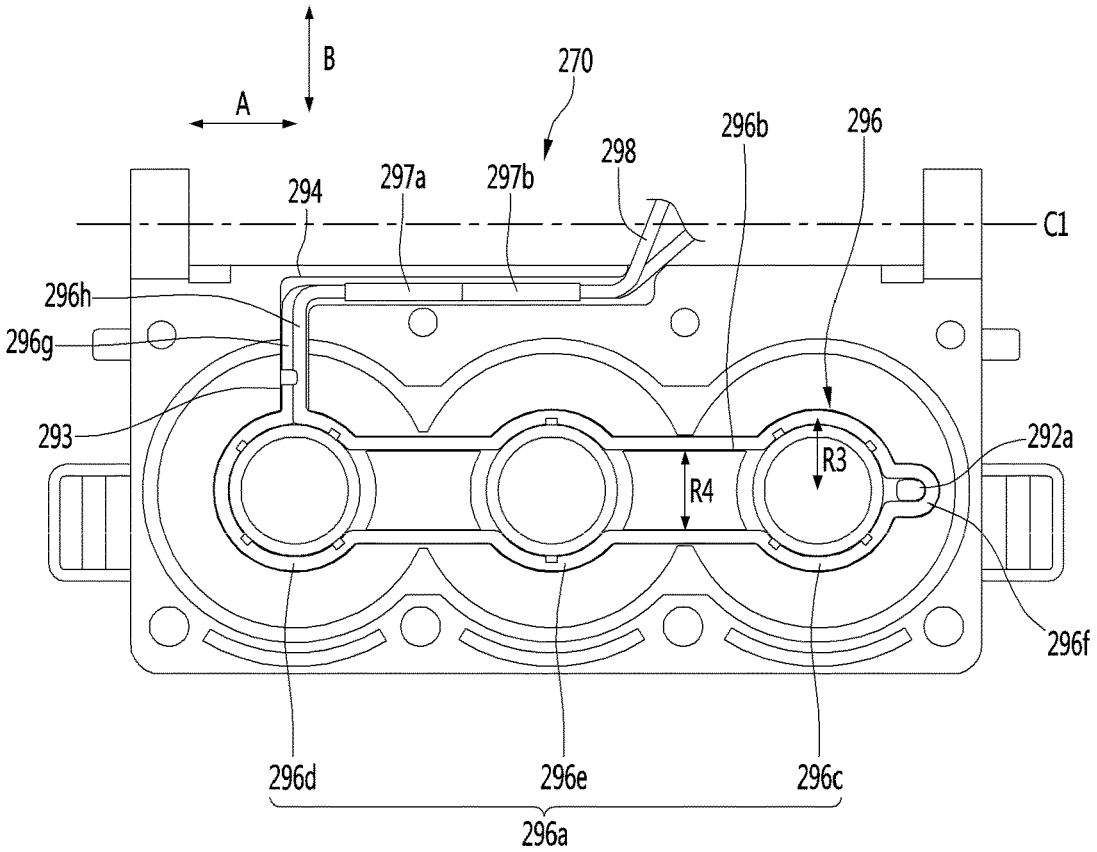
FIG. 28 is a perspective view showing a state in which a lower heater is coupled to a lower support of FIG. 27.
Figure 29:
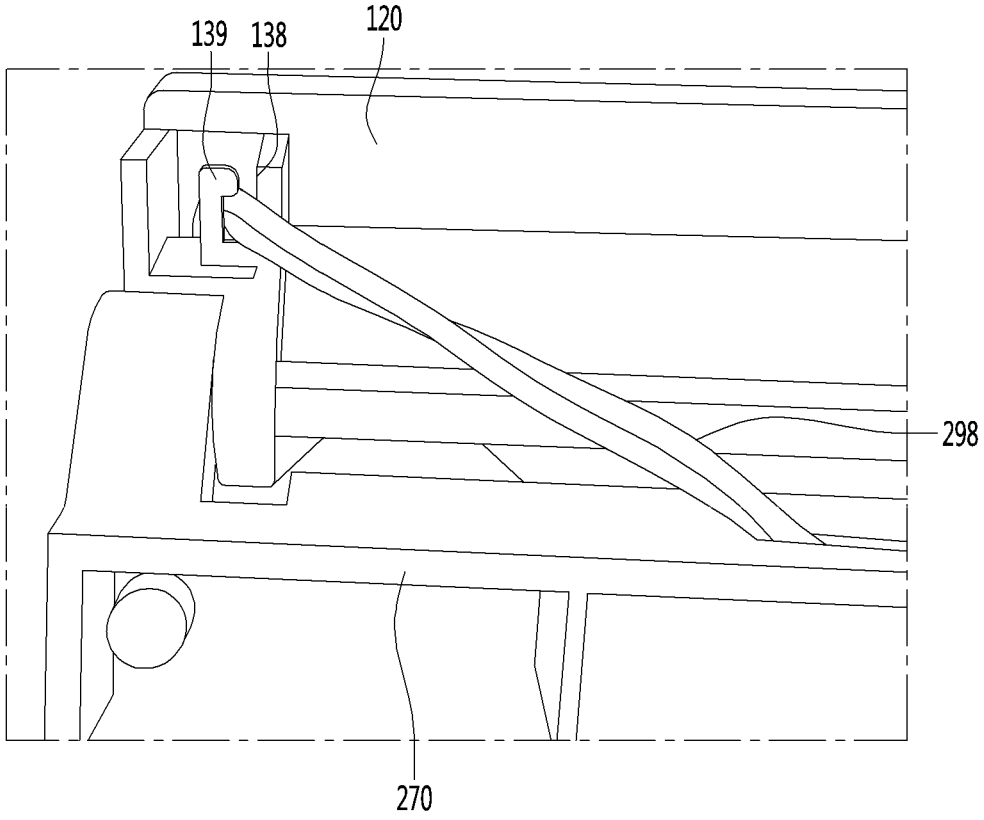
FIG. 29 is a view showing a state in which a lower assembly is coupled to an upper assembly and, at the same time, a wire connected to a lower heater penetrates an upper case.

FIG. 27 is a plan view of the lower support according to an embodiment, FIG. 28 is a perspective view illustrating a state in which a lower heater is coupled to the lower support of FIG. 27, and FIG. 29 is a view illustrating a state in which the wire connected to the lower heater passes through the upper case in a state in which the lower assembly is coupled to the upper assembly.

Referring to FIGS. 27 to 29, the ice maker 100 according to this embodiment may further include a lower heater 296 for applying heat to the lower tray 250 during the ice making process.

The lower heater 297 may provide the heat to the lower chamber 252 during the ice making process so that ice within the ice chamber 111 is frozen from an upper side.

Also, since lower heater 296 generates heat in the ice making process, bubbles within the ice chamber 111 may move downward during the ice making process. When the ice is completely made, a remaining portion of the spherical ice except for the lowermost portion of the ice may be transparent. According to this embodiment, the spherical ice that is substantially transparent may be made.

For example, the lower heater 296 may be a wire-type heater.

The lower heater 296 may be installed on the lower support 270. Also, the lower heater 296 may contact the lower tray 250 to provide heat to the lower chamber 252.

For example, the lower heater 296 may contact the lower tray body 251. Also, the lower heater 296 may be disposed to surround the three chamber walls 252*d* of the lower tray body 251.

The lower support 270 may further include a heater coupling part 290 to which the lower heater 296 is coupled. The heater coupling part 290 may include a heater accommodation groove 291 that is recessed downward from the chamber accommodation part 272 of the lower tray body 251.

Since the heater accommodation groove 291 is recessed, the heater coupling part 290 may include an inner wall 291*a* and an outer wall 291*b*.

The inner wall 291*a* may have, for example, a ring shape, and the outer wall 291*b* may be disposed to surround the inner wall 291*a*.

When the lower heater 296 is accommodated in the heater accommodation groove 291, the lower heater 296 may surround at least a portion of the inner wall 291*a*.

The lower opening 274 may be defined in a region defined by the inner wall 291*a*. Thus, when the chamber wall 252*d* of the lower tray 250 is accommodated in the chamber accommodation part 272, the chamber wall 252*d* may contact a top surface of the inner wall 291*a*. The top surface of the inner wall 291*a* may be a rounded surface corresponding to the chamber wall 252*d* having the hemispherical shape.

The lower heater may have a diameter greater than a recessed depth of the heater accommodation groove 291 so that a portion of the lower heater 296 protrudes to the outside of the heater accommodation groove 291 in the state in which the lower heater 296 is accommodated in the heater accommodation groove 291.

A separation prevention protrusion 291*c* may be provided on one of the outer wall 291*b* and the inner wall 291*a* to prevent the lower heater 296 accommodated in the heater accommodation groove 291 from being separated from the heater accommodation groove 291.

In FIG. 26, the separation prevention protrusions 291*c* is provided on the inner wall 291*a*.

Since the inner wall 291*a* has a diameter less than that of the chamber accommodation part 272, the lower heater 296 may move along a surface of the chamber accommodation part 272 and then be accommodated in the heater accommodation groove 291 in a process of assembling the lower heater 296.

That is, the lower heater 296 is accommodated in the heater accommodation groove 291 from an upper side of the outer wall 291*b* toward the inner wall 291*a*. Thus, the separation prevention protrusion 291*c* may be disposed on the inner wall 291*a* to prevent the lower heater 296 from interfering with the separation prevention protrusion 291*c* while the lower heater 296 is accommodated in the heater accommodation groove 291.

The separation prevention protrusion 291*c* may protrude from an upper end of the inner wall 291*a* toward the outer wall 291*b*.

A protruding length of the separation prevention protrusion 291*c* may be about ½ of a distance between the outer wall 291*b* and the inner wall 291*a*.

As illustrated in FIG. 28, in the state in which the lower heater 296 is accommodated in the heater accommodation groove 291, the lower heater 296 may be divided into a lower round portion 296*a* and a lower linear portion 296*b*.

The lower round portion 296*a* may be a portion disposed along the circumference of the lower chamber 252 and also a portion that is bent to be rounded in a horizontal direction.

The lower linear portion 296*b* may be a portion connecting the lower round portions 296*a* corresponding to the lower chambers 252 to each other.

The upper round portion 184*c* may comprise first lower round portions 296*c*, 296*d* corresponding to first and third lower chambers 252*a*, 252*c* of both sides of an outermost section among a plurality of lower chambers 252.

The first lower round portions 296*c*, 296*d* may be connected by a pair of lower linear portions 296*b*. That is, the pair of lower linear portions 296*b* each may be connected to both ends of first lower round portions 296*c*, 296*d*.

Lengths of the first lower round portions 296*c*, 296*d* are longer than each of the pair of lower linear portions 296*b*.

The pair of lower linear portions 296*b* connected to both ends of the first lower round portions 296*c*, 296*d* may be disposed substantially in parallel.

A distance (R4) between the pair of lower linear portions 296*b* is smaller than double (2*R3) in a radius of curvature of the first lower round portions 296*c*, 296*d*.

As the distance (R4) between the pair of lower linear portions 296*b* is elongated, lengths of each of the pair of lower linear portions 296*b* get long, whereas lengths of the first lower round portions 296*c*, 296*d* are reduced, and thus a length of the lower heater 296 is reduced when viewing the lower heater 296 as a whole.

When the length of the lower heater 296 is reduced, there is a small amount of heat transmitted to the lower chamber 252 by the lower heater 296.

In addition, when the distance (R2) of the pair of lower linear portion 296*b* is elongated, a distance between the lower linear portion 296*b* and the lower chamber 252 is increased, thereby enhancing a time when the heat of the lower linear portion 296*b* reaches the lower chamber 252.

However, according to this embodiment, since the distance (R4) between the pair of lower linear portion 296*b* is smaller than double in the radius of curvature in the first lower round portions 296*c*, 2296*d*, an interval between the pair of lower linear portion 296*b* and the lower chamber 252 may be reduced to rapidly transfer the heat of the lower linear portion 296*b* to the lower chamber 252.

The distance (R4) between the pair of lower linear portion 296*b* may be equal to or larger than a radius of curvature (R3) of the first lower round portions 296*c*, 296*d*.

As the distance (R4) between the pair of lower linear portions 296*b* is reduced more and more, there is a large degree of bending in a boundary between the pair of lower linear portions 296*b* and the first lower round portions 296*c*, 296*d*, thereby providing a lot of concern for a short circuit, and also, heat between two upper chambers that are adjacent to each other may be unnecessary concentrated.

However, according to this embodiment, if the distance (R4) between the pair of lower linear portions 296*b* is equal to or larger than the radius of curvature (R3) of the first lower round portions 296*c*, 296*d*, the above-described problem can be prevented.

The lower round portion 296*a* may further comprise a second lower round portion 296*e* corresponding to the second lower chamber 252*b*.

As an example, a pair of second lower round portions 296*e* may be spaced apart from each other. This is because each of the pair of second lower round portions 296*e* has to be connected to the first lower round portions 296*c*, 296*d* by the lower linear part 296*b* of both sides.

A length of the second lower round portion 296*e* may be shorter than a length of the first lower round portions 296*c*, 296*d*.

Since the lower round portion 296*a* of the lower heater 296 may be separated from the heater accommodation groove 291, the separation prevention protrusion 291*c* may be disposed to contact the lower round portion 296*a*.

A through-opening 291*d* may be defined in a bottom surface of the heater accommodation groove 291. When the lower heater 296 is accommodated in the heater accommodation groove 291, a portion of the lower heater 296 may be disposed in the through-opening 291*d*. For example, the through-opening 291*d* may be defined in a portion of the lower heater 296 facing the separation prevention protrusion 291*c*.

When the lower heater 296 is bent to be horizontally rounded, tension of the lower heater 296 may increase to cause disconnection, and also, the lower heater 296 may be separated from the heater accommodation groove 291.

However, when the through-opening 291*d* is defined in the heater accommodation groove 291 like this embodiment, a portion of the lower heater 296 may be disposed in the through-opening 291*d* to reduce the tension of the lower heater 296, thereby preventing the heater accommodation groove 291 from being separated from the lower heater 296.

The lower support 270 may include a first guide groove 293 guiding a power input terminal 296*g* and a power output terminal 296*h* of the lower heater 296 accommodated in the heater accommodation groove 291 and a second guide groove 294 extending in a direction crossing the first guide groove 293.

For example, the first guide groove 293 may extend in a direction of an arrow B in the heater accommodation part 291.

The second guide groove 294 may extend from an end of the first guide groove 293 in a direction of an arrow A. In this embodiment, the direction of the arrow A may be a direction that is parallel to the extension direction of a rotational central axis C1 of the lower assembly.

Referring to FIG. 28, the first guide groove 293 may extend from one of the left and right chamber accommodation parts except for the intermediate chamber accommodation part of the three chamber accommodation parts.

For example, in FIG. 28, the first guide groove 293 extends from the chamber accommodation part, which is disposed at the left side, of the three chamber accommodation parts. That is, a part extending from the first lower round portion 296*d* to the left may be accommodated in the first guide groove 293.

As illustrated in FIG. 28, in a state in which the power input terminal 296*g* and the power output terminal 296*h* of the lower heater 296 are disposed in parallel to each other, the lower heater 296 may be accommodated in the first guide groove 293.

The power input terminal 296*g* and the power output terminal 296*h* of the lower heater 296 may be connected to one first connector 297*a*.

A second connector 297*b* to which two wires 298 connected to correspond to the power input terminal 296*g* and the power output terminal 296*h* are connected may be connected to the first connector 297*a*.

In this embodiment, in the state in which the first connector 297*a* and the second connector 297*b* are connected to each other, the first connector 297*a* and the second connector 297*b* are accommodated in the second guide groove 294.

The wire 298 connected to the second connector 297*b* is led out from the end of the second guide groove 294 to the outside of the lower support 270 through an lead-out slot 295 defined in the lower support 270.

According to this embodiment, since the first connector 297*a* and the second connector 297*b* are accommodated in the second guide groove 294, the first connector 297*a* and the second connector 297*b* are not exposed to the outside when the lower assembly 200 is completely assembled.

As described above, the first connector 297*a* and the second connector 297*b* may not be exposed to the outside to prevent the first connector 297*a* and the second connector 297*b* from interfering with the surrounding structure while the lower assembly 200 rotates and prevent the first connector 297*a* and the second connector 297*b* from being separated.

Since the first connector 297*a* and the second connector 297*b* are accommodated in the second guide groove 294, one portion of the wire 298 may be disposed in the second guide groove 294, and the other portion may be disposed outside the lower support 270 by the lead-out slot 295.

Here, since the second guide groove 294 extends in a direction parallel to the rotational central axis C1 of the lower assembly 200, one portion of the wire 298 may extend in the direction parallel to the rotational central axis C1.

The other part of the wire 298 may extend from the outside of the lower support 270 in a direction crossing the rotational central axis C1.

According to the arrangement of the wires 298, tensile force may not merely act on the wires 298, but torsion force may act on the wires 298 during the rotation of the lower assembly 200.

When compared that the tensile force acts on the wire 298, if the torsion acts on the wire 298, possibility of disconnection of the wire 298 may be very little.

According to this embodiment, while the lower assembly 200 rotates, the lower heater 296 may be maintained at a fixed position, and twisting force may act on the wire 298 to prevent the lower heater 296 from being damaged and disconnected.

The power input terminal 296*g* and the power output terminal 296*h* of the lower heater 296 are disposed in the first guide groove 293. Here, since heat is also generated in the power input terminal 296*g* and the power output terminal 296*h*, heat provided to the left chamber accommodation part to which the first guide groove 293 extends may be greater than that provided to other chamber accommodation parts.

In this case, if intensities of the heat provided to each chamber accommodating part are different, transparency of the made spherical ice after the ice making process and the ice separating process may be changed for each ice.

Thus, a detour accommodation groove 292 may be further provided in the chamber accommodation part (for example, the right chamber accommodation part), which is disposed farthest from the first guide groove 292, of the three chamber accommodation parts to minimize a difference in transparency for each ice.

For example, the detour accommodation groove 292 may extend outward from the heater accommodation groove 291 and then be bent so as to be disposed in a shape that is connected to the heater accommodation groove 291.

When a portion 296*e* of the lower heater 296 is additionally accommodated in the detour accommodation groove 292, a contact area between the chamber wall accommodated in the right chamber accommodation part 272 and the lower heater 296 may increase.

Thus, a protrusion 292*a* for fixing a position of the lower heater 296 accommodated in the detour accommodation groove 292 may be additionally provided in the right chamber accommodation part 272.

As an example, a portion 296*f* of the first lower round portion 296*c* disposed to the left may be disposed in the detour accommodation groove 292.

Referring to FIG. 29, in the state in which the lower assembly 200 is coupled to the upper case 120 of the upper assembly 110, the wire 298 led out to the outside of the lower support 270 may pass through a wire through-slot 138 defined in the upper case 120 to extend upward from the upper case 120.

A restriction guide 139 for restricting the movement of the wire 298 passing through the wire through-slot 138 may be provided in the wire through-slot 138. The restriction guide 139 may have a shape that is bent several times, and the wire 298 may be disposed in a region defined by the restriction guide 139.

Figure 30:
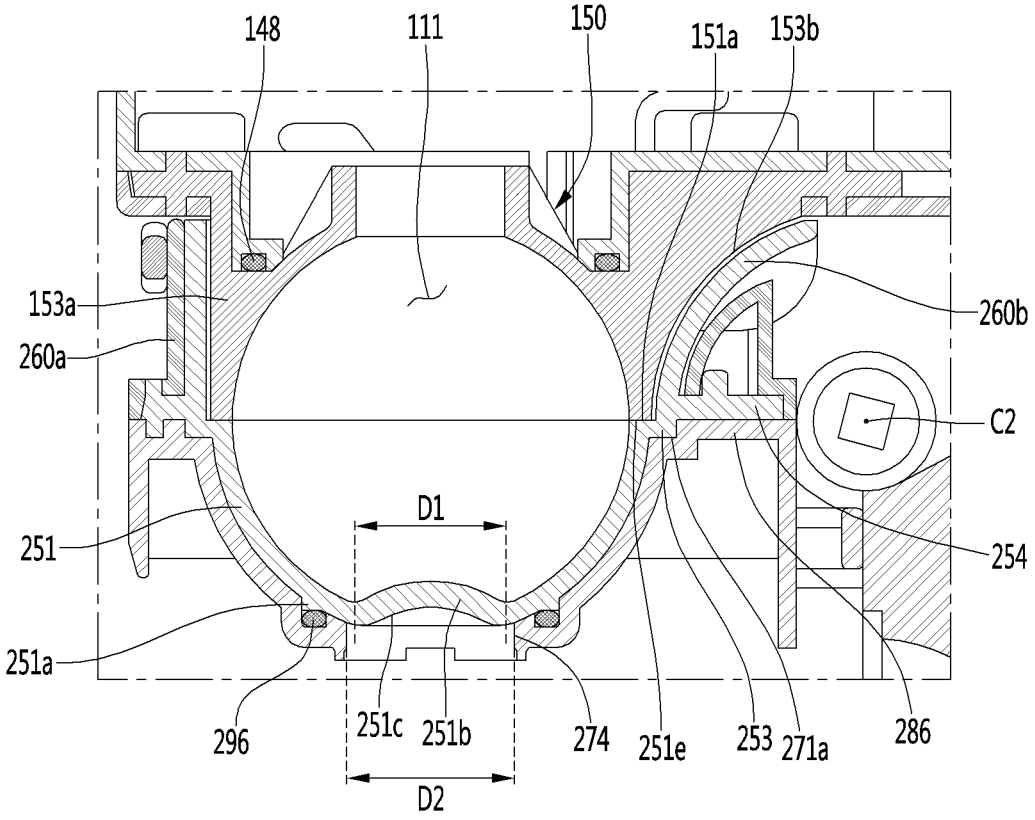
FIG. 30 is a cross-sectional view taken along line A-A of FIG. 3.
Figure 31:
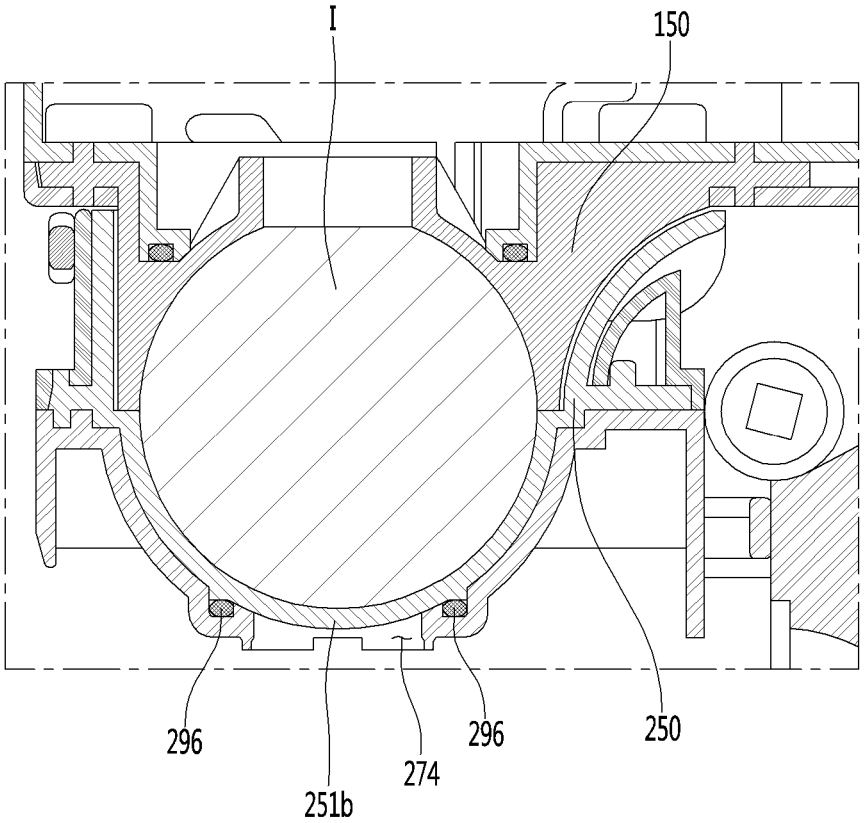
FIG. 31 is a view showing a state in which ice generation is completed in FIG. 30.

FIG. 30 is a cross-sectional view taken along line A-A of FIG. 3, and FIG. 31 is a view illustrating a state in which ice is completely made in FIG. 30.

In FIG. 30, a state in which the upper tray and the lower tray contact each other is illustrated.

Referring to FIG. 30, the upper tray 150 and the lower tray 250 vertically contact each other to complete the ice chamber 111.

The bottom surface 151*a* of the upper tray body 151 contacts the top surface 251*e* of the lower tray body 251.

Here, in the state in which the top surface 251*e* of the lower tray body 251 contacts the bottom surface 151*a* of the upper tray body 151, elastic force of the elastic member 360 is applied to the lower support 270.

The elastic force of the elastic member 360 may be applied to the lower tray 250 by the lower support 270, and thus, the top surface 251*e* of the lower tray body 251 may press the bottom surface 151*a* of the upper tray body 151.

Thus, in the state in which the top surface 251*e* of the lower tray body 251 contacts the bottom surface 151*a* of the upper tray body 151, the surfaces may be pressed with respect to each other to improve the adhesion.

As described above, when the adhesion between the top surface 251*e* of the lower tray body 251 and the bottom surface 151*a* of the upper tray increases, a gap between the two surface may not occur to prevent ice having a thin band shape along a circumference of the spherical ice from being made after the ice making is completed.

A thickness of at least portion of the chamber wall 153 defining the upper chamber 152 in the upper tray body 151 may be thicker than a thickness of a chamber wall 252*d* defining the lower chamber 252 in the lower tray body 251.

In the ice making process, when the lower heater 296 is operated, the ice starts to be frozen from the upper chamber 152. Water may be expanded in a process of a phase change to ice.

In this embodiment, as the ice grows toward the lower chamber 252 by starting to make the ice from the upper chamber 152, transparency of the made ice may be improved, and the ice having the same shape as the ice chamber may be made.

When an expansive force of the ice is applied to the upper tray body 151, if the tray body 151 is transformed, the ice may not grow to the lower chamber 252.

In accordance with this embodiment, if a thickness of at least a portion of the chamber wall 153 defining the upper chamber 152 in the upper tray body 151 is thicker than a thickness of the chamber wall 252*d* defining the lower chamber 252 in the lower tray body 251, it may be maximized that the upper tray body 151 is expanded by the expansive force of the ice. Therefore, the ice may grow from the upper chamber 152 to the lower chamber 252.

The first extension part 253 of the lower tray 250 is seated on the top surface 271*a* of the support body 271 of the lower support 270. Also, the second extension wall 286 of the lower support 270 contacts a side surface of the first extension part 253 of the lower tray 250.

The second extension part 254 of the lower tray 250 may be seated on the second extension wall 286 of the lower support 270.

In the state in which the bottom surface 151*a* of the upper tray body 151 is seated on the top surface 251*e* of the lower tray body 251, the upper tray body 151 may be accommodated in an inner space of the circumferential wall 260 of the lower tray 250.

Here, the vertical wall 153*a* of the upper tray body 151 may be disposed to face the vertical wall 260*a* of the lower tray 250, and the curved wall 153*b* of the upper tray body 151 may be disposed to face the second wall 260*b* of the lower tray 250.

An outer face of the chamber wall 153 of the upper tray body 151 is spaced apart from an inner face of the circumferential wall 260 of the lower tray 250. That is, a space may be defined between the outer face of the chamber wall 153 of the upper tray body 151 and the inner face of the circumferential wall 260 of the lower tray 250.

Water supplied through the water supply part 190 is accommodated in the ice chamber 111. When a relatively large amount of water than a volume of the ice chamber 111 is supplied, water that is not accommodated in the ice chamber 111 may flow into the space between the outer face of the chamber wall 153 of the upper tray body 151 and the inner face of the circumferential wall 260 of the lower tray 250.

Thus, according to this embodiment, even though a relatively large amount of water than the volume of the ice chamber 111 is supplied, the water may be prevented from overflowing from the ice maker 100.

A heater contact part 251*a* for allowing the contact area with the lower heater 296 to increase may be further provided on the lower tray body 251.

The heater contact portion 251*a* may protrude from the bottom surface of the lower tray body 251. In one example, the heater contact portion 251*a* may be formed in a ring shape and disposed on the bottom surface of the lower tray body 251. The bottom surface of the heater contact portion 251*a* may be planar.

The present invention is not limited, but the lower heater 296 in a state that the lower heater 296 contacts the heater contact portion 251*a* may be lower than an intermediate point of a height of the lower chamber 252.

The lower tray body 251 may further include a convex portion 251*b* in which a portion of the lower portion of the lower tray body 251 is convex upward. That is, the convex portion 251*b* may be convex toward the inside of the ice chamber 111.

A recess 251*c* may be defined below the convex portion 251*b* so that the convex portion 251*b* has substantially the same thickness as the other portion of the lower tray body 251.

In this specification, the "substantially the same" is a concept that includes completely the same shape and a shape that is not similar but there is little difference.

The convex portion 251*b* may be disposed to vertically face the lower opening 274 of the lower support 270.

The convex portion 251*b* may have a diameter D1 less than that D2 of the lower opening 274.

When cold air is supplied to the ice chamber 111 in the state in which the water is supplied to the ice chamber 111, the liquid water is phase-changed into solid ice. Here, the water may be expanded while the water is changed in phase. The expansive force of the water may be transmitted to each of the upper tray body 151 and the lower tray body 251.

In case of this embodiment, although other portions of the lower tray body 251 are surrounded by the support body 271, a portion (hereinafter, referred to as a "corresponding portion") corresponding to the lower opening 274 of the support body 271 is not surrounded.

If the lower tray body 251 has a complete hemispherical shape, when the expansive force of the water is applied to the corresponding portion of the lower tray body 251 corresponding to the lower opening 274, the corresponding portion of the lower tray body 251 is deformed toward the lower opening 274.

In this case, although the water supplied to the ice chamber 111 exists in the spherical shape before the ice is made, the corresponding portion of the lower tray body 251 is deformed after the ice is made. Thus, additional ice having a projection shape may be made from the spherical ice by a space occurring by the deformation of the corresponding portion.

Thus, in this embodiment, the convex portion 251*b* may be disposed on the lower tray body 251 in consideration of the deformation of the lower tray body 251 so that the ice has the completely spherical shape.

In this embodiment, the water supplied to the ice chamber 111 is not formed into a spherical form before the ice is generated. After the generation of the ice is completed, the convex portion 251*b* of the lower tray body 251 is deformed toward the lower opening 274, such that the spherical ice may be generated.

In the present embodiment, the diameter D1 of the convex portion 251*b* is smaller than the diameter D2 of the lower opening 274, such that the convex portion 251*b* may be deformed and positioned inside the lower opening 274.

Meanwhile, as the heat of the upper heater 148 is effectively transferred to a contact area of the upper tray 150 and the lower tray 250, the upper tray 250 can be effectively separated from the upper tray 150 in the ice separation process. Therefore, in some cases, a distance between the upper heater 148 and a contact surface of the upper tray 150 and the lower tray 250 may be less than a distance between the upper opening 154 and the contact surface of the upper tray 150 and the lower tray 250.

In some cases, the upper heater 148 may be disposed closer to the contact surface of the upper tray 150 and the lower tray 250 than to the upper opening 154.

Hereinafter, an ice making process by the ice maker according to one embodiment of the present invention will be described.

Figure 32:
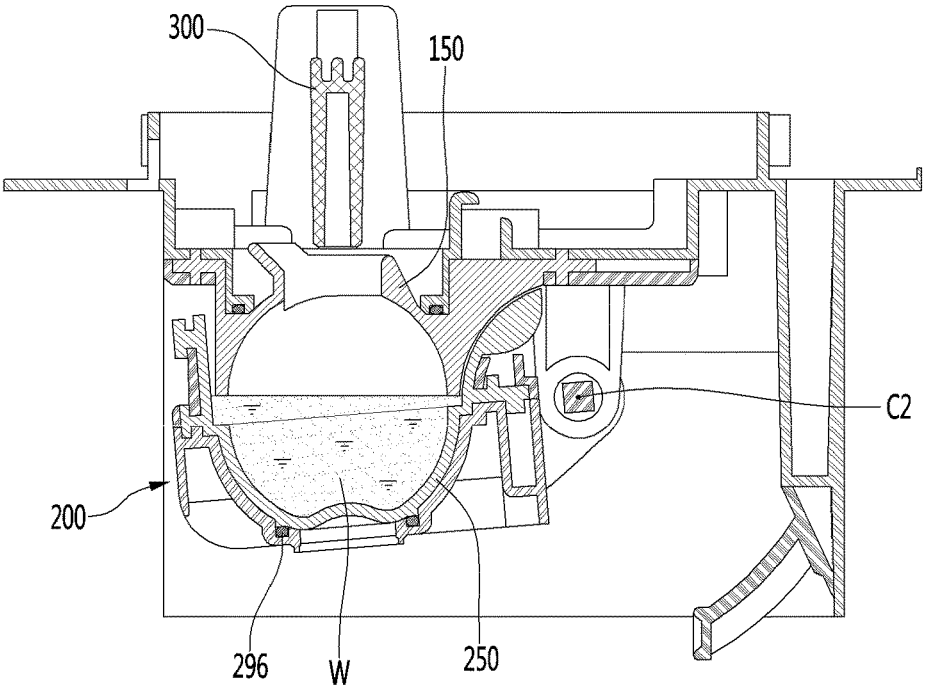
FIG. 32 is a cross-sectional view taken along line B-B of FIG. 3 in a water supplied state.

FIG. 32 is a cross-sectional view taken along line B-B of FIG. 3 in a water supply state, and FIG. 3 is a cross-sectional view taken along line B-B of FIG. 3 in an ice making state.

Figure 34:
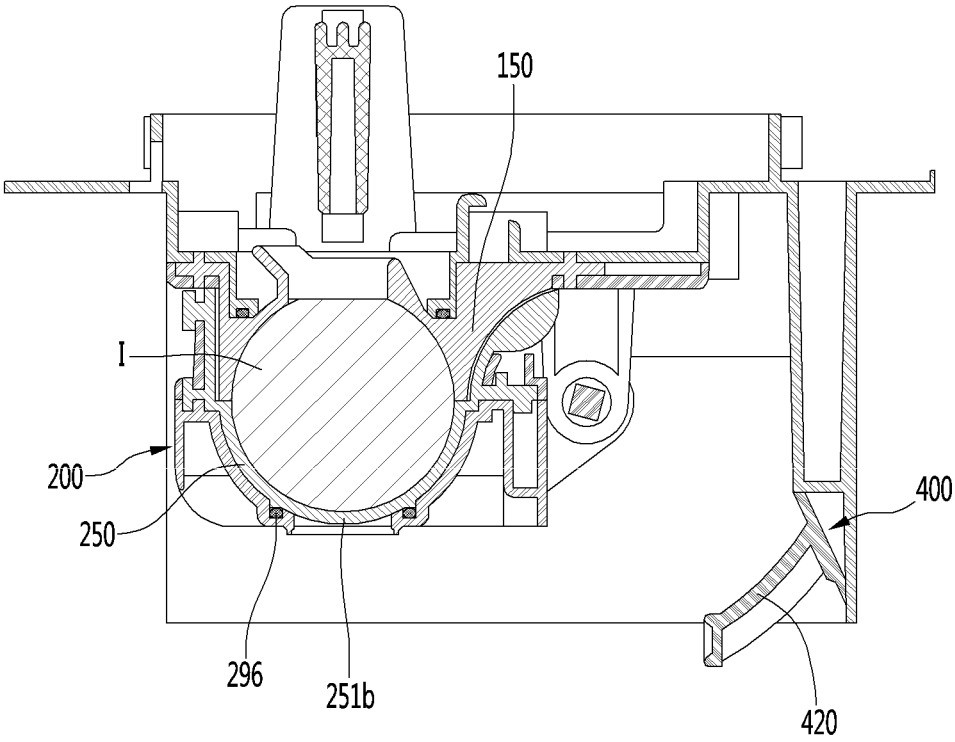
FIG. 34 is a cross-sectional view taken along line B-B of FIG. 3 in the ice-making completed state.
Figure 35:
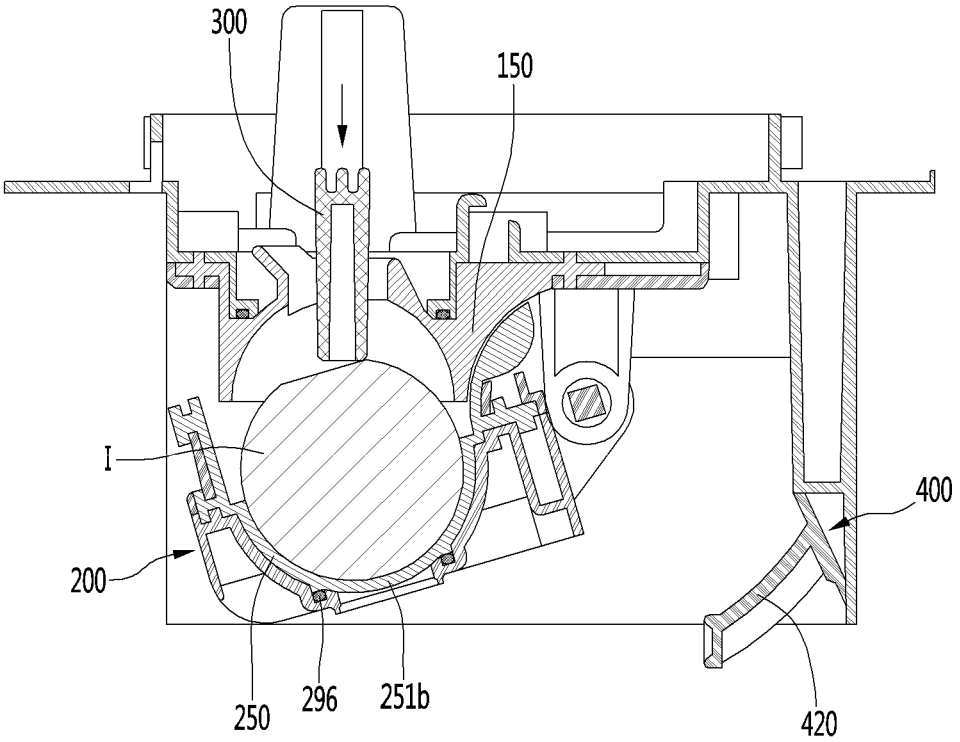
FIG. 35 is a cross-sectional view taken along line B-B of FIG. 3 in an initial state of ice separation.
Figure 36:
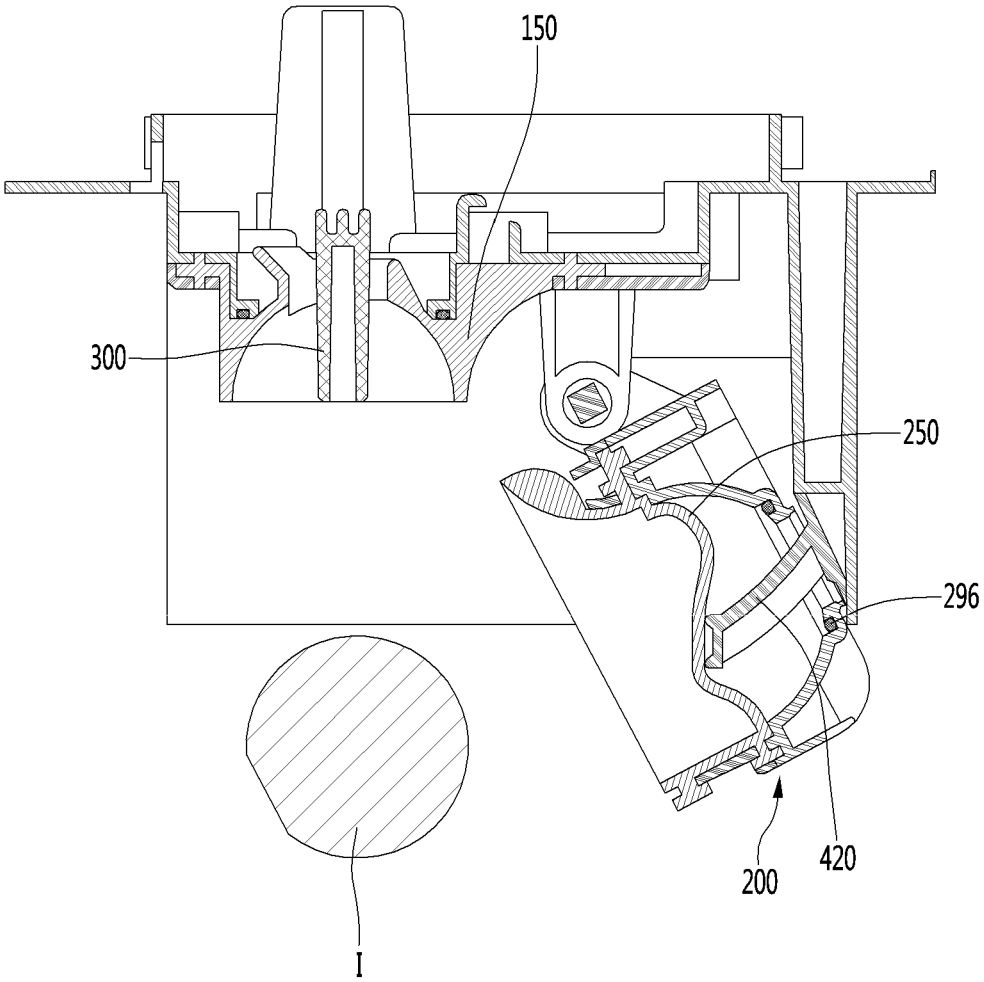
FIG. 36 is a cross-sectional view taken along line B-B of FIG. 3 in an ice-separation completed state.

FIG. 34 is a cross-sectional view taken along line B-B of FIG. 3 in a state in the ice-making completed state, FIG. 35 is a cross-sectional view taken along line B-B of FIG. 3 in an initial state of ice separation, and FIG. 36 is a cross-sectional view taken along line B-B of FIG. 3 in an ice separation completed state.

Referring to FIGS. 32 to 36, first, the lower assembly 200 rotates to a water supply position.

The top surface 251*e* of the lower tray 250 is spaced apart from the bottom surface 151*e* of the upper tray 150 at the water supply position of the lower assembly 200.

Although not limited, the bottom surface 151*e* of the upper tray 150 may be disposed at a height that is equal or similar to a rotational center C2 of the lower assembly 200.

In this embodiment, the direction in which the lower assembly 200 rotates (in a counterclockwise direction in the drawing) is referred to as a forward direction, and the opposite direction (in a clockwise direction) is referred to as a reverse direction.

Although not limited, an angle between the top surface 251*e* of the lower tray 250 and the bottom surface 151*e* of the upper tray 150 at the water supply position of the lower assembly 200 may be about 8 degrees.

In this state, the water is guided by the water supply part 190 and supplied to the ice chamber 111.

In this connection, the water is supplied to the ice chamber 111 through one upper opening of the plurality of upper openings 154 of the upper tray 150.

In the state in which the supply of the water is completed, a portion of the supplied water may be fully filled into the lower chamber 252, and the other portion of the supplied water may be fully filled into the space between the upper tray 150 and the lower tray 250.

For example, the upper chamber 151 may have the same volume as that of the space between the upper tray 150 and the lower tray 250. Thus, the water between the upper tray 150 and the lower tray 250 may be fully filled in the upper tray 150. In another example, the volume of the upper chamber 152 may be larger than the volume of the space between the upper tray 150 and the lower tray 250.

In case of this embodiment, a channel for communication between the three lower chambers 252 may be provided in the lower tray 250.

As described above, although the channel for the flow of the water is not provided in the lower tray 250, since the top surface 251*e* of the lower tray 250 and the bottom surface 151*e* of the upper tray 150 are spaced apart from each other, the water may flow to the other lower chamber along the top surface 251*e* of the lower tray 250 when the water is fully filled in a specific lower chamber in the water supply process.

Thus, the water may be fully filled in each of the plurality of lower chambers 252 of the lower tray 250.

In the case of this embodiment, since the channel for the communication between the lower chambers 252 is not provided in the lower tray 250, additional ice having a projection shape around the ice after the ice making process may be prevented being made.

Figure 33:
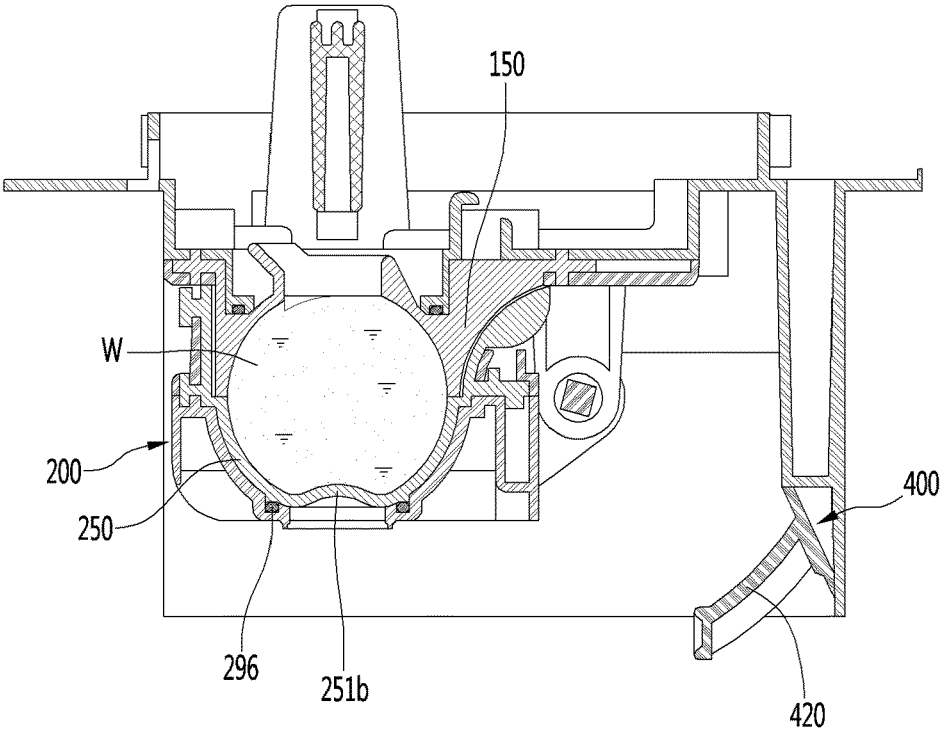
FIG. 33 is a cross-sectional view taken along line B-B of FIG. 3 in the ice-making state.

In the state in which the supply of the water is completed, as illustrated in FIG. 33, the lower assembly 200 rotates reversely. When the lower assembly 200 rotates reversely, the top surface 251*e* of the lower tray 250 is close to the bottom surface 151*e* of the upper tray 150.

Thus, the water between the top surface 251*e* of the lower tray 250 and the bottom surface 151*e* of the upper tray 150 may be divided and distributed into the plurality of upper chambers 152.

Also, when the top surface 251*e* of the lower tray 250 and the bottom surface 151*e* of the upper tray 150 are closely attached to each other, the water may be fully filled in the upper chamber 152.

In the state in which the top surface 251*e* of the lower tray 250 and the bottom surface 151*e* of the upper tray 150 are closely attached to each other, a position of the lower assembly 200 may be called an ice making position.

In the state in which the lower assembly 200 moves to the ice making position, ice making is started.

Since pressing force of water during ice making is less than the force for deforming the convex portion 251*b* of the lower tray 250, the convex portion 251*b* may not be deformed to maintain its original shape.

When the ice making is started, the lower heater 296 is turned on. When the lower heater 296 is turned on, heat of the lower heater 296 is transferred to the lower tray 250.

Thus, when the ice making is performed in the state where the lower heater 296 is turned on, ice may be made from the upper side in the ice chamber 111.

That is, water in a portion adjacent to the upper opening 154 in the ice chamber 111 is first frozen. Since ice is made from the upper side in the ice chamber 111, the bubbles in the ice chamber 111 may move downward.

Since the ice chamber 111 is formed in a sphere shape, the horizontal cross-sectional area may vary based on a height of the ice chamber 111.

Thus, the output of the lower heater 296 may vary depending on the height at which ice is produced in the ice chamber 111.

The horizontal cross-sectional area increases as it goes downwardly. Then, the horizontal cross-sectional area becomes maximum at the boundary between the upper tray 150 and the lower tray 250 and decreases as it goes downwardly again.

In the process where ice is generated from a top to a bottom in the ice chamber 111, the ice comes into contact with the top surface of the convex portion 251*b* of the lower tray 250.

In this state, when the ice is continuously made, the block part 251*b* may be pressed and deformed as shown in FIG. 34, and the spherical ice may be made when the ice making is completed.

A control unit (not shown) may determine whether the ice making is completed based on the temperature sensed by the temperature sensor 500.

The lower heater 296 may be turned off at the ice-making completion or before the ice-making completion.

When the ice-making is completed, the upper heater 148 is first turned on for the ice-removal of the ice. When the upper heater 148 is turned on, the heat of the upper heater 148 is transferred to the upper tray 150, and thus, the ice may be separated from the surface (the inner face) of the upper tray 150.

As described above, the upper heater 148 is the DC heater, and as the upper tray 150 is made of a silicone material, the upper tray 150 can be separated from the surface of the ice by the heat of the upper heater 148, and simultaneously, the local part of the ice may be prevented from being intensively melted.

After the upper heater 148 has been activated for a set time duration, the upper heater 148 may be turned off and then the drive unit 180 may be operated to rotate the lower assembly 200 in a forward direction.

As illustrated in FIG. 35, when the lower assembly 200 rotates forward, the lower tray 250 may be spaced apart from the upper tray 150.

Also, the rotation force of the lower assembly 200 may be transmitted to the upper ejector 300 by the connection unit 350. Thus, the upper ejector 300 descends by the unit guides 181 and 182, and the upper ejecting pin 320 may be inserted into the upper chamber 152 through the upper opening 154.

In the ice separating process, the ice may be separated from the upper tray 250 before the upper ejecting pin 320 presses the ice. That is, the ice may be separated from the surface of the upper tray 150 by the heat of the upper heater 148.

In this case, the ice may rotate together with the lower assembly 200 in the state of being supported by the lower tray 250.

Alternatively, even though the heat of the upper heater 148 is applied to the upper tray 150, the ice may not be separated from the surface of the upper tray 150.

Thus, when the lower assembly 200 rotates forward, the ice may be separated from the lower tray 250 in the state in which the ice is closely attached to the upper tray 150.

In this state, while the lower assembly 200 rotates, the upper ejecting pin 320 passing through the upper opening 154 may press the ice closely attached to the upper tray 150 to separate the ice from the upper tray 150. The ice separated from the upper tray 150 may be supported again by the lower tray 250.

When the ice rotates together with the lower assembly 200 in the state in which the ice is supported by the lower tray 250, even though external force is not applied to the lower tray 250, the ice may be separated from the lower tray 250 by the self-weight thereof.

While the lower assembly 200 rotates, even though the ice is not separated from the lower tray 250 by the self-weight thereof, when the lower tray 250 is pressed by the lower ejector 400 as shown in FIG. 36, the ice may be separated from the lower tray 250.

Particularly, while the lower assembly 200 rotates, the lower tray 250 may contact the lower ejecting pin 420.

When the lower assembly 200 continuously rotates forward, the lower ejecting pin 420 may press the lower tray 250 to deform the lower tray 250, and the pressing force of the lower ejecting pin 420 may be transmitted to the ice to separate the ice from the lower tray 250. The ice separated from the surface of the lower tray 250 may drop downward and be stored in the ice bin 102.

After the ice is separated from the lower tray 250, the lower assembly 200 may be rotated in the reverse direction by the drive unit 180.

When the lower ejecting pin 420 is spaced apart from the lower tray 250 in a process in which the lower assembly 200 is rotated in the reverse direction, the deformed lower tray 250 may be restored to its original form.

In the reverse rotation process of the lower assembly 200, the rotational force is transmitted to the upper ejector 300 by the connection unit 350, such that the upper ejector 300 is raised, and thus, the upper ejecting pin 320 is removed from the upper chamber 152.

When the lower assembly 200 reaches the water supply position, the drive unit 180 is stopped, and then water supply starts again.

By the proposed embodiment, as the DC heater is used as the upper heater for providing heat to the upper tray and the upper tray is made of the non-metal material, the upper tray and the ice can be separated from each other and simultaneously the heat is focused on a local part of the ice to prevent some of the ice from being melted.

As an example, if the upper tray is made of the silicone material, plastic deformation of the upper tray can be prevented despite a repetitive ice formation.

In addition, according to this embodiment, as the upper heater includes the round portion surrounding the upper chamber, the heat of the upper heater may be uniformly transferred to the upper chamber as a whole.

In addition, if the upper tray includes the plurality of upper chamber, as the upper heater includes the round portion surrounding each of the plurality of upper chambers, the heat of the upper heater may be uniformly transferred to the plurality of ice chambers.

In addition, according to this embodiment, since the upper tray supports the upper support, when the ejecting pin of the ejector is inserted into the upper chamber and pressurizes the ice, the upper tray can be prevented from drooping.

In addition, according to this embodiment, the protrusion is formed on the horizontal extension part of the upper tray and the slot into which the protrusion is inserted is provided in the upper support, the horizontal extension part can be prevented from being stretched in the ice separation process, and accordingly, the upper ejector and the upper opening of the upper tray may remain in a state of alignment.

In addition, since the unit guide for guiding the upper ejector includes the upper support, it can be minimized that a transfer force of the ejector is transmitted to the upper case, and accordingly, the deformation of the upper case can be prevented.

What is claimed is:

1. An ice maker comprising:

a first tray assembly comprising:

a first tray that defines a first chamber, and a first support that supports the first tray;

a second tray assembly comprising a second tray that defines a second chamber configured to define an ice chamber with the first chamber, the ice chamber being configured to receive water; and a first heater configured to supply heat to the first tray to thereby cause bubbles in the water received in the ice chamber to move toward one side of the first tray during an ice-making process, wherein the first tray comprises:

a first chamber wall that defines the first chamber, and a first extending portion that extends from the first chamber wall toward an outer edge of the first support, the first extending portion being in contact with the first support, wherein the first support defines:

a chamber accommodation part configured to accommodate the first chamber wall, and a first opening that exposes at least a portion of the first chamber wall accommodated in the chamber accommodation part to an outside of the first support during the ice-making process, wherein the first heater is disposed in the chamber accommodation part and disposed closer to the first opening than to the outer edge of the first support, wherein an inner circumferential surface of the chamber accommodation part has a shape corresponding to a shape of an outer circumferential surface of the first chamber wall, and wherein at least a portion of the outer circumferential surface of the first chamber wall is in direct contact with the inner circumferential surface of the chamber accommodation part during the ice-making process.

2. The ice maker according to claim 1, wherein the first tray and the second tray are configured to contact each other to thereby close the ice chamber.

3. The ice maker according to claim 2, wherein the first heater is disposed closer to the first opening than to a contact surface between the first tray and the second tray.

4. The ice maker according to claim 1, wherein the first heater comprises a round portion that surrounds a portion of the first opening.

5. The ice maker according to claim 1, wherein the first chamber wall comprises:

a first portion surrounded by the first support and configured to contact the first support during the ice-making process; and a second portion exposed through the first opening and configured not to contact the first support during the ice-making process.

6. The ice maker according to claim 5, wherein a surface area of the first portion is greater than a surface area of the second portion.

7. The ice maker according to claim 1, further comprising an ejector configured to, based on the first and second trays being separated from each other to open the ice chamber, pass through the first opening to thereby separate ice from the ice chamber.

8. The ice maker according to claim 7, wherein the ejector is configured to, based on the ejector passing through the first opening, apply pressure to the first chamber wall to thereby deform the first chamber wall and detach the first chamber wall from the first heater, and wherein the first chamber wall is configured to, based on a decrease of the pressure applied to the first chamber wall, return to a first shape and contact the first heater.

9. The ice maker according to claim 1, wherein at least one of the first tray or the second tray is made of a flexible material including silicone.

10. The ice maker according to claim 1, wherein the first tray assembly further comprises a first case that couples to the first extending portion.

11. The ice maker according to claim 10, wherein the second tray comprises:

a second chamber wall that defines the second chamber; and a second extending portion that extends outward from the second chamber wall and defines an outer edge of the second tray, and wherein the second tray assembly further comprises:

a second support that supports the second extending portion, and a second case that couples to the second extending portion.

12. The ice maker according to claim 10, wherein the first and second trays are configured to, based on relative movement between the first tray assembly and the second tray assembly, define (i) a closed position of the ice chamber in which the first and second trays are in contact with each other and (ii) an opened position of the ice chamber in which the first and second trays are separated from each other.

13. The ice maker according to claim 1, wherein the first chamber is one of a plurality of first chambers, and the second chamber is one of a plurality of second chambers, wherein the chamber accommodation part is one of a plurality of chamber accommodation parts, and the first opening is one of a plurality of first openings, and wherein a number of the plurality of first chamber, a number of the plurality of second chambers, a number of the plurality of chamber accommodation parts, and a number of the plurality of first openings are equal to one another.

14. The ice maker according to claim 1, wherein the chamber accommodation part is configured to maintain a shape of the ice chamber during the ice-making process based on the inner circumferential surface of the chamber accommodation part being in direct contact with the outer circumferential surface of the first chamber wall.

15. An ice maker comprising:

a tray body made of a flexible material, the tray body comprising a plurality of chamber walls arranged along a first direction and configured to define a plurality of ice chambers, the plurality of ice chambers being configured to receive water therein;

a support that defines a chamber accommodation part configured to accommodate at least a portion of the plurality of chamber walls; and a first heater that is disposed in the chamber accommodation part and in contact with an outer circumferential surface of the plurality of chamber walls, the first heater being configured to supply heat to the plurality of ice chambers to thereby cause bubbles in the water received in the plurality of ice chambers to move toward one side of the plurality of ice chambers during an ice-making process, wherein the support further defines a plurality of openings at positions corresponding to the plurality of ice chambers, respectively, the plurality of openings being arranged along the first direction and exposing portions of the plurality of chamber walls to an outside of the support during the ice-making process, wherein one of the plurality of openings passes through the chamber accommodation part, wherein the first heater is disposed closer to the one of the plurality of openings than to at least a portion of an outer circumference of the chamber accommodation part, wherein an inner circumferential surface of the chamber accommodation part has a shape corresponding to a shape of the outer circumferential surface of the plurality of chamber walls, and wherein at least a portion of the outer circumferential surface of the plurality of chamber walls is in direct contact with the inner circumferential surface of the chamber accommodation part in the ice-making process.

16. The ice maker of claim 15, wherein the first heater is disposed closer to the one of the plurality of openings than to any part of the outer circumference of the chamber accommodation part.

17. The ice maker of claim 15, wherein the first heater comprises a plurality of round portions that surround the plurality of openings, respectively.

18. The ice maker of claim 17, wherein a diameter of each the plurality of round portions is greater than a diameter of a corresponding one of the plurality of openings.

19. The ice maker according to claim 15, wherein each of the plurality of chamber walls comprises:

a first portion surrounded by the support and configured to contact the support during the ice-making process; and a second portion exposed through one of the plurality of openings and configured not to contact the support during the ice-making process.

20. The ice maker according to claim 19, wherein a surface area of the first portion is greater than a surface area of the second portion.

21. The ice maker according to claim 15, further comprising an ejector configured to pass through the plurality of openings to thereby separate ice from the plurality of ice chambers.

22. The ice maker according to claim 21, wherein the ejector is configured to, based on the ejector passing through the plurality of openings, apply pressure to the plurality of chamber walls to thereby deform the plurality of chamber walls and detach the plurality of chamber walls from the first heater.

23. The ice maker according to claim 22, wherein the plurality of chamber walls are configured to, based on a decrease of the pressure applied to the plurality of chamber walls, return to a first shape and contact the first heater.

24. The ice maker according to claim 21, wherein the ejector comprises a plurality of ejector pins configured to pass through the plurality of openings, respectively.

25. The ice maker according to claim 15, wherein the chamber accommodation part is configured to maintain a shape of each of the plurality of ice chambers in the ice-making process based on the inner circumferential surface of the chamber accommodation part being in direct contact with the outer circumferential surface of the plurality of chamber walls.

* * * * *